US009612546B2

(12) United States Patent
Hiroshi et al.

(10) Patent No.: US 9,612,546 B2
(45) Date of Patent: Apr. 4, 2017

(54) EXTERNAL ADDITIVE FOR TONER, METHOD OF PRODUCING THE SAME, AND TONER COMPRISING THE SAME

(71) Applicant: SAMSUNG ELECTRONICS CO., LTD., Suwon-si, Gyeonggi-do (KR)

(72) Inventors: Miyao Hiroshi, Yokohama (JP); Hiromichi Jin, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/980,074

(22) Filed: Dec. 28, 2015

(65) Prior Publication Data

US 2016/0187799 A1 Jun. 30, 2016

(30) Foreign Application Priority Data

Dec. 26, 2014 (JP) ..... 2014-265563
Apr. 9, 2015 (JP) ..... 2015-080007
Aug. 28, 2015 (KR) ..... 10-2015-0121503

(51) Int. Cl.
*G03G 9/097* (2006.01)

(52) U.S. Cl.
CPC ..... *G03G 9/09775* (2013.01)

(58) Field of Classification Search
CPC ..... G03G 9/09775; Y10T 428/2982
USPC ..... 430/108.7; 428/402; 556/483
See application file for complete search history.

(56) References Cited

U.S. PATENT DOCUMENTS

| | | | | |
|---|---|---|---|---|
| 5,346,797 | A | 9/1994 | Kmiecik-Lawrynowicz et al. | |
| 2005/0255398 | A1* | 11/2005 | Hiraoka | G03G 9/0804 430/109.4 |
| 2006/0257777 | A1* | 11/2006 | Matsumura | G03G 9/0804 430/109.4 |
| 2007/0009823 | A1 | 1/2007 | Skorokhod et al. | |
| 2007/0092822 | A1 | 4/2007 | Matsumura et al. | |
| 2007/0196758 | A1 | 8/2007 | Sasaki et al. | |
| 2009/0123864 | A1 | 5/2009 | Sacripante et al. | |
| 2010/0047705 | A1 | 2/2010 | Sasaki et al. | |
| 2010/0178605 | A1 | 7/2010 | Koo et al. | |
| 2011/0151368 | A1* | 6/2011 | Hong | G03G 9/0819 430/108.8 |
| 2012/0202149 | A1 | 8/2012 | Lee et al. | |
| 2012/0214096 | A1* | 8/2012 | Pang | G03G 9/08782 430/108.4 |
| 2013/0137029 | A1 | 5/2013 | Kadonome et al. | |

FOREIGN PATENT DOCUMENTS

| | | |
|---|---|---|
| JP | 63282752 | 11/1988 |
| JP | 627718 | 2/1994 |
| JP | 6250439 | 9/1994 |
| JP | 11143118 | 5/1999 |
| JP | 200691124 | 4/2006 |
| JP | 2006259460 | 9/2006 |
| JP | 200779205 | 3/2007 |
| JP | 3957590 B2 | 8/2007 |
| JP | 2007217249 | 8/2007 |
| JP | 2007225838 | 9/2007 |
| JP | 2007264142 | 10/2007 |
| JP | 2008262149 | 10/2008 |
| JP | 2010217588 | 9/2010 |
| JP | 2010224461 | 10/2010 |
| JP | 2010244033 | 10/2010 |
| JP | 201127791 | 2/2011 |
| JP | 2012163623 | 8/2012 |
| JP | 2012168222 | 9/2012 |
| JP | 201364819 | 4/2013 |
| JP | 2013137508 | 7/2013 |
| JP | 2013205609 | 10/2013 |
| JP | 2014178626 | 9/2014 |
| KR | 1020070044340 | 4/2007 |
| KR | 1020100084016 | 7/2010 |
| KR | 1020120090597 | 8/2012 |

OTHER PUBLICATIONS

Extended European Search Report issued on Jun. 8, 2016 in counterpart European Application No. 16155936.4 (5 pages).

* cited by examiner

*Primary Examiner* — Leszek Kiliman
(74) *Attorney, Agent, or Firm* — NSIP Law

(57) ABSTRACT

An external additive for toner includes a particulate obtained from a silicone compound selected from a silane compound represented by Chemical Formula 1, $Si(OR^1)_4$, wherein each $R^1$ is independently a C1 to C6 monovalent hydrocarbon group, a hydrolysis-condensation product of the silane compound, and a combination thereof, wherein the particulate has an average particle diameter ranging from about 50 nm to about 250 nm and a true density ranging from about 1.80 g/cm$^3$ to about 2.00 g/cm$^3$.

21 Claims, 2 Drawing Sheets

EXTERNAL ADDITIVE FOR TONER, METHOD OF PRODUCING THE SAME, AND TONER COMPRISING THE SAME

This application claims priority to Japanese Patent Application No. 2014-265563 filed Dec. 26, 2014, Japanese Patent Application No. 2015-080007 filed Apr. 9, 2015, and Korean Patent Application No. 10-2015-0121503 filed Aug. 28, 2015, and all the benefits accruing therefrom under 35 U.S.C. §119, the entire contents of which are each incorporated herein by reference.

BACKGROUND

1. Field

An external additive for toner applicable to an image forming apparatus, a process for producing the same, and a toner including the same are disclosed.

2. Description of the Related Art

An image forming apparatus, which is a device such as an electrofax forming an electrostatic image and exposing the same to light to visualize the image information, has been widely used in various technical fields.

Among these apparatuses, the electrofax forms an electrostatic image on a photoreceptor through a charge process and a photolithography process and develops the electrostatic image by a developer including toner, and then visualizes the developed electrostatic image through a transferring process and a fixing process.

The developer used in the electrofax may be broadly classified into a two-component developer, including a toner and a carrier, or a one-component developer, including a magnetic toner or a non-magnetic toner. Both kinds of developers generally include an external additive for the toner added on the surface of toner particles to improve the liquidity or cleaning property of the toner.

The external additive for the toner is a particulate including an inorganic compound or an organic compound, and the force between the toner particle and the external additive for the toner may be governed by electrostatic attractive force (coulombic force) and/or physical force (Van der Waals force), but it is generally governed by electrostatic attractive force.

SUMMARY

The present disclosure provides an external additive for toner having excellent adhesion to toner particles and excellent mechanical strength that suppresses toner degradation and image defects; a method of producing the external additive; and a toner including the external additive.

According to one embodiment, an external additive for toner includes a particulate obtained from a silicone compound selected from a silane compound represented by Chemical Formula 1, a hydrolysis-condensation product of the silane compound, and a combination thereof, wherein the particulate has an average particle diameter of ranging from about 50 nm to about 250 nm and a true density ranging from about 1.80 g/cm$^3$ to about 2.00 g/cm$^3$.

The Chemical Formula 1 is as follows.

$Si(OR^1)_4$ (each $R^1$ is independently a C1 to C6 monovalent hydrocarbon group).

In an exemplary embodiment, a first specific surface area ($\alpha$) of the particulate, measured by a gas adsorption method, may be about 13 m$^2$/g to about 90 m$^2$/g, and a ratio ($\alpha/\beta$) of the first specific surface area ($\alpha$) relative to the second specific surface area ($\beta$), calculated from an average particle diameter, may be about 0.85 to about 1.75.

In an exemplary embodiment, a gas desorption time at measurement of the first specific surface area ($\alpha$) may range from about 3 min to about 10 min.

In an exemplary embodiment, the average particle diameter may be obtained by a dynamic light scattering method.

In an exemplary embodiment, a ratio of the gas adsorption time relative to the gas desorption time may range from about 0.5 to about 1.0.

In an exemplary embodiment, a loss on heating of the particulate may be about 3 wt % to about 13 wt % when increasing temperature from room temperature up to about 500° C.

In an exemplary embodiment, the particulate may include a hydrophobic group on its surface.

In an exemplary embodiment, the hydrophobic group may include a trialkylsilyl group, a triphenylsilyl group, a diphenylmonoalkylsilyl group, a dialkylmonophenylsilyl group, and a combination thereof.

In an exemplary embodiment, a hydrophobization degree on the surface of the particulate may range from about 30 volume % to about 80 volume %.

In an exemplary embodiment, the hydrophobic group may be introduced on the surface of the particulate by contacting the surface of the particulate with a compound selected from a silazane compound represented by $R^2{}_3SiNHSiR^2{}_3$ (wherein each $R^2$ is independently a C1 to C6 monovalent hydrocarbon group), a silane compound represented by $R^3{}_3SiX$ (wherein each $R^3$ is independently a C1 to C6 monovalent hydrocarbon group, and X is a hydroxyl group (—OH) or a hydrolytic group), and a combination thereof and introducing a trialkylsilyl group on the surface of particulate.

In an exemplary embodiment, the particulate has an average aspect ratio of about 1.00 to about 1.25 and includes a protruding portion present outside a maximum inscribed circle when the maximum inscribed circle is defined based on the contour of a transmission electron microscope image, wherein the protruding portion has an average maximum length ranging from about 25 nm to about 45 nm, which is an average length of the chord connecting both ends of a circular arc of the maximum inscribed circle for the area in the shortest distance; a variation coefficient of the average maximum length ranging from about 10% to about 35%; a ratio of the average maximum length to the average particle diameter of the particulate ranging from about 0.12 to about 0.30; an average maximum height ranging from about 5 nm to about 15 nm, which is an average of the shortest distance between the chord and the farthest point of the area outside the maximum inscribed circle from the chord in a radial direction; the variation coefficient of the average maximum height ranging from about 20% to about 45%; and a ratio of the average maximum height to the average particle diameter ranging from about 0.05 to about 0.15.

In an exemplary embodiment, a ratio of the average maximum height to the average maximum length may range from about 0.2 to about 0.4.

According to another embodiment, a method of producing an external additive for toner including a particulate obtained from a silicone compound selected from a silane compound represented by Chemical Formula 1, a hydrolysis-condensation product of the silane compound, and a combination thereof, includes: mixing a silicon-containing component including the silicone compound and a catalyst-containing component including a basic compound to prepare a mixed solution; and maintaining the mixed solution at a first temperature (T1) for a first time (t1), and then maintaining the mixed solution at a second temperature (T2) for a second time (t2) to perform a condensation reaction of the silicone compound to prepare a particulate dispersed in the mixed solution.

In an exemplary embodiment, when the silicon-containing component and the catalyst-containing component are mixed, the temperature of the silicon-containing component (TA, in ° C.) and the temperature of the catalyst-containing component (TB, in ° C.) may satisfy the following relationships: 2° C.<TA<60° C., TA<TB, and TB−40° C.<TA<TB−3° C.

In an exemplary embodiment, when the silicon-containing component and the catalyst-containing component are mixed, the temperature of the silicon-containing component (TA, in ° C.) and the temperature of the catalyst-containing component (TB, in ° C.) may satisfy the following relationships: 0° C.≤TA≤10° C., 20° C.≤TB≤50° C., and 10° C.≤TB−TA≤50° C.

In an exemplary embodiment, the value from integrating the first temperature (T1) over the first time (t1) may range from 5° C.·hour to 90° C.·hour, and the value from integrating the second temperature (T2) over the second time (t2) may range from about 200° C.·hour to about 700° C.·hour.

In an exemplary embodiment, the first temperature (T1) and the second temperature (T2) may satisfy the relationships of 5° C.≤T1≤15° C., 30° C.≤T2≤50° C. and 15° C.≤T2≤−T1≤45° C., and the obtained particulate may include a protruded portion on the surface thereof.

In an exemplary embodiment, when going from the first temperature (T1) to the second temperature (T2), the temperature increasing rate may range from about 0.5° C./minute to 10° C./minute.

In an exemplary embodiment, the method may further include hydrophobizing the surface of the particulate.

In yet another embodiment, a toner is disclosed which includes an external additive for toner disclosed herein or an external additive for toner produced by the method disclosed herein.

Recently, the electrofax technique is being developed in a direction toward higher speed and lower energy consumption, so the toner is required to have a high degradation resistance. Unless the toner has high degradation resistance, it is difficult to maintain high transfer efficiency of the toner continuously during the image forming process.

One solution that has been suggested for suppressing toner degradation is a technique using the spacer effects of an external additive having a large particle diameter.

When a small particle diameter external additive and a large particle diameter external additive are used in combination as the external additive, direct external forces such as the shearing force or the impact force and the like, are less applied to the small particle diameter external additive due to the large particle diameter external additive. The large particle diameter external additive may prevent the small particle diameter external additive from being buried in the surface of toner particle (spacer effect), which may suppress toner degradation.

BRIEF DESCRIPTION OF THE DRAWINGS

The above and other advantages and features of this disclosure will become more apparent by describing in further detail exemplary embodiments thereof with reference to the accompanying drawings, in which.

DETAILED DESCRIPTION

Figure 1:
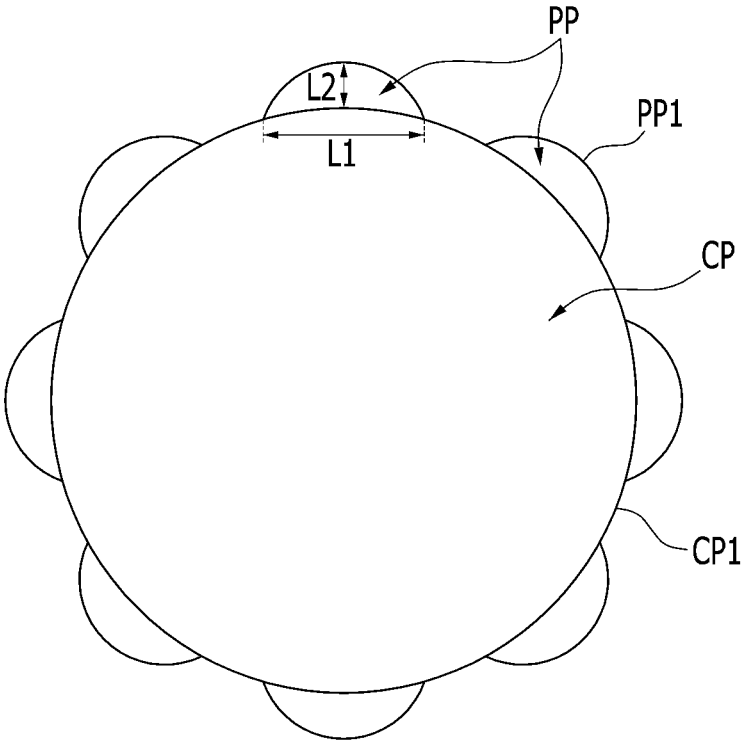
FIG. 1 is a schematic diagram of an image obtained with a transmission electron microscope (hereinafter, referred to as "TEM") of an exemplary embodiment of a particulate for use as an external additive for a toner according to one exemplary embodiment.

Exemplary embodiments of the invention will hereinafter be described in detail. However, this invention may be embodied in many different forms, and should not be construed as limited to the exemplary embodiments set forth herein. Rather, these embodiments are provided so that this disclosure will be thorough and complete, and will fully convey the scope of the invention to those skilled in the art.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

A. External Additive for Toner

An external additive for toner according to one embodiment includes a particulate consisting of a silicone compound selected from a silane compound represented by Chemical Formula 1, a hydrolysis-condensation product of the silane compound, and a combination thereof.

Chemical Formula 1 is as follows.

$$Si(OR^1)_4 \qquad \text{[Chemical Formula 1]}$$

(each $R^1$ is independently a C1 to C6 monovalent hydrocarbon group)

A raw material for forming the particulate may include a tetrafunctional silane compound represented by Chemical Formula 1 or a hydrolysis-condensation product of the silane compound.

The silane compound may be, for example, tetramethoxysilane, trimethoxymonoethoxysilane, dimethoxydiethoxysilane, triethoxymonomethoxysilane, tetraethoxysilane and the like, as a monomer, but is not limited thereto.

The hydrolysis-condensation product of the silane compound is a hydrolysis-condensation product obtained by a condensation reaction of a hydrolyzable functional group, such as a methoxy group or an ethoxy group, of the silane compound, and may be a dimer or an oligomer, but is not limited thereto.

By performing the condensation polymerization of the silane compound, the hydrolysis-condensation product of the silane compound, or a combination thereof, an alkoxy group (O—$R^1$) in the compound becomes a hydroxyl group (—OH), and water ($H_2O$) is released by the condensation polymerization between hydroxyl groups (—OH) to provide a silicone compound particulate formed with a siloxane group (Si—O—Si) converted from a silanol group (Si—OH).

Since the obtained particulate has a structure in which a plurality of siloxane groups (Si—O—Si) is formed, the particulate may satisfy the strength required for an external additive for toner.

A residual hydroxyl group (—OH) may be present on the surface of the particulate after the condensation polymerization. The residual hydroxyl group (—OH) on the surface of the particulate may be bonded with hydrophobic groups, described elsewhere herein, and hydrophobized.

The obtained particulate may have a spherical shape or an ovoid shape. On the other hand, the particulate may have a shape in which a plurality of protruding portions protrude from the outer circumferential surface of a "mother particle" having a spherical shape or an ovoid shape.

According to one embodiment, for convenience, the term "first shape" refers herein to a spherical shape or an ovoid shape formed with no protruding portions; and the term "second shape" refers to a shape in which a plurality of protruding portions is protruded from the outer circumferential surface of the spherical shape or the ovoid shape of a mother particle.

Hereinafter, the physical properties of a particulate having f the first shape or the second shape according to one embodiment and the method of measuring the same are described in more detail.

Herein, if a particulate is described without specifying its shape as the first shape or the second shape, it may be understood that the description is for the common points of a particulate having the first shape or the second shape. In addition, even if a property of a particulate is calculated by a measuring method different from the measuring method(s) disclosed herein, the particulate belongs within the scope of the invention when the results measured by the measuring method of the present invention is included in the range of the present invention.

Property 1. Average Particle Diameter

Among the properties of the particulate formed by one embodiment, the average particle diameter may be the average particle diameter obtained by a dynamic light scattering method.

The dynamic light scattering method, which is a method of measuring an average particle diameter of a particulate, is a method of measuring particle diameter by irradiating a particulate with laser light and calculating how the scattering intensity of scattering light is changed by the particle diameter of the particulate.

More specifically, a predetermined amount of external additive for toner including particulate is mixed with a methanol solvent and then by application of an ultrasonic wave the particulate is dispersed in the solvent to provide a dispersion. The dispersion is input into a measuring cell of a glass material and then introduced into a device for measuring a dynamic light scattering particle distribution (e.g., Model ELSZ1000ZS, manufactured by Otsuka Electronics).

Then the measuring cell is irradiated with laser light and the dynamic light scattering intensity of the dispersion solution is measured. When the particle diameter distribution calculated from the measured scattering intensity is illustrated in a two-dimensional coordinate system having a vertical axis of the scattering intensity and a horizontal axis of particle diameter, the average particle diameter is defined as the particulate diameter (median diameter: "D50"). The D50 is the particle diameter that splits the distribution with 50% of the total number of particles above and 50% of the total number of particles below this diameter.

Further, based on the particle distribution, the ratio ("D90/D10") of the particulate diameter can be determined. The parameter "D90" refers to the particle diameter that splits the distribution such that 90% of the number of particulates in the distribution have a particle diameter below the D90 value and the particulate diameter "D10" refers to the particle diameter that splits the distribution such that 10% of the number of particulates in the distribution have a particle diameter below the D10 value The ratio "D90/D10" means the deviation of the dynamic light scattering particle diameter distribution, and the deviation of dynamic light scattering particle diameter distribution may be, for example, less than or equal to about 2.30. When the deviation of dynamic light scattering particle distribution is greater than about 2.30, the particle distribution is excessively wide to increase the deviation of average particle diameter.

In one embodiment, average particle diameter of the particulate is a volume-average particle diameter and may be, for example, about 50 nm to about 250 nm, for example, about 50 nm to about 200 nm, for example about, about 100 nm to about 200 nm, for example, about 110 nm to about 150 nm.

When the particulate has an average particle diameter of less than about 50 nm, the size difference between a large particle diameter external additive having a relatively large particle diameter and a small particle diameter external additive having a relatively small particle diameter is less, so that it is difficult to provide a space effect by the large particle diameter external additive. When the particulate has an average particle diameter of greater than about 200 nm, the large particle diameter external additive and the small particle diameter external additive have an excessively high deviation, so that the adhesive force between the particulate and the toner particle may be deteriorated.

In other words, when the particulate has an average particle diameter within the disclosed range, it may have excellent adhesion to the toner particle, and also it may suppress the toner degradation by imparting a space effect when a large particle diameter external additive is used as the external additive including particulate.

Property 2. True Density

According to one embodiment, a "true density" is the specific gravity calculated from the measured volume and mass of a particulate. The true density of particulate may be obtained by a measuring device capable of measuring the volume and mass of a particulate.

More specifically, about 1.5 g of particulate is input into a dry-auto density measurer (Aqupic II Series 1340, manufactured by Shimadzu). Then, volume and mass of the added particulate are measured, and the value of mass to volume of particulate is calculated from the measured values, so that the true density of the particulate may be obtained.

According to one embodiment, the true density of the particulate may be, for example, about 1.80 g/cm$^3$ to about 2.00 g/cm$^3$, for example, about 1.85 g/cm$^3$ to about 1.98 g/cm$^3$, for example, about 1.90 g/cm$^3$ to about 1.98 g/cm$^3$.

When the true density is less than about 1.80 g/cm$^3$, the particulate has excessively light weight, so that the strength of particulate may be deteriorated; when the true density is greater than about 2.00 g/cm$^3$, the particulate has excessively heavy weight, so that the impact force of toner particle may be increased.

In other words, when the true density is within the disclosed range, the particulate may have a relatively light weight and may also decrease the impact force to the toner particle, so as to suppress toner degradation.

Property 3. Loss on Heating

Among the properties of the particulate obtained according to one embodiment, the property "loss on heating" refers to how the mass is decreased when the temperature is increased up to 500° C. from room temperature. That is, the "loss on heating" refers to a ratio of the dried weight of particulate at 500° C. relative to the dried weight of particulate at a room temperature. The decreased amount of weight after heating to 500° C. indicates the amount of water remaining in the particulate and the amount of unreacted residuals from the condensation polymerization reaction present in the silicone compound.

The water amount in the particulate affects the electrification of particulate, which affects adhesion to the toner particle. Accordingly, the particulate may be controlled to have a loss on heating sufficient to provide a toner particle with excellent adhesion and also to contain an appropriate amount of moisture even if the particulate is applied with an excessive charge, particularly, under low temperature/low humidity conditions, in order to suppress excessive electrification; and to prevent toner coalescence on the photoreceptor surface or underlayer formation on the image member, which are causes for the member contamination, so as to suppress toner degradation.

According to one embodiment, the loss on heating may be measured by a simultaneous thermogravimetry/differential thermal analysis ("TGDTA"). More specifically, a predetermined amount of particulate is input into an aluminum container under an argon (Ar) atmosphere, and the aluminum container is introduced into a device for measuring the simultaneous thermogravimetry/differential thermal analysis (TG/DTA6200, manufactured by Seiko Instrument) and heated from room temperature (25° C.) to about 500° C. at a rate of about 3° C./minute.

The weight of the aluminum container is weighed by a balance in the measuring device during the heating. After completing the heating, the difference between the weight after the heating and before the heating is compared to obtain the loss on heating.

In one embodiment, the loss on heating of the particulate may be, for example, about 3 wt % to about 13 wt %, for example, about 3 wt % to about 10 wt %, for example, about 5 wt % to about 8 wt %.

When the loss on heating is less than about 3%, the particulate has too high a quantity of electric charge to suppress toner coalescence on the surface of the photoreceptor and underlayer formation on the developing member, so that it may not sufficiently suppress image degradation. When the loss on heating is greater than about 13%, the particulate has an excessively low quantity of electric charge such that the particulate may easily escape from the toner particle, so that it may not sufficiently suppress toner degradation. Particularly under a low temperature/low humidity atmosphere, excessive electrification may be not suppressed when excessively charge is applied to the particle, so that it may not sufficiently suppress image degradation.

Property 4. Hydrophobization Degree

Among properties of the particulate obtained from one embodiment, the "hydrophobization degree" refers to the ratio of hydrophobic groups formed on the surface of the particulate relative to the entire particulate surface. The hydrophobic group may provide hydrophobicity on the surface of the particulate and reduce the hygroscopicity of the particulate, so that the quantity of electric charge of the external additive and the toner may be maintained at an appropriate level.

According to one embodiment, by using a trialkylsilyl group as the hydrophobic group, the effect on decreasing hygroscopicity of particulate may be enhanced, and the external additive and toner may maintain an appropriate level of a quantity of electric charge, but the scope of the present invention is not limited thereto. The hydrophobic group may include various hydrophobic groups capable of providing hydrophobicity on the particulate surface, for example, any one of a trialkylsilyl group, a triphenylsilyl group, a diphenylmonoalkylsilyl group, and a dialkylmonophenylsilyl group.

According to one embodiment, the method of measuring a hydrophobization degree includes methanol titration. More specifically, a predetermined amount of deionized water and a particulate powder are input into a beaker and titrated with methanol from a burette while the dispersion of the hydrophobic particulate powder is agitated by magnetic stirring.

With increasing methanol concentration in the beaker, the particulate powder is slowly precipitated, and the volume fraction of methanol in the methanol-water mixed solution when the entire amount of particulate powder is precipitated is defined as a hydrophobization degree (volume %) of hydrophobic particulate powder.

In an exemplary embodiment, the hydrophobization degree of the particulate may be, for example, about 30 volume % to about 80 volume %, for example, about 50 volume % to about 80 volume %.

When the hydrophobization degree is less than about 30 volume %, the hygroscopicity of particulate is increased, so the electrification of the external additive and the toner is deteriorated; and it is practically impossible to produce particulate having a hydrophobic degree of greater than about 80 volume %.

Property 5. First Specific Surface Area

Among the properties of the particulate according to one embodiment, the property "first specific surface area" (α) refers to the specific surface area of the particulate measured by gas adsorption. The first specific surface area (α) is a function of the surface structure and particle diameter of the particulate, which affect the ability of the particulate to suppress toner degradation and simultaneously to improve the adhesion to the toner when attaching particulates the toner particle and to impart a spacer effect when a large particle diameter external additive is used in a toner.

The gas adsorption method for measuring the first specific surface area (α) according to one embodiment is, for example, a method including: inputting a particulate into a measuring cell, spraying an adsorptive gas on the surface of the particulate to be contacted to each other while monitoring the relative pressure change of the adsorptive gas, cooling the same to the temperature of liquid nitrogen to adsorb the adsorptive gas on the particulate surface, and then returning the sample to room temperature to desorb the adsorptive gas adsorbed on the particulate surface.

According to one embodiment, the first specific surface area (α) is calculated by the BET (Brunauer-Emmett-Teller) using nitrogen gas as an adsorptive gas, but the scope of the present invention is not necessarily limited thereto, and the adsorptive gas may include a gas capable of adsorbing as a monomolecular layer on the particulate surface, for example, at liquid nitrogen temperature by van der Waals forces between the particulate and the gas molecule, which can be, for example, krypton gas, argon gas, carbonate gas or the like.

The gas adsorption step is carried out from the time when the relative pressure of the sprayed adsorptive gas begins to become lower than the initial value of the sprayed adsorptive gas until it returns to the initial value, and the gas adsorption time is the time of performing the gas adsorption step. In addition, the gas desorption step is carried out from the time when the relative pressure of the sprayed adsorptive gas begins to become higher than the initial value of the sprayed adsorptive gas until it returns to the initial value. The gas desorption time is the time of performing the gas desorption step.

The gas adsorption method uses the phenomenon that the adsorptive gas is adsorbed as a monomolecular layer on the particulate surface upon cooling. The method may provide a gas adsorption time or a gas desorption time reflecting the particulate surface structure or size thereof. That is, the gas adsorption time and the gas desorption time are each proportional to the specific surface area of the particulate.

For example, when the first specific surface area (α) of a particulate is measured from the gas adsorption time, a '∪-shaped' curved line may be obtained, representing the gas adsorption step, in which the relative pressure is decreased to less than the initial value; and a '∩-shaped' curve may be obtained, representing the gas desorption step in which the relative pressure is increased to more than the initial value, when plotted in a 2-dimensional coordinate system with a vertical axis of the relative pressure of the nitrogen gas and a horizontal axis of time. In the predetermined two-dimensional coordinate, the first specific surface area (α) of the particulate may be obtained by calculating the area between the horizontal time axis and the ∪-shape curved line representing the gas adsorption step.

According to one embodiment, 2 g of particulate is injected into a ∪-shaped measuring cell having a gas inlet and a gas outlet, and the measuring cell is connected to an automatic surface area analyzer (MODEL HM1201, using the BET method, manufactured by Mountech), and a mixed gas (nitrogen gas flow rate: 25 ml/min) of nitrogen gas (adsorption gas) and helium gas (carrier gas) is flowed into the measuring cell through the gas inlet.

Subsequently, the relative pressure change of the nitrogen gas is monitored, and the adsorption step is performed by cooling the measuring cell to liquid nitrogen temperature to adsorb the nitrogen gas on the particulate surface. Then the measuring cell is returned to room temperature (25° C.) to carry out the gas desorption step of desorbing nitrogen gas.

Subsequently, the nitrogen gas relative pressure change as a function of time during the gas adsorption step and the gas desorption step is designated in the two-dimensional coordinate, and the first specific surface area (α) of particulate may be calculated from the area between ∪-shaped curved line showing the gas adsorption step and the time axis.

In an exemplary embodiment, a first specific surface area (α) measured by the gas adsorption method may be, for example, about 13 $m^2/g$ to about 90 $m^2/g$, for example, about 15 $m^2/g$ to about 70 $m^2/g$, for example about 20 $m^2/g$ to 50 $m^2/g$.

When the first specific surface area is less than about 13.0 $m^2/g$, the particulate may have an excessively large diameter, and the quantity of electric charge may be dramatically decreased, thus the adhesion between toner particles may be highly deteriorated; when the first specific surface area is greater than about 90 $m^2/g$, the particulate may have an excessively small diameter, and the spacer effects may be negligible even if the external additive including the particulate is used as an external additive having a large particle diameter, so that it may be difficult to prevent image degradation.

The gas adsorption time and the gas desorption time are measured at a particulate mass of about 2 g and at an adsorptive gas flow rate of about 25 ml/min. When the particulate mass is greater than about 2 g, the total surface area over all particulates is increased, so the gas adsorption and desorption times are prolonged. When the particulate mass is less than about 2 g, the gas adsorption and desorption times are shortened.

When the flow rate of the adsorptive gas is greater than about 25 ml/min, the desorption of the gas adsorbed on the particulate surface is accelerated, so the gas adsorption and desorption times are shortened. When the flow rate of the adsorptive gas is less than about 25 ml/min, the gas adsorption and desorption times are prolonged.

When the particulate particle diameter is small, the surface area of a given mass of particulates is increased compared to the surface area of same mass of particulates having a large particle diameter, so the gas desorption time is prolonged.

When the particulate has the second shape, the surface area of a given mass of particulates is increased compared to the surface area of the same mass of particulates having the first shape, so the gas desorption time may be prolonged.

The gas adsorption time of the particulate may be, for example, about 3 minutes to about 10 minutes, for example, about 3 minutes to about 6 minutes, and the gas desorption time of particulate may be, for example, about 3 minutes to about 10 minutes, for example, about 4 minutes to about 9 minutes.

When the gas adsorption or desorption time is less than about 3 minutes, the particulate may have an excessively large particle diameter, and the adhesion between the toner particle and the particulate may be weakened. When the gas adsorption or desorption time is greater than about 10 minutes, the particulate may have an excessively small particle diameter, such that the adhesion between the toner particle and the particulate may be too large to suppress image degradation, so the strength of the particulate may be weakened.

When the particulate has the second shape, in which a plurality of protruding portions protrude from the outer circumferential surface having a spherical shape or an ovoid shape, the ratio of the gas adsorption time relative to the gas desorption time may be, for example, about 0.5 to about 1.0, for example, about 0.7 to about 0.9. If the ratio of the gas adsorption time relative to the gas desorption time is less than about 0.5, the improvement in mechanical strength between the protruding portion and the mother particle or the improvement of adhesion between the particulate and the toner particle by the protruding portions may be negligible. When the ratio of the gas adsorption time relative to the gas desorption time is greater than about 1.0, improvement in adhesion between the particulate and the toner particle may not be obtained.

Property 6. Ratio ($\alpha/\beta$) of First Specific Surface Area Relative to Second Specific Surface Area A property of a particulate having the first shape, in which protruding portions are not formed, the ratio ($\alpha/\beta$) of the first specific surface area ($\alpha$) relative to the second specific surface area ($\beta$), is described hereinafter. The second specific surface area ($\beta$), which is a theoretical value, is calculated from Property 1, the average particle diameter.

The ratio ($\alpha/\beta$) of the first specific surface area ($\alpha$) relative to the second specific surface area ($\beta$) may show a range of values capable of improving the adhesion between the toner and the particulate to help suppression of toner degradation when the particulate is attached to the toner particle and of providing the particulate with an appropriate surface structure, in which the degree of protrusion from the particulate surface is not huge, so that charge is not abnormally concentrated on the protruded surface.

In an exemplary embodiment, the ratio ($\alpha/\beta$) of the first specific surface area ($\alpha$) relative to the second specific surface area ($\beta$) may be, for example about 0.85 to about 1.75, for example about 0.85 to about 1.60.

When the ratio ($\alpha/\beta$) of the first specific surface area ($\alpha$) relative to the second specific surface area ($\beta$) is less than about 0.85, the particulate has an excessively small particle diameter, so that it is difficult to impart a spacer effect when the external additive including the particulate is used as an external additive having a large particle diameter. When the ratio ($\alpha/\beta$) of the first specific surface area ($\alpha$) relative to the second specific surface area ($\beta$) is greater than about 1.75, the protruded portions protruding from the particulate surface are increased, so that the ratio of abnormally concentrating charge is increased, and the particulate is strongly attached to the photoreceptor, or the like, by the concentrated charge causing the contamination of the photoreceptor, the electrified roll, the development roll, and the like. Thus, in an embodiment the ratio ($\alpha/\beta$) of the first specific surface area ($\alpha$) relative to the second specific surface area ($\beta$) is limited to the disclosed range.

A particulate having the ratio ($\alpha/\beta$) of the first specific surface area ($\alpha$) relative to the second specific surface area ($\beta$) within the range also satisfies Property 2 of the true density, so the particulate may maintain the required strength as an external additive for toner even if it is relatively light weight.

Hereinafter, the schematic shape of a particulate having the second shape is described with reference to FIG. 1 for describing the properties of a particulate having the second shape in which a plurality of protruding portions protrude from the outer circumferential surface having a circular shape or an ovoid shape.

FIG. 1 is a schematic diagram representing the image of a particulate obtained by transmission electron microscopy (hereinafter, referred to as "TEM").

Referring to FIG. 1, when the maximum inscribed circle ("CP1") is defined as the contour of the TEM image of the particulate having the second shape, the mother particle ("CP") refers to the region of both the maximum inscribed circle CP1 and the interior of the maximum inscribed circle CP1; a protruding portion ("PP") refers to a region present outside of the maximum inscribed circle CP1. That is, the particulate may include the mother particle CP and a plurality of protruding portions PP protruding from the outer circumferential surface of the maximum inscribed circle CP1.

Hereinafter, the average aspect ratio is described as a property of the particulate having the second shape with reference to FIG. 1.

Property 7. Average Aspect Ratio

Among the properties of a particulate having the second shape, in which a plurality of protruding portions protrude from the circumferential surface having a spherical shape or an ovoid shape according to one embodiment, the "average aspect ratio" refers to the average aspect ratio of the mother particle (CP).

More specifically, the average aspect ratio of the particulate may be obtained by analysis of particulate images obtained by transmission electron microscopy ("TEM"). First, the obtained and dried particulate is dispersed in ethanol to provide a dispersion, and the dispersion is dripped on a copper grid. Then the copper grid dripped with the dispersion is disposed on a hot plate and dried at 150° C. to remove the ethanol. Subsequently, the copper grid is introduced into a carbon depositing device to perform a carbon deposition for the conductive treatment. In order to analyze the surface structure of the particulate and the fine structure of the various protruded portions by a transmission electron microscope (JEM-1400, manufactured by JEOL LTD.), a mother group of a total of 100 particulates is carried out with image analysis changing the microscope views. That is, a TEM image projected with a plurality of particles is binary-coded by an image processing program to provide contrast on the transmission image, so as to provide a binary-coded transmission image dividing a region showing a mother particle CP and a protruding portion PP and the other region.

After designating a hypothetical quadrangle circumscribed to the particulate based on the real contour of the mother particle CP which is not defined by the maximum inscribed circle CP1 among the binary-coded transmission images of particulate, the ratio of the long side length relative to the short side length of the hypothetical quadrangle is designated as the aspect ratio of the particle. In addition, by changing the transmission image of the transmission electron microscope, each aspect ratio is calculated for the total 100 particulates, and the average of the calculated aspect ratio may be designated as the "average aspect ratio".

In an exemplary embodiment, the average aspect ratio may be, for example, about 1.00 to about 1.25, for example, about 1.00 to about 1.20.

When the particulate has an average aspect ratio of greater than about 1.25, the ratio of particulate including a mother particle (CP) having a non-spherical shape is increased to be buried in the toner surface by the external impact when it is externally added to the toner, so the average aspect ratio is limited within the range.

Hereinafter, referring to FIG. 1 and FIG. 2, sizes of the protruding portion related to the fine structure of protruding portion (PP) are described in more detail.

Figure 2:
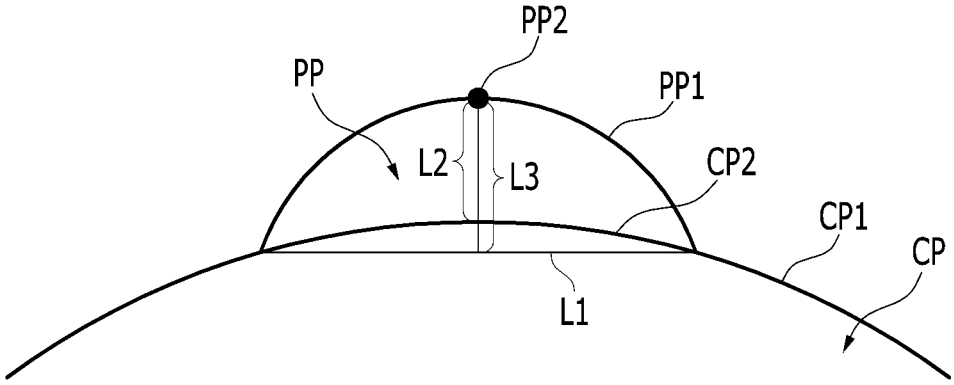
FIG. 2 is a schematic diagram enlarging a portion of FIG. 1.

FIG. 2 is a schematic view enlarging a region of FIG. 1.

Size 1 of Protruding Portion: Average Maximum Length of Protruding Portion

Referring to FIG. 1 and FIG. 2, when a particulate according to one embodiment has the second shape in which a plurality of protruding portions protrudes from the outer circumferential surface of the spherical shape or the ovoid shape, the average of the maximum length of a protruding portion PP (hereinafter, referred to as "average maximum length of protruding portion") is an average length of chord L1 connecting the shortest distance between both ends of a curved line of circular arc portion CP2 of the maximum inscribed circle CP1 for the peripheral region PP1 of protruding portion PP, and it may be obtained by image analysis of a particulate image obtained using a transmission electron microscope (TEM), as calculated in the average aspect ratio.

As the mother particle CP has a size of nanometer order, it is difficult to measure precise sizes of protruding portions of a particulate having the second shape, so errors between the real values and the measurement values necessarily occur. Because of these reasons, it is difficult to concretely measure the real value of the average maximum length. Therefore in one embodiment, a length of circular arc portion CP2 of maximum inscribed circle CP1 contacted with protruding portion PP, which is relatively easy to measure, is measured and the results are used as an approximate value of the average maximum length. The average particle diameter of a particulate is quite tiny, as much as nanoscale, so the error between the real value and the approximate value is sufficiently minute to be negligible.

The average maximum length of a protruding portion calculated by the method may be, for example, about 20 nm to about 45 nm, for example, about 25 nm to about 40 nm.

When the average maximum length is less than about 20 nm, the protruding portion PP protrudes little from the outer circumferential surface of mother particle CP having the average particle diameter, so mechanical strength improvement effects of the particulate and improvement in adhesion between the particulate and the toner particle by the protruding portion PP may be negligible; when the average maximum length is greater than about 45 nm, the protruding portion PP protrudes excessively from the mother particle CP, so it may not provide improvement in adhesion between the particulate and the toner particle.

Size 2 of Protruding Portion: Variation Coefficient of Average Maximum Length

According to one embodiment, the variation coefficient of the average maximum length may be calculated as a standard deviation of the length of the circular arc portion CP2 of the maximum inscribed circle CP1 contacted with the protruding portion PP÷average maximum length×100.

According to one embodiment, the variation coefficient of average maximum length may be, for example, about 10% to about 35%, for example, about 15% to about 30%.

When the variation coefficient of the average maximum length is less than about 10%, the width of the protruding portion PP is too small, so that improvement in adhesion between the particulate and the toner particle by the protruding portion PP and mechanical strength improvement of the particulate by the protruding portion PP are negligible; when the variation coefficient of average maximum length is greater than about 35%, the deviation among the widths of protruding portions PP is too large to provide improvement in adhesion between the particulate and the toner particle.

Size 3 of Protruding Portion: Ratio of Average Maximum Length Relative to Average Particle Diameter According to one embodiment, the ratio of the average maximum length relative to the average particle diameter may be calculated from the average particle diameter and the average maximum length, as described above.

The ratio of the average maximum length relative to the average particle diameter refers to the width of protruding portion PP relative to the size of mother particle CP. According to one embodiment, the ratio of the average maximum length relative to the average particle diameter may be, for example, about 0.12 to about 0.30, for example, about 0.20 to about 0.30.

When the ratio of the average maximum length relative to the average particle diameter is less than about 0.12, the width of protruding portion PP is excessively small relative to the mother particle CP, so mechanical strength improvement of the particulate by the protruding portion PP and improvement in adhesion between the particulate and the toner particle by the protruding portion PP may be negligible; when the ratio of the average maximum length relative to the average particle diameter is greater than about 0.30, the width of protruding portion PP is too large to provide improvement in adhesion between the particulate and the toner particle.

Size 4 of Protruding Portion: Average Maximum Height

According to one embodiment, when the particulate has the second shape in which a plurality of protruding portions protrude from the outer circumferential surface of the spherical shape or the ovoid shape, the average of the first straight line L2 (hereinafter, referred to as the "average maximum height"), referring to the shortest distance between the circular arc portion CP2 of the region in the maximum inscribed circle and the apex PP2 which is the farthest point of the peripheral region PP1 protruding out from the maximum inscribed circle CP1 in a radial direction, may be obtained by image analysis of the particulate image obtained using a transmission electron microscope (TEM), as discussed above and calculated in the average aspect ratio and in the average maximum length.

Since the average maximum height is also difficult to measure precisely, as in the average maximum length, in one embodiment, the average length between straight line L3 connecting between chord L1 connecting both ends of circular arc CP2 of the maximum inscribed circle CP1 contacted with protruding portion PP and apex PP2 in the shortest distance is used as the approximate value of the average maximum height. The average particle diameter of the particulate is quite small, as much as nanoscale, so the error between the real value and the approximate value is sufficiently minute so as to be negligible.

The average maximum height obtained by the method may be, for example, about 5 nm to about 15 nm, for example, about 7 nm to about 12 nm.

When the average maximum height is less than about 5 nm, the protruding portion PP protrudes little from the outer circumferential surface of mother particle CP having the average particle diameter, so mechanical strength improvement effects of the particulate and improvement in adhesion between the particulate and the toner particle by the protruding portion PP may be negligible; when the average maximum height is greater than about 15 nm, the protruding portion PP protrudes too far from the mother particle CP to provide improvement in adhesion between the particulate and the toner particle.

Size 5 of Protruding Portion: Variation Coefficient of Average Maximum Height

According to one embodiment, the variation coefficient of the average maximum height may be calculated by a standard deviation of length of second straight line L3÷average maximum height×100.

According to one embodiment, the variation coefficient of the average maximum height may be, for example, about 20% to about 45%, for example, about 20% to about 30%.

When the variation coefficient of the average maximum height is less than about 20%, the width of protruding portion PP is too small, so that improvement in adhesion between the particulate and the toner particle by the protruding portion PP and mechanical strength improvement of the particulate by the protruding portion PP may be negligible; when the variation coefficient of the average maximum height is greater than about 45%, the improvement in adhesion between the particulate and the toner particle may not be obtained.

Size 6 of Protruding Portion: Ratio of Average Maximum Height Relative to Average Particle Diameter According to one embodiment, the ratio of the average maximum height relative to the average particle diameter may be calculated from each calculated average particle diameter and average maximum height, as described above.

The ratio of the average maximum height relative to the average particle diameter refers to how the protruding portion (PP) protrudes relative to the size of mother particle (CP). According to one embodiment, the ratio of the average maximum height relative to the average particle diameter may be, for example, about 0.05 to about 0.15, for example, about 0.07 to about 0.13.

When the ratio of the average maximum height relative to the average particle diameter is less than about 0.05, the height of protruding portion PP is too low relative to the mother particle CP, so mechanical strength improvement of the particulate by the protruding portion PP and improvement in adhesion between the particulate and the toner particle by the protruding portion PP may be negligible;

when the ratio of the average maximum height relative to the average particle diameter is greater than about 0.15, the height of protruding portion PP is too high to provide improvement in adhesion between the particulate and the toner particle.

Size 7 of Protruding Portion: Ratio of Average Maximum Length Relative to Average Maximum Height In an embodiment, the ratio of the average maximum length relative to the average maximum height according to one embodiment may be, for example, about 0.2 to about 0.4, for example, about 0.25 to about 0.35. According to one embodiment, the ratio of average maximum length relative to the average particle height may be obtained through the average particle length and the average maximum height calculated in the sections of Size 1 of protruding portion and the Size 4 of protruding portion, respectively, as described above.

When the ratio of the average maximum length relative to the average particle height is less than about 0.2, the mechanical strength improvement of particulate by the protruding portion PP and the improvement in adhesion between the particulate and the toner particle by the protruding portion PP may be negligible; when the ratio of the average maximum length relative to the average particle diameter is greater than about 0.4, improvement in adhesion between the particulate and the toner particle may not be obtained.

As described above, when an external additive for toner according to one embodiment includes a particulate having the first shape, it may have Property 1 to Property 6.

When an external additive for toner includes the particulate having the second shape, it may have Property 1 to Property 5, and Property 7, and may satisfy the size conditions of Sizes 1 to 7 of protruding portions formed on the particulate surface.

B. Method of Preparing External Additive for Toner Including Particulate Having First Shape Hereinafter, a method of producing the external additive for toner including a particulate having the first shape of a spherical shape or an ovoid shape on which protruding portions are not formed will be described in more detail. A method of producing the external additive for toner including a particulate having the first shape includes: broadly, a particulate forming process and a particulate recovering process. The method is one example of methods being capable of producing a silica particulate having the above properties. Hereinafter, an exemplary process will be described.

1. Particulate Forming Process

The particulate forming process includes: mixing a silicon-containing component including a silicone compound represented by the formula of $Si(OR^1)_4$ (each $R^1$ is independently a C1 to C6 monovalent hydrocarbon group) and a catalyst-containing component including a basic compound; condensation-polymerizing the silicone compound in the mixed solution of the silicon-containing component and the catalyst-containing component to provide a silica particulate dispersion.

In the particulate forming process, the condensation polymerization of the silicone compound is performed through a mixing step, a first reaction process (hereinafter, also referred to as the "first reaction step"), and a second reaction process (hereinafter, also referred to as the "second reaction step").

Hereinafter, the particulate forming process will be described according to each step.

First, before the mixing step, the silicon-containing component and the catalyst-containing component are individually prepared.

(1) Preparation of Silicon-Containing Component

The silicon-containing component is a solution including the silicone compound represented by Chemical Formula 1 and an organic solvent.

The silicone compound, which is a raw material of silica particulate, includes a tetrafunctional silane compound represented by Chemical Formula 1 or a hydrolysis-condensation product of the silane compound.

The tetrafunctional silane compound may include a silane compound (monomer component), for example, tetramethoxysilane, tetraethoxysilane and the like but is not limited thereto. The hydrolysis-condensation product of the tetrafunctional silane compound may include a hydrolysis-condensation product (dimer or oligomer, etc.) obtained by condensing a hydrolytic group (e.g., methoxy group, ethoxy group, etc.) in the tetrafunctional silane compound but is not limited thereto.

The silicon-containing component according to the present invention may include a silicone compound backbone to adjust a particle property. The content of silicone compound in the silicon-containing component may be appropriately determined by considering the kind of silicone compound and the composition amount of silicone compound required to provide a usable particulate, and the like.

For example, the content of silicone compound may be, for example, about 1 wt % to about 50 wt %, for example, about 3 wt % to about 45 wt %, for example, about 3 wt % to about 30 wt %, for example, about 3 wt % to about 25 wt %, based on the entire weight of the mixed solution.

When the content of silicone compound is less than about 1 wt %, the absolute amount of silicone compound in the mixed solution is too low to provide enough raw material for the particulate obtained by the condensation polymerization of the silicone compound, so that it is difficult to provide a particulate having strong durability. In addition, when it is greater than the upper limit of about 50 wt %, the content of silicone compound is excessively high, so that the residue of remaining silicone compound which is unreacted in the condensation polymerization may remain in the mixed solution.

The content of the organic solvent in the silicon-containing component may be determined by considering the kind of silicone compound used, the compatibility with the used silicone compound, the composition amount of silicone compound required to provide a usable particulate, or the like.

According to one embodiment, the content of the organic solvent may be about 50 wt % to about 99 wt %, for example, about 70 wt % to about 99 wt %, for example, about 75 wt % to about 99 wt %, for example, about 75 wt % to about 95 wt %, based on the entire weight of the mixed solution.

When the content of the organic solvent is less than about 50 wt %, the content of the silicone compound is excessive, so residual silicone compound which is unreacted in the condensation polymerization may remain in the mixed solution; when it is greater than about 99 wt %, the absolute amount of the silicone compound is too low to provide enough raw material for the silica particulate provided by the condensation polymerization of the silicone compound, so that it is difficult to provide a particulate having strong durability.

Further, the organic solvent may be determined based on considering the kind of silicone compound, the compatibility with the catalyst-containing component or the like. For example, the organic solvent may include a protic solvent, an aprotic solvent or the like, but the scope of the present invention is not limited thereto.

The protic solvent may include, for example, ethanol, propanol, isopropanol or the like, and the aprotic solvent may include, for example, acetonitrile, tetrahydrofuran, dioxane or the like.

In addition, when a protic solvent and an aprotic solvent coexist in the silicon-containing component, the balance of the two kinds of solvents is important for the condensation polymerization of the silicone compound. The weight ratio of the aprotic solvent and the protic solvent may be, for example, about 10:90 to about 90:10, for example, about 10:90 to about 80:20, for example, about 20:80 to about 80:20, for example, about 20:80 to about 50:50, for example, about 30:70 to about 50:50.

When the weight ratio of the aprotic solvent and the protic solvent is out of the range, the balance of solvents is unfavorable, and may inhibit the condensation polymerization of the silicone compound.

(2) Preparation of Catalyst-Containing Component

The catalyst-containing component according to one embodiment is a solution including a basic compound and a solvent compatible with the silicon-containing component. Examples of the basic compound include ammonia, dimethyl amine, diethyl amine, triethylamine or the like but is not limited thereto. In addition, the solvent may include, for example, an aqueous solvent such as water, methanol, ethanol and the like, but is not necessarily limited thereto.

The content of the basic compound in the catalyst-containing component is determined considering compatibility with the silicone compound used and the content of the silicone compound based on the entire amount of mixed solution required to provide a usable particulate, and the like.

According to one embodiment, the content of basic compound in the catalyst-containing component may be, for example, about 1 wt % to about 40 wt %, for example, about 3 wt % to about 30 wt %.

When the content of the basic compound is less than about 1 wt %, the content of the basic compound required for the role of a catalyst of the condensation polymerization of the silicone compound may be insufficient; when the content is greater than about 40 wt %, the condensation polymerization of the silicone compound may be excessively performed.

The silicon-containing component and the catalyst-containing component are individually prepared. The content of each component is determined by the composition ratio of both components required to provide a usable silica particulate.

(3) Preparation of the Mixed Solution

In an embodiment, during preparation of the mixed solution, a silicone compound selected from a silane compound represented by Chemical Formula 1, a hydrolysis-condensation product of the silane compound, and a combination thereof is mixed with a catalyst-containing component including a basic compound to provide a mixed solution.

The composition weight ratio of the silicon-containing component and the catalyst-containing component in the mixed solution may be, for example, about 10:90 to about 90:10, for example, about 30:70 to about 85:15.

When the content of the silicon-containing component based on the entire weight of mixed solution is too low, the raw material for the particulate obtained by the condensation polymerization of silicone compound may be insufficient, and when the content of the catalyst-containing component to the entire amount of mixed solution is too low, the catalyst required to perform the condensation polymerization of silicone compound may be insufficient.

Preparing the mixed solution is the initial process of the condensation polymerization of the silicone compound. In preparing the mixed solution, the temperature of each of the silicon-containing component and the catalyst-containing component is individually adjusted so that the temperature (TA) of the silicon-containing component and the temperature (TB) of catalyst-containing component satisfy the following Relationship Equations (a) to (c).

$$2° \text{ C.} < TA < 60° \text{ C.} \quad (a)$$

$$TA < TB \quad (b)$$

$$TB - 40° \text{ C.} < TA < TB - 3° \text{ C.} \quad (c)$$

wherein the temperature (TA) of the silicon-containing component may be greater than about 2° C. and less than about 60° C., for example, about 5° C. to about 45° C. to satisfy Relationship Equation (a).

When the temperature (TA) of the silicon-containing component on mixing is less than about 2° C., the reaction temperature is too low to perform the condensation polymerization of the silicone compound; when the temperature (TA) of the silicon-containing component is greater than 60° C., the reaction temperature is too high to control the rate of the condensation polymerization reaction of the silicone compound; when the temperature is out of the range, it is generally difficult to control the particle diameter and ratio ($\alpha/\beta$) of the first specific surface area ($\alpha$) relative to the second specific surface area ($\beta$) as described above.

The temperature (TA) of the silicon-containing component may be set at a lower temperature than the temperature (TB) of the catalyst-containing component to satisfy Relationship (b).

In order for temperature (TA) of the silicon-containing component and temperature (TB) of the catalyst-containing component to satisfy Relationship Equation (c), the temperature (TA) of the silicon-containing component may be set at a temperature between a temperature 40° C. lower than the temperature (TB) of the catalyst-containing component and a temperature 3° C. lower than the temperature (TB) of the catalyst-containing component.

After the temperatures are individually adjusted in order to satisfy Relationship Equations (a) to (c), the catalyst-containing component is added to the silicon-containing component at a time, and the two components are mixed. Thereby, the temperature of the mixed solution of the silicon-containing component and the catalyst-containing component becomes a temperature between the temperature (TA) of the silicon-containing component and the temperature (TB) of the catalyst-containing component during the mixing.

In this manner, by providing a temperature difference to each component, and by adding and mixing the high temperature catalyst-containing component into the low temperature silicon-containing component at a time, the silicone compound in the silicon-containing component and the basic compound in the catalyst-containing component are instantly contacted, the particulate growth direction may thereby be controlled from the initial process of the condensation polymerization reaction of silicone compound. That is, the properties of the particulate obtained may be controlled.

Further, the stir speed of the mixed solution may be, for example, about 50 rpm to about 300 rpm, for example, about 80 rpm to about 250 rpm.

When the stir speed of the mixed solution is less than about 50 rpm, the silicone compound in the silicon-containing component and the basic compound in the catalyst-containing component are not well mixed, so that the silicone compound is insufficiently condensation-polymerized; when the stir speed of the mixed solution is greater than about 300 rpm, the particulate may not grow sufficiently. The stir speed may be maintained constant for all steps, including before the mixing, during the mixing, and after the mixing, but the stir speed may be changed in the various steps as long as it does not inhibit the growth of particulate.

(4) Particulate Formation

In the particulate forming process, the condensation polymerization is initiated in the mixed solution to provide a particulate dispersion. The condensation polymerization may be performed through a first reaction step and a second reaction step, performed sequentially.

According to one embodiment, after completing the first reaction step, the second reaction step may be not directly continued. That is, a transition step may be further included between the first reaction step and the second reaction step.

1) First Reaction Step

The first reaction step refers to the overall step of condensation polymerization after the mixed solution preparing process, and the first reaction step may be controlled by application of lower heat energy than the second reaction so that the required particulate structure backbone is constructed and, simultaneously, may be controlled to supply sufficient heat energy to the following second reaction step so that the particulate specific structure is controlled.

In the first reaction step, the mixed solution stirred in the mixing process is maintained at a first temperature (T1) for a first reaction time (t1). In order to provide the desired particulate backbone, the first temperature (T1) needs to be greater than about 2° C. in the first reaction step, but when it is greater than about 60° C., the particulate backbone is too fixed to control the specific particulate structure in the following second reaction step, so the first temperature (T1) in the first reaction step is limited within a range of about 2° C. to about 60° C.

Furthermore, when the first accumulated heat (Q1) of the first reaction step is defined as the sum of the heat calculated by integrating the applied temperature within the range of about 2° C. to about 60° C. over the time in the first reaction and the heat calculated by integrating the applied temperature greater than equal to about 2° C. over the time for the process of the applied temperature reaching the first temperature (T1) from an initiating point, wherein the initiating point is right after mixing the silicon-containing component and the catalyst-containing component in the mixing process, the first accumulated heat (Q1) may be, for example, about 5° C.·hour to about 90° C.·hour, for example about 5° C.·hour to about 30° C.·hour.

When the first accumulated heat (Q1) is less than 5° C.·hour, insufficient condensation polymerization reaction of the silicone compound may occur; when the first accumulated heat (Q1) is greater than 90° C.·hour, excessively high heat is applied in the first reaction step, so that excessive condensation polymerization of the silicone compound may occur.

The first temperature (T1) is determined to be lower than the mixed liquid temperature of the mixed solution obtained from the mixing process and may be, for example, about 5° C. to about 45° C., for example, about 5° C. to about 40° C.

When the first temperature (T1) is less than about 5° C., the temperature of the first reaction step is too low to carry out the condensation polymerization of silicone compound; when the first temperature (T1) is greater than about 45° C., the reaction temperature of the first reaction step is too high to control the reaction rate of the condensation polymerization of the silicone compound.

In an embodiment, the first temperature (T1) may be determined to be the same temperature as the temperature (TA) of the silicon-containing component on mixing during the mixed solution preparing process. In this case, as the temperature of the silicon-containing component may be controlled within the range of the temperature (TA) of the silicon-containing component and the temperature (TB) of the catalyst-containing component on mixing during the mixed-solution preparing process and the first reaction step, thermal stress applied to the growing particulate in the mixed solution preparing process may be minimized.

In addition, the method of controlling the temperature from the liquid temperature of the mixed solution obtained from the mixed solution preparing process to the first temperature (T1) may include various methods capable of rapidly carrying out transition from the mixed process to the first reaction step without affecting the condensation polymerization of the silicone compound. For example, when mixing the silicon-containing component and the catalyst-containing component in the mixed solution preparing process, in order to shift the liquid temperature of the mixed solution after the mixing to the first temperature (T1), at least any one of the following may be controlled: content of the silicon-containing component, the temperature (TA) of the silicon-containing component on the mixing, the content of the catalyst-containing component, and the temperature (TB) of the catalyst-containing component on the mixing.

The first reaction time (t1) refers to the time right after obtaining the mixed solution by mixing the silicon-containing component and the catalyst-containing component at the mixing time and does not include the time for changing to the second reaction step.

The first reaction time (t1) may be determined to be the same or shorter than the second reaction time (t2) to apply less heat to the particulate than in the following second reaction step.

According to one embodiment, the first reaction time (t1) may be, for example, about 1 hour to about 10 hours, for example, about 1 hour to about 5 hours.

When the first reaction time (t1) is less than about 1 hour, the heat applied to the mixed solution in the first reaction step is too low to perform the condensation polymerization of the silicone compound; when the first reaction time (t1) is greater than about 10 hours, the heat applied to the mixed solution in the first reaction step is excessively high, so that excessive condensation polymerization of the silicone compound may be performed.

The stirring speed of the mixed solution in the first reaction step may be, for example, about 50 rpm to about 300 rpm, for example, about 80 rpm to about 260 rpm. The stirring speed may be maintained constant for the overall first reaction step, but it may be changed to various speeds within the range as long as it does not inhibit growth of the particulate.

2) Transition Step

In an embodiment, after completing the first reaction step and before starting the second reaction step, a transition step may be performed in which the mixed solution which was heated at the first temperature (T1) is changed to be slowly heated to a second temperature (T2). According to one embodiment, the temperature increasing rate of the transition step may be, for example, about 0.1° C./minute to about 5° C./minute, for example, about 0.3° C./minute to about 3° C./minute.

When the temperature increasing rate is less than about 0.1° C./minute, the transition time from the first reaction step to the second reaction step is too prolonged to perform the second reaction step rapidly; when the temperature increasing rate is greater than about 5° C./minute, the temperature change is excessively large, and the thermal stress to the condensation polymerization is too high to perform sufficient condensation polymerization.

3) Second Reaction Step

The second reaction step corresponds to the second half step of the condensation polymerization after the first reaction step. In the second reaction step, a heat higher than in the first reaction step is applied, and the specific particle structure is controlled by carrying out condensation polymerization on the backbone formed in the first reaction step, so that a particulate dispersion, controlled to provide desirable properties, is obtained.

In the second reaction step, after the first reaction step, the stirred mixed solution is maintained at a second temperature (T2) for the second reaction time (t2).

In order to control the specific particle structure in the second reaction step, a temperature of greater than or equal to about 2° C. is required; when the temperature is greater than about 80° C., the condensation polymerization is too rapidly performed to control the physical particle structure, so the second temperature (T2) may be controlled to be within the disclosed range of about 2° C. to about 80° C.

In addition, when a second accumulated heat (Q2) of the second reaction step is defined as the sum of heat calculated by integrating the applied temperature within the range of about 2° C. to about 80° C. in the second reaction on time and heat calculated by integrating the applied temperature greater than or equal to about 2° C. during the change of the temperature to the second temperature (T2) until initiating the second reaction step from the first temperature (T1) after completing the first reaction step on time, the second accumulated heat (Q2) may be, for example, about 200° C.·hour to 700° C.·hour, for example, about 210° C.·hour to about 500° C.·hour.

The heat when performing the transition from the first temperature (T1) to the second temperature (T2) is included in the second accumulated heat (Q2), but the heat after completing the second step, for example, the heat in a temperature decreasing process is not included. This is because the particulate structure is not changed by the heat of a temperature decreasing process at the time point of completing the second reaction.

When the second accumulated heat (Q2) is less than about 200° C.·hour, the condensation polymerization of the silicone compound may not be sufficiently performed; when the second accumulated heat (Q1) is greater than about 700° C.·hour, excessively high heat is applied in the second reaction step, so the condensation polymerization of the silicone compound is excessive.

The second temperature (T2) is determined as higher than the first temperature (T1) for the latter half of the condensation polymerization as described above.

According to one embodiment, the second temperature (T2) may be, for example, about 15° C. to about 70° C., for example, about 25° C. to about 65° C.

When the second temperature is less than about 15° C., it is difficult to perform condensation polymerization of the silicone compound; when the second temperature is greater than about 70° C., it is difficult to control the reaction rate of the condensation polymerization of the silicone compound.

The second temperature may be determined to be the same as the temperature (TB) of the catalyst-containing component on mixing during the mixed solution preparing process. In this case, through the mixing process, the first reaction step, and the second reaction step, the temperature of the silicon-containing component may be controlled within the range of the temperature (TA) of the silicon-containing component and the temperature (TB) of the catalyst-containing component on mixing, so as to minimize thermal stress to the growing particulate in the mixed solution.

The second reaction time (t2) is the time of the latter half of the condensation polymerization and may be determined to be the same as or longer than the first reaction time (t1).

According to one embodiment, the second reaction time (t2) may be, for example, about 1 hour to about 10 hours, for example, about 2 hours to about 5 hours.

When the second reaction time (t2) is less than about 1 hour, the heat applied to the mixed solution in the second reaction step is excessively low, so that it is difficult to perform the condensation polymerization of the silicone compound; when the second reaction time (t2) is greater than about 10 hours, the heat applied to the mixed solution during the second reaction step is excessively high, so that excessive condensation polymerization of the silicone compound occurs.

The second accumulated heat (Q2) is higher than the first accumulated heat (Q1) by controlling the heat in the second reaction step to be higher than in the first reaction step, the second temperature (T2) to be higher than the first temperature (T1), and the second reaction time (t2) to be greater than or equal to the first reaction time (t1).

The stirring speed of the mixing solution in the second reaction step may be, for example, about 50 rpm to about 300 rpm, for example, about 80 rpm to about 250 rpm. The stirring speed may be maintained constant over the second reaction step, but may be changed to various speeds within the range as long as stirring does not inhibit particulate growth.

In the particulate forming process, the temperature of the silicon-containing component including a silicone compound, which is a raw material of the particulate, is changed as follows: increasing in one step during the mixed solution preparing process of mixing the temperature (TA) on mixing with the temperature (TB) of the catalyst-containing component, which is higher than the temperature (TA); once decreasing to the first reaction step; then slowly increasing in the transition step or maintaining when the temperature (TA) of the silicon-containing component on mixing is the same as the first temperature (T1); and then increasing to the second temperature (T2) in the second reaction step.

By controlling the temperature of the silicon-containing component to be changed according to the multi-step process, the condensation polymerization of the silicone compound during the particulate forming process may determine the direction of particulate growth by the mixing process, then the particulate grows by applying the first accumulated heat (Q1) to the mixed solution in the first reaction step, and then a dispersion of particulates having the first shape is obtained by applying the second accumulated heat (Q2) higher than the first accumulated heat (Q1) to the mixed solution in the second reaction step to react the regions where the condensation polymerization was not performed and to perform particulate growth.

The particulate in the particulate dispersion may have Property 1 to Property 6 of the particulate.

In an embodiment, in order to provide a particulate having Property 1 to Property 6 by the particulate forming process, satisfying the conditions of the mixed solution preparing process and the particulate preparing process is required.

2. Particulate Recovering Process

The particulate recovering process is the process of recovering the particulate from the particulate dispersion obtained from the particulate forming process. During the process, only particulate is separated from the particulate dispersion and recovered.

The recovering method is not particularly limited as long as the surface or the shape of the particulate in the dispersion is not changed, and the particulate is not damaged. For example, the recovering method may include concentration by heating using an evaporator, a solid-liquid separation using a centrifugal settler, a frozen drying method, or the like.

The particulate recovered through the particulate recovering process may have Property 1 to Property 6.

3. Particulate Hydrophobizing Process

The particulate hydrophobizing process is the process of hydrophobizing the particulate surface by reacting a hydrophobization agent with hydroxyl groups (—OH) remaining on the particulate surface and introducing the hydrophobic group onto the particulate surface to hydrophobize the particulate surface.

In the particulate hydrophobizing process, the particulate may be hydrophobized according to the kind of toner to be added, the usage of toner, or the like, or may be omitted. The particulate hydrophobized by the particulate hydrophobizing process may be the particulate recovered from the particulate recovering process or the sol particulate dispersion formed from the particulate forming process. The former may be prepared by sequentially performing the particulate forming process, the particulate recovering process, and the particulate hydrophobizing process; the latter may be prepared by sequentially performing the particulate forming process, the particulate hydrophobizing process, and the particulate recovering process.

The particulate hydrophobizing process may use a trialkylsilyl group as the hydrophobic group on the surface of the particulate to provide the particulate with excellent hygroscopicity-reducing effects and to maintain the external additive and toner with an appropriate quantity of electric charge, but the scope of the present invention is not limited thereto. The hydrophobic group may include various hydrophobic groups capable of applying hydrophobicity on the particulate surface, for example, at least any one of a trialkylsilyl group, a triphenylsilyl group, a diphenylmonoalkylsilyl group, and a dialkylmonophenylsilyl group.

When the hydrophobic group is a trialkylsilyl group according to one embodiment, how the particulate is hydrophobized is described as follows:

According to one embodiment, a compound selected from the silazane compound represented by Chemical Formula 2, the silane compound represented by Chemical Formula 3, and a combination thereof is contacted to the particulate surface to add a trialkylsilyl group on the particulate surface and then to hydrophobize the particulate surface.

Each of Chemical Formula 2 and Chemical Formula 3 is as follows:

$R^2_3SiNHSiR^2_3$ [Chemical Formula 2]

(each $R^2$ is independently a C1 to C6 monovalent hydrocarbon group)

$R^3_3SiX$ [Chemical Formula 3]

(each $R^3$ is independently a C1 to C6 monovalent hydrocarbon group and X is an —OH group or a hydrolytic functional group)

The compound acts as a hydrophobization agent by trialkysilylating a hydroxyl group (—OH) remaining on the particulate surface after the condensation polymerization of the silicone compound.

Examples of contacting a hydrophobization agent to the particulate surface may include mixing the particulate dispersion obtained from the particulate forming process with a solution including a hydrophobization agent; mixing the solution including particulate recovered from the particulate recovering process with a solution including a hydrophobization agent; or adding a solution including a hydrophobization agent onto the surface of the particulate recovered from the particulate recovering process, but the scope of the present invention is not limited thereto.

In an embodiment, the reaction temperature in the particulate hydrophobizing process in which the trialkylsilyl group is added on the particulate surface may be, for example, about 20° C. to about 90° C., for example, about 30° C. to about 85° C.

When the particulate is performed with the hydrophobization reaction within the disclosed reaction temperature range, the hydrophobization is rapid and sufficiently performed by a trialkylsilyl group.

In addition, the pressure inside the reaction vessel (hereinafter, referred to as "pressure in the reaction vessel") used in the particulate hydrophobizing process of adding a trialkylsilyl group on the particulate surface may be standard pressure (760 mmHg) or a pressure greater than or equal to standard pressure, for example, about 760 mmHg to about 850 mmHg.

When the hydrophobization reaction is performed with the particulate within the disclosed pressure range in the reaction vessel, hydrophobization is rapid and sufficiently performed by a trialkylsilyl group.

The silazane compound represented by Chemical Formula 2 may include, for example, hexamethyldisilazane (HMDS), trimethylsilyl chloride or the like, but the scope of the present invention is not limited thereto.

The silane compound represented by Chemical Formula 3 may include, for example, methyltrimethoxysilane, dimethyldimethoxysilane, dimethyldiethoxysilane, isobutyltrimethoxysilane, methacryloyloxypropyltrimethoxysilane, phenyltrimethoxysilane or the like, but the scope of the present invention is not limited thereto.

The hydrolytic functional group represented as X in Chemical Formula 3 may include, for example, methoxy group, ethoxy group, propyl group, butyl group or the like, but the scope of the present invention is not limited thereto.

A solvent of the silazane compound or the silane compound, functioning as the hydrophobization agent, may include, for example, an aqueous solvent such as water or an organic solvent such as acetone, methylethylketone, methylisobutylketone, methanol, ethanol, isopropanol, and the like.

The particulate included in the external additive obtained by the method of preparing the external additive for toner may have Property 1 to Property 6.

C. Method of Preparing External Additive for Toner Including Particulate Having Second Shape Hereinafter, the method of preparing an external additive for toner including a particulate having the second shape will be described in detail.

The detailed descriptions for the same processes as in the method of preparing the external additive for toner including a particulate having the first shape will be omitted from the description for the method of preparing the external additive for toner including a particulate having the second shape.

1. Particulate Forming Process (1) Preparation of Silicon-Containing Component

It is carried out by the same method as in the method of preparing the external additive for toner including a particulate having the first shape.

(2) Preparation of Catalyst-Containing Component

It is carried out by the same method as in the method of preparing the external additive for toner including a particulate having the first shape.

(3) Preparation of Mixed Solution

The mixed solution preparing process is the beginning process of the condensation polymerization of the silicone compound. In preparing the mixed solution, the temperature of each of the silicon-containing component and the catalyst-containing component is individually controlled so that the temperature (TA) of the silicon-containing component on mixing and the temperature (TB) of the catalyst-containing component satisfy the following Relationship Equations (d) to (f).

$$0° \text{ C.} \leq TA \leq 10° \text{ C.} \quad (d)$$

$$20° \text{ C.} \leq TB \leq 50° \text{ C.} \quad (e)$$

$$10° \text{ C.} \leq TB - TA \leq 50° \text{ C.} \quad (f)$$

The temperature (TA) of the silicon-containing component on mixing may be about 0° C. to about 10° C., for example, about 0° C. to about 8° C. to satisfy Relationship Equation (d).

When the temperature (TA) of the silicon-containing component on mixing is less than about 0° C., the reaction temperature is too low to perform the condensation polymerization of the silicone compound, so that the protruding portion PP hardly protrudes from the outer circumferential surface of mother particle CP; when the temperature (TA) of the silicon-containing component on mixing is greater than about 10° C., the reaction temperature is too high to control the reaction rate of the condensation polymerization of the silicone compound, so that it is difficult to provide the desired size protruding portion PP.

The temperature (TB) of the catalyst-containing component on mixing may be about 20° C. to about 50° C., for example, about 30° C. to about 50° C. to satisfy Relationship Equation (e).

When the temperature (TB) of the catalyst-containing component on mixing is less than about 20° C., the temperature of the basic compound in the catalyst-containing component is excessively lower than the temperature suitable for the condensation polymerization of the silicone compound in the particulate forming process, so that it is difficult to perform the condensation polymerization of the silicone compound, and the protruding portion PP hardly protrudes from the outer circumferential surface of mother particle CP; when the temperature (TB) of the catalyst-containing component on mixing is greater than about 50° C., the temperature of the basic compound in the catalyst-containing component is excessively higher than the temperature suitable for the condensation polymerization of silicone compound in the particulate forming process, so that it is difficult to control the reaction rate of the condensation polymerization of the silicone compound to provide the desired size of the protruding portion PP.

The difference (TB−TA) between the temperature (TB) of the catalyst-containing component and the temperature (TA) of the silicon-containing component may be about 10° C. to about 50° C., for example, about 20° C. to about 50° C. to satisfy Relationship Equation (f).

When the difference (TB−TA) between the temperature (TB) of the catalyst-containing component and the temperature (TA) of the silicon-containing component is less than about 10° C., the temperature difference is too little to transition readily from the mixed solution preparing process to the particulate forming process, so that the protruding portion PP hardly protrudes from the outer circumferential surface of mother particle CP; when the difference (TB−TA) between the temperature (TB) of the catalyst-containing component and the temperature (TA) of the silicon-containing component is greater than about 50° C., the temperature difference is excessively large, so that is it difficult to fluently carry out the reaction from the mixed solution preparing process to the particulate forming process, and the condensation polymerization of the silicone compound is suddenly and substantially begun during the mixed solution preparing process, so that it is difficult to control the reaction rate of condensation polymerization of the silicone compound and to provide a desired size of the protruding portion PP.

(4) Formation of Particulate

In the method of preparing the external additive for toner including a particulate having the second shape, the specific conditions of the temperatures and times of the mixing process of the silicon-containing component and the catalyst-containing component and the first step, the transition, step and the second step in the particulate forming process are controlled in the different ways from the method of preparing the external additive for toner including a particulate having the first shape.

Thereby, the plurality of protruding portions PP protruding from the outer circumferential surface of mother particle CP may be integrally formed with the mother particle CP.

1) First Reaction Step

The first reaction step means the overall condensation polymerization step after preparing the mixed solution. The first reaction step applies sufficient heat to the following second reaction step to control the specific structure of the particulate and simultaneously controls the applied heat to be less than in the second reaction step to construct the backbone of the mother particle CP in the particulate structure.

When the accumulated heat (Q1) of the first reaction step refers to the value from summing the heat calculated by integrating the temperature applied within the range of about 2° C. to about 60° C. over time and the heat calculated by integrating the temperature applied at greater than or equal to 2° C. over the time for reaching the temperature from an initiating point to the first temperature (T1) on a time in the first reaction step, wherein the initiating point is considered to be right after the silicon-containing component and the catalyst-containing component are mixed in the mixed solution preparing process, the first accumulated heat (Q1) may be, for example, about 5° C.·hour to 30° C.·hour, for example, about 5° C.·hour to about 20° C.·hour.

When the first accumulated heat (Q1) is less than about 5° C.·hour, insufficient condensation polymerization of the silicone compound is performed, so the mother particle CP may have a smaller size than estimated; when the first accumulated heat (Q1) is greater than about 30° C.·hour, excessively high heat is applied to the first reaction step, so excessive condensation polymerization of the silicone compound is performed, and thus the mother particle CP may have a larger size than estimated.

The first temperature (T1) satisfies the following Relationship Equation (g).

$$5^\circ\ \text{C.} \leq T1 \leq 15^\circ\ \text{C.} \quad \text{(g)}$$

The first temperature (T1) is determined to be less than or equal to the mixed liquid temperature of the mixed solution obtained from the mixing process, and it may be, for example, about 5° C. to about 15° C., for example, about 5° C. to about 12° C. to satisfy Relationship Equation (g).

When the first temperature (T1) is less than about 5° C., the temperature of the first reaction step is excessively low, so that it is difficult to perform the condensation polymerization of the silicone compound; when the first temperature (T1) is greater than about 15° C., the reaction temperature in the first reaction step is excessively high, so that it is difficult to control the reaction rate of the condensation polymerization of the silicone compound.

In an embodiment, the first temperature (T1) is determined to be a relatively low temperature like the temperature (TA) of the silicon-containing component on mixing in the mixed solution preparing process. In this case, as the temperature of the silicon-containing component may be controlled within a range of the temperature (TA) of the silicon-containing component and the temperature (TB) of the catalyst-containing component on mixing through the mixed solution preparing process and the first reaction step, thermal stress to the growing particulate may be minimized during the mixed solution preparing process, and the size and shape of mother particle CP may be controlled as desired.

The first reaction time (t1) is the time right after obtaining the mixed solution by mixing the silicon-containing component with the catalyst-containing component at the mixing time and does not include the transition time to the second reaction step.

The first reaction time (t1) may be determined to be shorter than the second reaction time (t2) to apply less heat to the particulate than in the followed second reaction step.

According to one embodiment, the first reaction time (t1) may be, for example, about 0.3 hours to about 6 hours, for example, about 1 hour to about 2 hours.

When the first reaction time (t1) is less than about 0.3 hours, the heat applied to the mixed solution in the first reaction step is excessively low, so that it is difficult to perform the condensation polymerization of the silicone compound; when the first reaction time (t1) is greater than about 6 hours, the heat applied to the mixed solution in the first reaction step is excessively high, so that excessive condensation polymerization of the silicone compound may be performed.

2) Transition Step

After completing the first reaction step and before beginning the second reaction step, a transition step is performed to slowly heat the mixed solution from the first temperature (T1) to the second temperature (T2). According to one embodiment, the temperature increasing rate in the transition step may be, for example, about 0.5° C./minute to about 10° C./minute, for example, about 3° C./minute to about 5° C./minute.

When the temperature increasing rate is less than about 0.5° C./minute, the time of transiting from the first reaction step to the second reaction step is excessively prolonged, so the second reaction step may not be rapidly performed; when the temperature increasing rate is greater than about 10° C./minute, the temperature change is large, so thermal stress to the condensation polymerization is too high to perform sufficient condensation polymerization.

3) Second Reaction Step

The second reaction step corresponds to the second half step of the condensation polymerization after the first reaction step. In the second reaction step, a heat higher than in the first reaction step is applied, and the particulate structure is further concisely controlled by carrying out the condensation polymerization on the backbone formed by the first reaction step to provide a plurality of protruding portions PP on the outer circumferential surface of mother particle CP, so that a particulate dispersion controlled to provide desirable properties and fine structure is obtained.

In the second reaction step after the first reaction step, the stirred mixed solution is maintained at a second temperature (T2) for the second reaction time (t2).

The second reaction step requires a temperature greater than or equal to about 2° C. in order to concisely control the particle structure; when it is greater than about 80° C., the condensation polymerization is performed too rapidly to be concisely controlled, so the second temperature (T2) may be controlled within the disclosed range.

The second temperature (T2) is for the second half of the condensation polymerization as described above and is determined to be higher than the first temperature (T1) and satisfies the following Relationship Equation (h).

$$30^\circ\ \text{C.} \le T2 \le 50^\circ\ \text{C.} \quad \text{(h)}$$

The second temperature (T2) according to one embodiment may be, for example, about 30° C. to about 50° C., for example, about 30° C. to about 45° C.

When the second temperature is less than about 30° C., it is difficult to perform the condensation polymerization of the silicone compound and it is also difficult to provide protruding portions PP; when the second temperature is greater than about 50° C., it is difficult to control the reaction rate of the condensation polymerization of the silicone compound, so it is difficult to control the size and the shape of protruding portion PP as desired.

The second temperature is determined to be a relatively high temperature like the temperature (TB) of the catalyst-containing component on mixing in the mixed solution preparing process. In this case, the temperature of the silicon-containing component may be controlled within the range of the temperature (TA) of the silicon-containing component and the temperature (TB) of the catalyst-containing component on mixing through the mixing process, the first reaction step, and the second reaction step, so as to minimize thermal stress applied to the growing particulate in the mixed solution and to control the size and the shape of protruding portion PP as desired.

As described above, the second reaction time (t2) may be determined to be the same or longer than the first reaction time (t1).

According to one embodiment, the second reaction time (t2) may be determined to be longer than the first reaction time (t1), and it may be, for example, about 4 hours to about 17 hours, for example, about 8 hours to about 14 hours.

When the second reaction time (t2) is less than about 4 hours, the heat applied to the mixed solution in the second reaction step is excessively low, so it is difficult to perform the condensation polymerization of the silicone compound and to provide the protruding portion PP; when the second reaction time (t2) is greater than about 17 hours, the heat applied to the mixed solution in the second reaction step is excessively high, excessive condensation polymerization of silicone compound is performed, so it is difficult to control the size and the shape of protruding portion PP as desired.

The second accumulated heat (Q2) is higher than the first accumulated heat (Q1) since the heat in the second reaction step is determined to be higher than in the first reaction step, the second temperature (T2) is determined to be higher than the first temperature (T1), and the second reaction time (t2) is determined to be higher than or equal to the first reaction time (t1).

Meanwhile, the first temperature (T1) and the second temperature (T2) satisfy the following Relationship Equation (i).

$$15^\circ\ \text{C.} \le T2 - T1 \le 45^\circ\ \text{C.} \quad \text{(i)}$$

As in Relationship Equation (i), the difference (T2−T1) between the second temperature (T2) and the first temperature (T1) may be, for example, about 15° C. to about 45° C., for example, about 15° C. to about 35° C.

The difference (T2−T1) between the second temperature (T2) and the first temperature (T1) is a condition controlling provision of a plurality of protruding portions PP by the second reaction step on the outer circumferential surface of mother particle CP grown in the first reaction step.

When the difference (T2−T1) between the second temperature (T2) and the first temperature (T1) is less than about 15° C., the temperature difference is excessively low, so the size of protruding portion PP is excessively small; when the difference (T2−T1) between the second temperature (T2) and the first temperature (T1) is greater than about 45° C., the temperature difference is excessively large, so excessive condensation polymerization is performed to increase excessively the size of protruding portion PP.

In the particulate forming process, the temperature of the silicon-containing component including a silicone compound, which is a raw material of particulate, is changed as follows: increasing in one step during the mixed solution preparing process of mixing the temperature (TA) on mixing with the temperature (TB) of the catalyst-containing component higher than the temperature (TA); once decreasing to the first reaction step; then slowly increasing in the transition step or maintaining when the temperature (TA) of the silicon-containing component on mixing is same as the first temperature (T1); and then increasing to the second temperature (T2) in the second reaction step.

By controlling the temperature of the silicon-containing component to be changed according to the multi-step process, the condensation polymerization of the silicone compound during the particulate forming process determines the direction of particulate growth by the mixing process, then grows the particulate by applying the first accumulated heat (Q1) to the mixed solution in the first reaction step, and then provides a dispersion of particulate having the second shape by applying the second accumulated heat (Q2) higher than the first accumulated heat (Q1) to the mixed solution in the second reaction step, so as to react the regions where the condensation polymerization was not performed.

The particulate in the particulate dispersion has Property 1 to Property 5 and Property 7 of the particulate and satisfies the conditions of Sizes 1 to 7 of the protruding portion.

2. Particulate Recovering Process

It is the same as in the method of producing the external additive for toner including a particulate having the first shape.

3. Particulate Hydrophobizing Process

It is the same as in the method of producing the external additive for toner including a particulate having the first shape.

By changing each process condition in the mixed solution preparing process and particulate forming process, the particulate having the second shape may be formed, differing from the particulate having the first shape.

D. Toner

Hereinafter, the toner including the external additive including a particulate having the first shape or the second shape is described.

The toner according to one embodiment includes a toner particle and the external additive including a particulate having the first shape and/or the second shape, wherein the particulate is attached to the surface of the toner particle.

First, a toner mother particle is prepared to provide a toner. The toner mother particle may be a resin particle. For example, a resin is first prepared from a raw material to prepare the toner mother particle. Subsequently, the resin and a colorant are mixed and, if required, further mixed with a charge control agent and a release agent to provide a resin mixture.

The obtained resin mixture is fused and kneaded to provide a kneaded material. The kneaded material is coarsely ground, and then the coarsely ground material is pulverized and fractioned to provide a toner mother particle having a certain average particle diameter.

The obtained toner mother particle is added to the external additive for toner and further added to a hydrophobic silica, if required, and mixed to provide a toner particle.

According to one embodiment, the resin used as a raw material for the toner mother particle may be one kind of resin, for example, a polyester resin, or a mixture of more than one kind of resin. In addition, when it is a mixture of two or more resin materials, two or more different kinds of polyester resins can be mixed and used. But, the scope of the present invention is not limited thereto.

The colorant according to one embodiment may include a pigment for yellow, magenta, or cyan, or a pigment such as carbon black or ferrosoferric oxide for a black color, and the like and may be variously selected according to the usage of the toner.

According to one embodiment, the charge control agent (CCA) is an additive controlling the polarity and electrification of the toner. The CCA may be selected according to the usage of the toner. Examples of a positive electrified charge control agent include an azine-based compound, a quaternary ammonium salt and the like. Examples of a negative electrified charge control agent include an azo-based metal compound, a salicylic acid-based compound and the like.

According to one embodiment, a release agent may include, for example, natural oil such as wax or synthesis oil such as silicone oil, and may be variously selected according to the usage of the toner.

According to one embodiment, hydrophobic silica may be added to a toner in an appropriate amount to provide liquidity to the toner particles according to the kind of image forming apparatus in which the toner is input. The hydrophobic silica may be a silica-based particle having a small particle diameter of, for example, about 20 nm.

The external additive for toner obtained by the method has Property 1 to Property 6 when the particulate has the first shape, so as to provide the following effects.

When the particulate is attached to the toner particle surface, it has an average particle diameter within the appropriate range to facilitate imparting a spacer effect, so as to suppress toner degradation.

The particulate has a ratio ($\alpha/\beta$) of the first specific surface area relative to the second specific surface area within the disclosed range and simultaneously has a lower true density than a particulate of a conventional external additive for toner. Thereby, when the external additive for toner is externally attached to the toner particle surface, the impact force between the toner particle and the particulate may be reduced compared to that observed with a particulate of a conventional external additive for toner and may reduce the damage to the toner particle, so as to suppress toner degradation.

The particulate has a ratio ($\alpha/\beta$) of the first specific surface area relative to the second specific surface area, so as to provide appropriate adhesion between the particulate and the toner particle.

As the appropriate adhesion between the particulate and the toner particle is provided, contamination of members may be suppressed so that image defects caused by member contamination may also be suppressed.

As the particulate has the above ranged loss on heating, the particulate may have a quantity of electric charge sufficient to suppress the toner coalescence phenomenon causing member contamination or underlayer formation on the developing member, so as to suppress image degradation.

As the particulate is a silica polymer formed from the silicone compound, it may have the strength required of an external additive.

Thus, when the external additive for toner according to one embodiment is externally added to the toner surface, it may suppress toner degradation and simultaneously suppress member contamination and the image defects caused by member contamination.

Further, a method of producing an external additive including a particulate including a silicone compound selected from a silane compound represented by Chemical Formula 1, a hydrolysis-condensation product of the silane compound, and a combination thereof includes: a mixed solution preparing process of mixing a silicon-containing component including a silicone compound with a catalyst-containing component to provide a mixed solution; and a particulate forming process including a first reaction step of maintaining the mixed solution at the first temperature (T1) for the first time (t1) and a second reaction step of maintaining the mixed solution at the second temperature (T2) for the second time (t2); when TA(° C.) is the temperature of the silicon-containing component, and when TB(° C.) is the temperature of the catalyst-containing component when the silicon-containing component and the catalyst-containing component are mixed, the following Relationship Equations (a) to (c) are satisfied.

$$2^\circ\ C. < TA < 60^\circ\ C. \quad (a)$$

$$TA < TB \quad (b)$$

$$TB - 40^\circ\ C. < TA < TB - 3^\circ\ C. \quad (c)$$

When the toner particle is externally added to the external additive for toner including a particulate having the first shape, formed under the above temperature conditions, the particulate is controlled to have Property 1 to Property 6 and to provide the obtained toner with appropriate characteristics.

In an embodiment, in the particulate forming process, the properties of the obtained particulate may be appropriately controlled by adjusting the first accumulated heat (Q1) or the second accumulated heat (Q2) within the disclosed range.

The method of producing an external additive for toner including a particulate having the first shape according to one embodiment may provide an external additive for toner that when externally added to the toner surface is capable of suppressing toner degradation and simultaneously suppressing member contamination and image defects caused by the member contamination.

Furthermore, the toner externally added to the external additive for toner including a particulate having the first shape according to one embodiment has a high degradation resistance so that it may maintain the adhesion between the toner particle and the particulate for a long time from right after initiating the use until finishing the use, and may maintain a high transfer efficiency, and simultaneously, may have effects on suppressing image defects caused by member contamination or the like.

When the particulate has the second shape, it has Property 1 to Property 5, Property 7 and Sizes 1 to 7 of protruding portion and has the effects as follows:

As the particulate having the second shape is formed by integrally forming the mother particle CP and the protruding portion PP with the same silicone compound, there is no mechanical strength difference at the interface between the mother particle CP and the protruding portion PP. Thus, the particulate has excellent mechanical strength compared to a conventional particulate, so it is rarely broken even if a physical force, such as a compression force or shear force, is received.

The particulate having the second shape may have excellent mechanical strength as described above and may ensure a contact point with the toner particle by the protruding portion (PP) protruding from the mother particle (CP), so as to improve adhesion to the toner particle. That is, the particulate having the second shape may have high adhesion to a toner particle and excellent mechanical strength, so it is difficult for the particulate to be separated from the toner particle.

Thereby, the contamination of a member such as a photoreceptor, an electrification roll, a development roll and the like (e.g., 'photoreceptor filming' of particulate or pieces under the high temperature/high humidity atmosphere, toner coalesce of photoreceptor under the high temperature/high humidity) or cleaning blade defect, and the like may be suppressed. Accordingly, image defects, such as a phase transition, fogging, and halftone fading, caused by the member contamination may be suppressed.

When the particulate having the second shape is externally added to the toner particle, toner degradation may be suppressed since having an average particle diameter within an appropriate range imparts a spacer effect.

The particulate having the second shape has a lower true density compared to the conventional particulate used as an external additive for toner, so when the disclosed particulate having the second shape is externally added to the toner particle, it may reduce the impact force applied to the toner particle, and it may suppress toner degradation as the impact transferred to the toner particle may be reduced.

As the particulate having the second shape has a loss on heating within a certain disclosed range, it may suppress the phenomenon of underlayer formation on the development member caused by member contamination, and it may have a quantity of electric charge sufficient to suppress image degradation.

As the particulate having the second shape has a certain disclosed range of hydrophobization degree, it may reduce the hygroscopicity of the particulate and may appropriately determine the quantity of electric charge of the toner.

Thus, the external additive for toner having the particulate having the second shape may show improved adhesion with the toner particle and enhance the mechanical strength and have effects to suppress member contamination and image defects caused by the member contamination.

The method of producing the external additive for toner including a particulate consisting of a silicone compound selected from a silane compound represented by Chemical Formula 1, a hydrolysis-condensation product of the silane compound, and a combination thereof includes: a mixed solution preparing process of mixing a silicon-containing component including a silicone compound and a catalyst-containing component to provide a mixed solution; and a particulate forming process including a first reaction step of maintaining the mixed solution at the first temperature (T1) for a first time (t1) and a second reaction step of maintaining the mixed solution at the second temperature (T2) for the second time (t2); and the following Relationship Equations (d) to (i) are satisfied when TA(° C.) refers to the temperature of the silicon-containing component, and TB(° C.) refers to the temperature of the catalyst-containing component when the silicon-containing component and the catalyst-containing component are mixed.

$$0° \text{ C.} \leq TA \leq 10° \text{ C.} \quad \text{(d)}$$

$$20° \text{ C.} \leq TB \leq 50° \text{ C.} \quad \text{(e)}$$

$$10° \text{ C.} \leq TB - TA \leq 50° \text{ C.} \quad \text{(f)}$$

$$5° \text{ C.} \leq T1 \leq 15° \text{ C.} \quad \text{(g)}$$

$$30° \text{ C.} \leq T2 \leq 50° \text{ C.} \quad \text{(h)}$$

$$15° \text{ C.} \leq T2 - T1 \leq 45° \text{ C.} \quad \text{(i)}$$

Thereby, the obtained particulate may have the second shape, so the external additive for toner having the second shape may also have Property 1 to Property 5, Property 7 and may have Sizes 1 to 7 of the protruding portions when it is externally added to the toner particle.

Accordingly, the method of producing the external additive for toner including the particulate having the second shape according to one embodiment may provide an external additive for toner capable of improving adhesion with the toner particle and mechanical strength, and suppressing member contamination.

As the toner externally added to the external additive for toner including the particulate having the second shape according to one embodiment has a high degradation resistance, it may maintain adhesion between the particulate and the toner particle for the long time between the use finishing time and the use initiating time and maintain a high transfer efficiency, and simultaneously may suppress image defects caused by the member contamination or the like, so as to provide improved image quality.

E. Experimental Example

External Additive for Toner Including Particulate Having First Shape and Toner Hereinafter, the external additive for toner including a particulate having the first shape according to one embodiment is described in detail with reference to the Experimental Examples. However, each of the Experimental Examples does not limit an exemplary embodiment.

Hereinafter, Experimental Example 1 will be subsequently described in the order of: preparation of External Additive 1, property confirmation of the obtained External Additive 1, preparation of Toner 1 using External Additive 1, and characteristic evaluation of the obtained Toner 1.

Experimental Examples 2 to 8 and Comparative Examples 1 to 6 will be described in the same order as in Experimental Example 1.

Before describing the Experimental Examples and Comparative Examples, the durability tests and the evaluation methods thereof applied to the Experimental Examples and Comparative Examples will be described.

<Durability Test>

Toner is subjected to Durability Test 1 and Durability Test 2 as follows:

<Durability Test 1>

A color laser printer, CLP-610ND, (printing speed: 21 sheet/minute) manufactured by Samsung Electronics and employing a one-component developing method, is used as the image forming apparatus. Toner is input into a black image forming unit of the image forming apparatus, and full-color copy paper (82 g/cm$^2$, A4 size), manufactured by Fuji Xerox, is used as the transfer material. Durability Test 1 is performed under the conditions of printing out 1500 sheets at room temperature/room humidity (N/N) atmosphere (23° C./55% RH), low temperature/low humidity (L/L) atmosphere (15° C./10% RH), and high temperature/high humidity (H/H) atmosphere (32° C./80% RH) in a way such that one minute is paused after every 2 sheets of the text image controlling the printing rate of 5% are printed in the mono-color mode.

Subsequently, the following evaluations are performed: image concentration, fogging, transfer efficiency, member contamination, and halftone fading.

<Durability Test 2>

Durability Test 2 is performed under the same conditions as in Durability Test 1, except that the printed image is substituted with a beta black image having a center width of 10 cm, the printing atmosphere is changed to 35° C./85% RH, and the print out way is changed to a continuous printing way.

Then the later-described evaluation of filming resistance is performed.

The following evaluations may be performed under the same atmosphere as in the corresponded durability test if there is a durability test corresponding to each evaluation. Furthermore, even if the evaluation is performed without the durability test, it may be performed under the same atmosphere as in a durability test.

<Evaluation 1. Image Concentration>

As an evaluation for the early use stage, one sheet of an image including a square solid patch (each side length: 5 mm) in each of the four corners and in the center portion is printed out using the evaluation subject toner, without performing Durability Test 1. Then the output image is irradiated with light, and the reflection concentration of a patch is measured from the reflectance of the reflected light using a colorimeter (manufactured by GretagMacbeth). The average of the measured values is evaluated and determined, according to the following criteria, to belong to one of A to D.

A to D are as follows.

A: average of reflection concentration-measured values is greater than or equal to about 1.20

B: average of reflection concentration measured values is greater than or equal to about 1.05 and less than about 1.20

C: average of reflection concentration measured values is greater than or equal to about 0.90 and less than about 1.05

D: average of reflection concentration measured values is less than about 0.90

Hereinafter, the evaluation for the early use stage is referred to as 'early evaluation.'

Furthermore, the same evaluation as in 'early evaluation' may be performed using the same toner, after performing Durability Test 1.

Hereinafter, the evaluation after performing Durability Test 1 is referred to as 'after durability test evaluation'.

In this case, when the toner has a high quantity of electric charge, toner hardly escapes from the developing member in the development step, so the toner amount developed on the photoreceptor is decreased.

Thus, when the image concentration is low, the toner may have a high quantity of electric charge.

<Evaluation 2. Fogging>

As an early evaluation, one sheet of image including both a white background region and a printed region is printed out using the same toner as in the above without performing Durability Test 1. The output image is measured using a colorimeter (reflectometer, manufactured by Tokyo Denshoku), and the fogging concentration (%) is calculated from the difference between the degree of whiteness of the white background region of the image and the degree of whiteness of the transfer paper. The image fogging is evaluated and determined to belong to one of A to D, according to the following criteria.

A to D are as follows.

A: fogging concentration is less than or equal to about 1.0%

B: fogging concentration is greater than or equal to about 1.0% and less than or equal to about 2.0%

C: fogging concentration is greater than or equal to about 2.0% and less than or equal to about 3.0%

D: fogging concentration is greater than or equal to about 3.0% Using the same toner as above, evaluation of the 'after durability test' is performed.

Fogging means the phenomenon that the toner is not transferred on the latent image of the photoreceptor and transferred to the white background region where there is a no-image region at the developing stage, when toner is not electrified, or the quantity of electric charge of toner is low, or the toner is electrified in the opposite polarity, so as to deteriorate the image quality. Accordingly, a high fogging concentration corresponds to the cases in which the toner is not electrified or is electrified in an opposite polarity or in which the toner has a low quantity of electric charge.

<Evaluation 3. Transfer Efficiency>

As an early evaluation, when one sheet of beta image is output using the same toner as in the above without performing Durability Test 1, the transfer efficiency may be obtained from the weight ratio between the toner amount on the photoreceptor and the toner amount on the transfer paper.

The transfer efficiency is determined to be 100% when the entire amount of toner on the photoreceptor is transferred to the transfer paper; and transfer efficiency is determined according to the following criteria to belong to one of A to D.

A to D are as follows.

A: transfer efficiency is greater than or equal to about 95%

B: transfer efficiency is greater than or equal to about 90% and less than about 95%

C: transfer efficiency is greater than or equal to about 80% and less than about 90%

D: transfer efficiency is greater than or equal to about 70% and less than about 80%

Furthermore, an 'after durability test evaluation' is performed using the same toner as in above.

All evaluation subject toner is a toner particle with an added external additive having a large particle diameter, and the toner may maintain a high transfer efficiency when adhesion between the external additive having a large particle diameter and the toner particle is maintained. When the transfer efficiency is low, the adhesion between the external additive having a large particle diameter and the toner particle is low.

<Evaluation 4. Member Contamination>

Contamination of the surface of each of the development roll, the electrification roll, and the photoreceptor resulted due to low adhesion between the external additive and the toner particle, resulting in the particulate of the external additive escaping from the toner particle.

(1) Development Roll

As an early evaluation, one sheet of halftone image is output using the same toner as in the above without performing Durability Test 1, and the output image and the development roll are observed.

On observing the development roll, the toner on the surface is removed by air blowing.

Whether the image is defective or not and how contaminated the development roll is are evaluated and the results are determined, according to the following criteria, to belong to one of A to D.

A to D are as follows.

A: the surface of development roll is never contaminated, and the image is never defective.

B: the surface of development roll is little contaminated, and the image is never defective.

C: the surface of development roll is contaminated, and the image is little defective.

D: the surface of development roll is obviously contaminated, and the image is obviously defective (unusable)

Furthermore, an 'after durability test evaluation' is performed using the same toner as in above.

(2) Electrification Roll

As an early evaluation, one sheet of halftone image is output using the same toner as in the above without performing Durability Test 1, and the output image and the electrification roll are observed.

Whether the image is defective or not and how contaminated the electrification roll is are evaluated and the results are determined, according to the following criteria, to belong to one of A to D.

A to D are as follows.

A: the surface of electrification roll is never contaminated, and the image is never defective B: the surface of electrification roll is slightly contaminated, but the image is never defective.

C: the surface of electrification roll is contaminated, and the image is slightly defective.

D: the surface of electrification roll is obviously contaminated, and the image is obviously defective (unusable)

Furthermore, an 'after durability test evaluation' is performed using the same toner as in above.

(3) Photoreceptor

As an early evaluation, one sheet of halftone image is output using the same toner as in the above without performing Durability Test 1, and the output image and the surface of photoreceptor are observed.

Whether the image is defective or not and how contaminated the surface of photoreceptor is are evaluated and the results are determined, according to the following criteria, to belong to one of A to D.

A to D are as follows.

A: the surface of photoreceptor is never contaminated, and the image is never defective B: the surface of photoreceptor surface is slightly contaminated, but the image is never defective.

C: the surface of photoreceptor is contaminated, and the image is slightly defective.

D: the surface of photoreceptor is obviously contaminated, and the image is obviously defective (unusable)

Furthermore, an 'after durability test evaluation' is performed using the same toner as in the above.

<Evaluation 5. Filming Resistance>

Filming means the phenomenon in which the external additive separated from the toner particle by a physical force is attached to the surface of the photoreceptor and then is thermally fused with the photoreceptor to be filmed resulting from deterioration of adhesion between the toner particle and the external additive due to a low quantity of electric charge of the toner particle. Filming easily occurs under an atmosphere of high temperature/high humidity.

As an early evaluation, one sheet of halftone image is output using the same toner as in the above without performing Durability Test 1, and the output image and the surface of photoreceptor are observed.

On observing the photoreceptor surface, the toner on the surface of photoreceptor is removed by an air blow.

Whether the image is defective or not and whether the surface of photoreceptor is fused with the external additive to be filmed are observed by the naked eye and evaluated and the results are determined, according to the following criteria, to belong to one of A to D.

A to D are as follows.

A: it is never filmed on the surface of photoreceptor by the filming phenomenon, and the image is never defective.

B: It is slightly filmed on the surface of photoreceptor by the filming phenomenon, but the image is never defective C: It is filmed on the surface of photoreceptor by the filming phenomenon, and the image is slightly defective D: it is obviously filmed on the surface of photoreceptor by the filming phenomenon, and the image is obviously defective (unusable)

In addition, whether the image is defective may be determined by observing whether the halftone is faded in the halftone image or whether there is any region where the halftone is darkly printed.

According to the criteria of Evaluation 1 to Evaluation 5, an 'A' evaluation refers to appropriately usable, and a 'B' evaluation refers to sufficiently usable.

A toner with a 'C' evaluation is usable if only one 'C' is evaluated besides 'A' or 'B,' but it is unusable if two or more 'C' evaluations are determined. Furthermore, if there is any 'D' evaluation, the toner is determined to be unusable.

The determinations for Evaluation 1 to Evaluation 5 are shown in the following Table 2 and Table 5.

In addition, as shown in Table 2 and Table 5, for the image characteristics (image concentration, fogging, transfer efficiency), the durability test is performed under the room temperature/room humidity condition and under the high temperature/high humidity condition, and the durability test is not performed under the low temperature/low humidity condition. This is because the toner is basically required to maintain uniform image characteristics under the high temperature/high humidity condition, and the image characteristics are not deteriorated under the low temperature/low humidity condition.

Additionally, as shown in Table 2 and Table 5, for member contamination, the durability test is performed under the low temperature/low humidity condition. This is because image degradation occurs easily by member contamination under the low temperature/low humidity condition.

Experimental Examples 1 to 8

In preparing External Additives for toners 1 to 8 according to Experimental Examples 1 to 8, the first temperature (T1) in the first reaction step is set at the same temperature as the temperature (TA) of the silicon-containing component on mixing, and the second temperature (T2) of the second reaction step is set at a temperature less than or equal to the temperature (TB) of the catalyst-containing component on the mixing.

Experimental Example 1

Preparation of External Additive 1

First, external additive 1, which is the external additive for the toner obtained from Experimental Example 1, is prepared as follows:

65 parts by weight of ethanol and 65 parts by weight of acetonitrile and 50 parts by weight of tetraethoxysilane are input into a reaction vessel under a nitrogen atmosphere. While the silicon-containing component including the three components is stirred at a stir speed of 150 rpm, the temperature (TA) of the silicon-containing component during the mixing is controlled at 20° C. In addition, the temperature (TB) of a catalyst-containing component including a mixture of 115 parts by weight of distilled water and 5 parts by weight of 10 wt % ammonia water is controlled during the mixing at 55° C. Subsequently, the entire amount of catalyst-containing component maintained at a temperature (TB) of 55° C. while mixing the catalyst-containing component is added to the stirred silicon-containing component to provide a mixed solution. The temperature of the mixed solution may be 32° C. right after mixing the catalyst-containing component and the silicon-containing component Then the temperature of the mixed solution is adjusted to 20° C., and a first reaction step is performed with stirring at a stir speed of 150 rom while maintaining a first temperature (T1) of 20° C. for a first reaction time (t1) of 1.5 hours. Subsequently, a second reaction step is performed while maintaining a second temperature (T2) of 54° C. for a second reaction time (t2) of 6.5 hours to provide a particulate dispersion. As alternative conditions for preparation of External Additive 1, the temperature (TA) of the silicon-containing component on mixing and the first temperature (T1) are adjusted to the same temperature of 20° C., and the temperature (TB) of the catalyst-containing component on mixing is adjusted to 55° C., and the first and the second reaction times according to the first and the second temperatures during the first and second reaction step are recorded, based on the same, the first accumulated heat (Q1) may be adjusted to 29° C.·hour, and the second accumulated heat (Q2) may be adjusted to 348° C.·hour. The total reaction time (t1+t2) may be adjusted to about 8 hours.

Then 100 parts by weight of distilled water is added into the particulate dispersion obtained by the particulate forming process and heated and concentrated using an evaporator until the amount of liquid is halved. The concentrated solution may be solid-liquid separated by a centrifugal settler. The supernatant is removed through decantation, and then 300 parts by weight of distilled water is added to the precipitate to perform another solid-liquid separation by the same centrifugal settler. After the step is repeated two times, the precipitate is lyophilized for 24 hours to provide a white powder.

Subsequently, 10 parts by weight of the white powder is mixed with 100 parts by weight of water and 15 parts by weight of hexamethyldisilazane ("HMDS") and stirred at room temperature (25° C.) for 30 minutes at 200 rpm under a pressure of 850 mmHg in a reaction vessel and stirred at 70° C. for 4 hours at 200 rpm, and then a solid-liquid separation is performed in accordance with the same procedure as in the particulate forming process and the precipitate is washed with methanol and dried at 80° C. for 48 hours to provide a white powder (external additive 1) comprising a particulate of which the surface is hydrophobized.

Other specifications of the kinds and amounts of raw materials and the process conditions for preparing External Additive 1 are shown in Table 1.

<Evaluation of Properties of External Additive 1>

The obtained External Additive 1 includes a particulate having the first shape, and has a true density of 1.93 g/cm$^3$, a first specific surface area ($\alpha$) of 36.2 m$^2$/g, an average particle diameter of 90 nm, a ratio ($\alpha/\beta$) of the first specific surface area ($\alpha$) to the second specific surface area ($\beta$) of 1.05, a loss on heating of 8.4 wt %, and a nitrogen gas desorption time when measuring the first specific surface area of 7.2 minutes. That is, external additive 1 is confirmed to possess property 1 to property 6 as described above.

Hereinafter, the toner mother particle, to which External Additive 1 is externally added, is fabricated as follows:

Preparation of Resin 1

Resin 1, a raw material of the toner mother particle, is prepared as follows:

10800 g of the propylene oxide addition product of bisphenol A (average addition molar number: 2.2 moles), 4300 g of the ethylene oxide addition product of bisphenol A (average addition molar number: 2.0 moles), 5040 g of terephthalic acid, and 700 g of n-dodecenyl succinic anhydride are introduced into a reaction vessel mounted with a Dean-Stark trap and stirred at 230° C. under a nitrogen atmosphere. The time point when water generated by the reaction is not flowed out is identified by when the liquid amount gathered in the trap is not increased, and then 2112 g of anhydrous trimellitic acid is added thereto and reacted until a softening point is 147° C. to provide a Resin 1. The obtained Resin 1 is designated as "polyester A".

The softening point of polyester A, measured after the reaction, may be 145° C.; the glass transition temperature may be 73° C.; the maximum peak temperature of the heat of fusion may be 80° C.; the acid value may be 26 mgKOH/g; and the hydroxyl value may be 27 mgKOH/g.

Preparation of Resin 2

Resin 2, a raw material of the toner mother particle, is prepared as follows:

12250 g of the propylene oxide addition product of bisphenol A (average addition molar number: 2.2 moles), 21125 g of the ethylene oxide addition product of bisphenol A (average addition molar number: 2.0 moles), 14940 g of terephthalic acid, and 15 g of tributyltin oxide are introduced into a reaction vessel and stirred at 230° C. under a nitrogen atmosphere and reacted until the softening point is 121° C. to provide a Resin 2.

The obtained Resin 2 is designated as "polyester B".

The softening point of polyester B, measured after the reaction, may be 120° C.; the glass transition temperature may be 65° C.; the maximum peak temperature of heat of fusion may be 70° C.; the acid value may be 3.6 mgKOH/g; and the hydroxyl value may be 23.7 mgKOH/g.

Preparation of Toner Mother Particle 1

Toner mother particle 1 is prepared using Resin 1 (polyester A) and Resin 2 (polyester B) as follows:

2880 g of polyester A, 4320 g of polyester B, 300 g of Pigment Blue 15:3 (manufactured by Daiichi Seika Industries), 86.5 g of the charge control agent LR-147 (manufactured by Nippon Carlit), and 504 g of carnauba wax (manufactured by Kato Yoko Co, melting point: 83° C.) as a hydroxyl ester-containing release agent are introduced into a Henshel Mixer and stirred and mixed at 3000 rpm for 15 minutes to provide a mixture. The mixture is fused and kneaded using an open roll-type continuous kneader to provide a kneaded product. The open roll-type continuous kneader used has a roll exterior diameter of 0.14 m, an effective roll length of 0.8 m, and sets the operation conditions at a rotation speed of the heating roll (front roll) of 33 m/minute, a rotation speed of 11 m/minute of the cooling roll (back roll), and a roll gap of 0.1 mm. The heating and cooling media in the roll are set at the temperature of the inlet for inputting a raw material at 150° C., and the temperature of discharging the kneaded product at 115° C. in the heating roll. The temperature of inputting a raw material is set at 35° C. and the temperature of discharging the kneaded product is set at 30° C. in the cooling roll.

The kneaded product is coarse-ground by a rotter brake, and the coarse ground material is pulverized and fractured by using a breaker disc-type grinder (IDS-2 series, manufactured by Nippon Pneumatic Kogkyo) and a dispersion separator to provide an untreated cyan toner particle ("toner mother particle1") having a volume average particle diameter of about 8.0 μm. The volume average particle diameter may be measured using a particle diameter distribution measuring device (MULTISIZER, manufactured by Beckman Coulter).

Preparation of Toner 1

1.0 parts by weight of hydrophobic silica (TS720: manufactured by Cabot) having a small diameter of about 20 nm, which is hydrophobized in hexamethyldisilazane (HMDS), and 0.4 parts by weight of External Additive 1 are added with respect to 150 parts by weight of Toner Mother Particle 1, and mixed in a sample mill at 10,000 rpm for 30 seconds to provide a cyan toner ("Toner 1").

<Evaluation of Toner 1>

The obtained Toner 1 is subjected to Evaluations 1 to 5 for determining the characteristics thereof, and the results are shown in Table 2, presented below. As shown in Table 2, Toner 1 may be evaluated as 'A' for all categories of evaluation. Considering that 'A' may be suitably usable for a toner, it is confirmed that Toner 1 may be applicable as a toner for developing an electrostatic image since it has excellent adhesion between the particulate and the toner particle. The excellent properties of Toner 1 come from the properties of the particulate included in External Additive 1.

Experimental Example 2

Preparation of External Additive 2

External Additive 2 may be prepared in accordance with the same procedure as for External Additive 1, except that the following conditions are changed.

The content of 10 wt % ammonia water in the catalyst-containing component is decreased to 2 parts by weight.

The temperature (TA) of the silicon-containing component on mixing is set at 10° C.

The temperature (TB) of the catalyst-containing component on mixing is set at 44° C.

The first reaction time (t1) is set for 2 hours.

The second reaction time (t2) is set for 6 hours.

The first accumulated heat (Q1) is set at 18° C.·hour.

The second temperature (T2) is set at 44° C., and the second accumulated heat (Q2) is set at 262° C.·hour.

135 parts by weight of water is added into 15 parts by weight of methyltrimethoxysilane to provide a hydrophobization agent.

The types and, amounts of raw material for External Additive 2, and the process conditions thereof are shown in the following Table 1.

<Property Confirmation of External Additive 2>

The obtained External Additive 2 includes a particulate having the first shape and has an average particle diameter of 120 nm, a true density of 1.96 g/cm$^3$, a first specific surface area (α) of 44 m$^2$/g, a ratio (α/β) of the first specific surface area (α) to second specific surface area (β) of 1.72, a loss on heating of 7.2 wt %, and a nitrogen gas desorption time when measuring the first specific surface area of 8.1 minutes. That is, it is confirmed that External Additive 2 has Property 1 to Property 6 as described above.

Experimental Example 3

Preparation of External Additive 3

External Additive 3 may be prepared in accordance with the same procedure as for External Additive 1, except that the following conditions are changed.

The content of 10 wt % ammonia water in the catalyst-containing component is increased to 10 parts by weight.

The temperature (TA) of the silicon-containing component on mixing is set at 5° C.

The temperature (TB) of the catalyst-containing component on mixing is set at 20° C.

The first temperature (T1) is set at 5° C., and the first accumulated heat (Q1) is set at 6.5° C.·hour.

The second temperature (T2) is set at 20° C., and the second accumulated heat (Q2) is set at 119° C.·hour.

The kinds and amount of raw material for External Additive 3, and the process conditions are shown in the following Table 1.

<Property Confirmation of External Additive 3>

The obtained External Additive 3 includes a particulate having the first shape and has an average particle diameter of 210 nm, a true density of 1.85 g/cm$^3$, a first specific surface area (α) of 13.5 m$^2$/g, a ratio (α/β) of the first specific surface area (α) to second specific surface area (β) of 0.87, a loss on heating of 12.5 wt %, and a nitrogen gas desorption time when measuring the first specific surface area of 8.6 minutes. That is, it is confirmed that External Additive 3 has Property 1 to Property 6 as described above.

Experimental Example 4

Preparation of External Additive 4

External Additive 4 may be prepared in accordance with the same procedure as for External Additive 1, except that the following conditions are changed.

The content of 10 wt % ammonia water in the catalyst-containing component is decreased to 3 parts by weight.

The first reaction time (t1) is set for 3 hours.

The second reaction time (t2) is set for 5 hours.

The first temperature (T1) is set as the same as the temperature (TA) of the silicon-containing component on mixing, and the first accumulated heat (Q1) is set at 56° C.·hour.

The second temperature (T2) is set at 35° C., and the second accumulated heat (Q2) is set at 264° C.·hour.

The kinds and amounts of raw material for External additive 4, and the process conditions are shown in the following Table 1.

<Property Confirmation of External Additive 4>

The obtained External Additive 4 includes a particulate having the first shape and has an average particle diameter of 60 nm, a true density of 1.99 g/cm$^3$, a first specific surface area ($\alpha$) of 69.8 m$^2$/g, a ratio ($\alpha/\beta$) of the first specific surface area ($\alpha$) to second specific surface area ($\beta$) of 1.39, a loss on heating of 7.9 wt %, and a nitrogen gas desorption time when measuring the first specific surface area of 9.3 minutes. That is, it is confirmed that External Additive 4 has Property 1 to Property 6 as described above.

Experimental Example 5

Preparation of External Additive 5

External Additive 5 may be prepared in accordance with the same procedure as for External Additive 1, except that the following conditions are changed.

The content of 10 wt % ammonia water in the catalyst-containing component is increased to 12 parts by weight.

The temperature (TB) of the catalyst-containing component on mixing is set at 65° C.

The first reaction time (t1) is set for 4 hours.

The second reaction time (t2) is set for 4 hours.

The first temperature (T1) is set as the same as the temperature (TA) of the silicon-containing component on mixing, and the first accumulated heat (Q1) is set at 74° C.·hour.

The second temperature (T2) is set at 62° C., and the second accumulated heat (Q2) is set at 255° C.·hour.

The kinds and amounts of raw material for External Additive 5, and the process conditions are shown in the following Table 1.

<Property Confirmation of External Additive 5>

The obtained External Additive 5 includes a particulate having the first shape and has an average particle diameter of 230 nm, a true density of 1.87 g/cm$^3$, a first specific surface area ($\alpha$) of 22.3 m$^2$/g, a ratio ($\alpha/\beta$) of the first specific surface area ($\alpha$) to second specific surface area ($\beta$) of 1.60, a loss on heating of 8.6 wt %, and a nitrogen gas desorption time when measuring the first specific surface area of 3.5 minutes. That is, it is confirmed that External Additive 5 has Property 1 to Property 6 as described above.

Experimental Example 6

Preparation of External Additive 6

External Additive 6 may be prepared in accordance with the same procedure as for External Additive 1, except that the following conditions are changed.

The catalyst-containing component is changed to a mixture of 100 parts by weight of distilled water and 2 parts by weight of 10 wt % ammonia water.

The temperature (TB) of the catalyst-containing component on mixing is set at 65° C.

The first reaction time (t1) is set for 3 hours.

The second reaction time (t2) is set for 5 hours.

The first temperature (T1) is set as the same as the temperature (TA) of the silicon-containing component on mixing, and the first accumulated heat (Q1) is set at 56° C.·hour.

The second temperature (T2) is set at 44° C., and the second accumulated heat (Q2) is set at 215° C.·hour.

During the particulate hydrophobizing step, the pressure in the reaction vessel is set at 760 mmHg.

The kinds and amounts of raw material for External Additive 6, and the process conditions are shown in the following Table 1.

<Property Confirmation of External Additive 6>

The obtained External Additive 6 includes a particulate having the first shape and has an average particle diameter of 55 nm, a true density of 2.00 g/cm$^3$, a first specific surface area ($\alpha$) of 77.5 m$^2$/g, a ratio ($\alpha/\beta$) of the first specific surface area ($\alpha$) to second specific surface area ($\beta$) of 1.42, a loss on heating of 7.6 wt %, and a nitrogen gas desorption time when measuring the first specific surface area of 4.6 minutes. That is, it is confirmed that External Additive 6 has Property 1 to Property 6 as described above.

Experimental Example 7

Preparation of External Additive 7

External Additive 7 may be prepared in accordance with the same procedure as for External Additive 1, except that the following conditions are changed. The catalyst-containing component is changed to a mixture of 80 parts by weight of ethanol, 50 parts by weight of acetonitrile, and 50 parts by weight of tetraethoxysilane.

The content of 10 wt % ammonia water in the catalyst-containing component is adjusted to 12 parts by weight.

The temperature (TA) of the silicon-containing component on mixing is set at 40° C.

The temperature (TB) of the catalyst-containing component on mixing is set at 70° C.

The first reaction time (t1) is set for 2 hours.

The second reaction time (t2) is set for 6 hours.

The first temperature (T1) is set as the same as the temperature (TA) of the silicon-containing component on mixing, and the first accumulated heat (Q1) is set at 78° C.·hour.

The second temperature (T2) is set as the same as the temperature (TB) of the catalyst-containing component on mixing, and the second accumulated heat (Q2) is set at 416° C.·hour.

During the particulate hydrophobizing step, the pressure in the reaction vessel is set at 800 mmHg.

The kinds and amounts of raw material for External Additive 7, and the process conditions are shown in the following Table 1.

<Property Confirmation of External Additive 7>

The obtained External Additive 7 includes a particulate having the first shape and has an average particle diameter of 250 nm, a true density of 2.00 g/cm$^3$, a first specific surface area ($\alpha$) of 15 m$^2$/g, a ratio ($\alpha/\beta$) of the first specific surface area ($\alpha$) to second specific surface area ($\beta$) of 1.25, a loss on heating of 10.1 wt %, and a nitrogen gas desorption time when measuring the first specific surface area of 4.0 minutes. That is, it is confirmed that External Additive 7 has Property 1 to Property 6 as described above.

Experimental Example 8

Preparation of External Additive 8

External Additive 8 may be prepared in accordance with the same procedure as for External Additive 1, except that the following conditions are changed.

The catalyst-containing component is changed to a mixture of 80 parts by weight of distilled water and 2 parts by weight of 10 wt % ammonia water.

The temperature (TA) of the silicon-containing component on mixing is set at 45° C.

The temperature (TB) of the catalyst-containing component on mixing is set at 65° C.

The first reaction time (t1) is set for 1.9 hours.

The second reaction time (t2) is set for 10 hours.

The first temperature (T1) is set as the same in the temperature (TA) of the silicon-containing component on the mixing, and the first accumulated heat (Q1) is set at 84° C.·hour.

The second temperature (T2) is set as the same in the temperature (TB) of the catalyst-containing component on mixing, and the second accumulated heat (Q2) is set at 633° C.·hour.

Total sum of the reaction time is increased to 11.9 hours.

During the particulate hydrophobization step, the pressure in the reaction vessel is set at 800 mmHg.

The kinds and amounts of raw material for External Additive 8, and the process conditions are shown in the following Table 1.

<Property Confirmation of External Additive 8>

The obtained External Additive 8 includes a particulate having the first shape and has an average particle diameter of 52 nm, a true density of 1.85 g/cm$^3$, a first specific surface area ($\alpha$) of 79.3 m$^2$/g, a ratio ($\alpha/\beta$) of the first specific surface area ($\alpha$) to second specific surface area ($\beta$) of 1.27, a loss on heating of 8.7 wt %, and a nitrogen gas desorption time when measuring the first specific surface area of 4.9 minutes. That is, it is confirmed that External Additive 8 has Property 1 to Property 6 as described above.

Table 1 is as follows:

TABLE 1

| Step | Raw material, preparation condition | | Ex. 1 | Ex. 2 | Ex. 3 | Ex. 4 | Ex. 5 | Ex. 6 | Ex. 7 | Ex. 8 |
|---|---|---|---|---|---|---|---|---|---|---|
| Particulate formation step | silicon-containing component | ethanol (parts by weight) | 65 | 65 | 65 | 65 | 65 | 65 | 80 | 65 |
| | | acetonitrile (parts by weight) | 65 | 65 | 65 | 65 | 65 | 65 | 50 | 65 |
| | | tetraethoxy silane (parts by weight) | 50 | 50 | 50 | 50 | 50 | 50 | 50 | 50 |
| | | diphenyldiethoxy silane (parts by weight) | — | — | — | — | — | — | — | — |
| | Catalyst-containing component | water (parts by weight) | 115 | 115 | 115 | 115 | 115 | 100 | 115 | 80 |
| | | 10% ammonia (parts by weight) | 5 | 2 | 10 | 3 | 12 | 2 | 12 | 2 |
| | | 20% ammonia (parts by weight) | — | — | — | — | — | — | — | — |
| | Preparation condition | temperature TA (° C.) of silicon-containing component when being mixed | 20 | 10 | 5 | 20 | 20 | 20 | 40 | 45 |
| | | temperature TB (° C.) of catalyst-containing component when being mixed | 55 | 45 | 20 | 55 | 65 | 45 | 70 | 65 |

TABLE 1-continued

| Step | Raw material, preparation condition | | Ex. 1 | Ex. 2 | Ex. 3 | Ex. 4 | Ex. 5 | Ex. 6 | Ex. 7 | Ex. 8 |
|---|---|---|---|---|---|---|---|---|---|---|
| | | Additive after mixing | catalyst-containing component | catalyst-containing com-ponent | catalyst-containing com-ponent | catalyst-containing com-ponent | catalyst-containing com-ponent | catalyst-containing com-ponent | catalyst-containing com-ponent | catalyst-containing com-ponent |
| | | T1 (° C.) | 20 | 10 | 5 | 20 | 20 | 20 | 40 | 45 |
| | | T2 (° C.) | 54 | 44 | 20 | 53 | 62 | 44 | 70 | 65 |
| | | Q1 (° C. · hour) | 29 | 18 | 6.5 | 56 | 74 | 56 | 78 | 84 |
| | | Q2 (° C. · hour) | 348 | 262 | 119 | 264 | 255 | 215 | 416 | 633 |
| | | t1 (hour) | 1.5 | 2 | 1.5 | 3 | 4 | 3 | 2 | 1.9 |
| | | t2 (hour) | 6.5 | 6 | 6.5 | 5 | 4 | 5 | 6 | 10 |
| | | t1 + t2 (hour) | 8 | 8 | 8 | 8 | 8 | 8 | 8 | 11.9 |
| Particulate hydrophobization step | Treatment agent | hexamethyl disilazane (parts by weight) | 15 | | 15 | 15 | 15 | 15 | 15 | 15 |
| | | methyltrimethoxy silane (parts by weight) | — | 15 | — | — | — | — | — | — |
| | solvent | water (parts by weight) | 100 | 135 | 100 | 100 | 100 | 100 | 100 | 100 |
| | preparation condition | Temperature (° C.) | 70 | 70 | 70 | 70 | 70 | 70 | 70 | 70 |
| | | Pressure in reaction vessel (mmHg) | 850 | 850 | 850 | 850 | 800 | 760 | 800 | 800 |
| Properties of external additive | average particle diameter (nm) | | 90 | 120 | 210 | 60 | 230 | 55 | 250 | 52 |
| | first specific surface area (α) | | 36.2 | 44 | 13.5 | 69.8 | 22.3 | 77.5 | 15 | 79.3 |
| | second specific surface area (β) | | 34.5 | 25.5 | 15.4 | 50.3 | 14.0 | 54.5 | 12.0 | 62.4 |
| | true density (ρ:g/cm$^3$) | | 1.93 | 1.96 | 1.85 | 1.99 | 1.87 | 2.00 | 2.00 | 1.85 |
| | α/β | | 1.05 | 1.72 | 0.87 | 1.39 | 1.60 | 1.42 | 1.25 | 1.27 |
| | loss on heating Comp. Ex. (mass %) | | 8.4 | 7.2 | 12.5 | 7.9 | 8.6 | 7.6 | 10.1 | 8.7 |
| | Nitrogen gas desorption time (min) | | 7.2 | 8.1 | 8.6 | 9.3 | 3.5 | 4.6 | 4.0 | 4.9 |
| | ρ/(α/β) | | 1.84 | 1.14 | 2.12 | 1.43 | 1.17 | 1.41 | 1.60 | 1.46 |

Preparation of Toners 2 to 8

Toners 2 to 8 are prepared in accordance with the same procedure as for Toner 1, except the kind of external additive is changed to each External Additives 2 to 8, respectively.

<Evaluation of Toners 2 to 8>

Toners 2 to 8 are evaluated in accordance with the same method as for Toner 1, and the results are shown in the following Table 2.

Toner 2 is evaluated as 'A' for 13 categories among the total 16 categories.

The other 3 categories (fogging under the high temperature/high humidity atmosphere after durability test; photoreceptor contamination under low temperature/low humidity atmosphere; and filming resistance) are evaluated as 'B', which is not a disruptive influence on the use, so it may be appropriately used.

Toner 3 is evaluated as 'A' for 8 categories.

The other 8 categories (fogging and transfer efficiency under the room temperature/room humidity atmosphere after durability test; fogging and transfer efficiency under the high temperature/high humidity atmosphere after durability test; development roll, charge roll, photoreceptor contamination under low temperature/low humidity atmosphere; and filming resistance) are evaluated as 'B', which is not a disruptive influence on the use, so it may be appropriately used.

Toner 4 is evaluated as 'A' for 13 categories.

The other 3 categories (fogging and transfer efficiency under the high temperature/high humidity atmosphere after durability test; development roll contamination under low temperature/low humidity atmosphere) are evaluated as 'B', which is not a disruptive influence on the use, so it may be appropriately used.

Toner 5 is evaluated as 'A' for 11 categories.

The other 5 categories (image concentration and fogging under the high temperature/high humidity atmosphere after durability test; charge roll, photoreceptor contamination and filming resistance under low temperature/low humidity atmosphere; and filming resistance) are evaluated as 'B', which is not a disruptive influence on the use, so it may be appropriately used.

Toner 6 is evaluated as 'A' for 12 categories.

The other 4 categories (image concentration, fogging and transfer efficiency under the high temperature/high humidity atmosphere after durability test; photoreceptor contamination under low temperature/low humidity atmosphere) are evaluated as 'B', which is not a disruptive influence on the use, so it may be appropriately used.

Toner 7 is evaluated as 'A' for 10 categories.

The other 6 categories (transfer efficiency under the room temperature/room humidity atmosphere after durability test; transfer efficiency under the high temperature/high humidity atmosphere after durability test; development roll, charge roll, photoreceptor contamination and filming resistance under low temperature/low humidity atmosphere) are evaluated as 'B', which is not a disruptive influence on the use, so it may be appropriately used.

Toner 8 is evaluated as 'A' for 11 categories.

Although the other 5 categories (fogging under the room temperature/room humidity atmosphere after durability test, image concentration, fogging and transfer efficiency under the high temperature/high humidity atmosphere after durability test, photoreceptor contamination under low temperature/low humidity atmosphere) are evaluated as 'B', this is not a disruptive influence on the use, so it may be appropriately used.

As the evaluating results in above, it is confirmed that all Toners 2 to 8 are appropriately usable as a toner for developing an electrostatic image having excellent degradation resistance and adhesion between the external additive and the toner particle.

It is understood that the excellent properties of Toners 2 to 8 result from the properties of the particulates included in External Additives 2 to 8.

adjusted to be the same as the temperature (TB) of the catalyst-containing component on mixing.

Comparative Example 1

Preparation of Comparative External Additive 1

Comparative External Additive 1 is prepared in accordance with the same procedure as for External Additive 1, except that the following conditions are changed.

The catalyst-containing component is changed to a mixture of 70 parts by weight of distilled water and 2 parts by weight of 10 wt % ammonia water.

The temperature (TB) of the catalyst-containing component on mixing is set at 65° C.

The first reaction time (t1) is set for 2 hours.

The second reaction time (t2) is set for 6 hours.

The first temperature (T1) is set as the same as the temperature (TA) of the silicon-containing component on mixing, and the first accumulated heat (Q1) is set at 38° C.·hour.

The second temperature (T2) is set at 63° C., and the second accumulated heat (Q2) is set at 381° C.·hour.

During the particulate hydrophobization step, the pressure in the reaction vessel is set at 760 mmHg.

TABLE 2

| | | | Ex. 1 | Ex. 2 | Ex. 3 | Ex. 4 | Ex. 5 | Ex. 6 | Ex. 7 | Ex. 8 |
|---|---|---|---|---|---|---|---|---|---|---|
| Image characteristic (room temperature/room humidity) | Initial time | Image concentration | A | A | A | A | A | A | A | A |
| | | Fogging | A | A | A | A | A | A | A | A |
| | | Transfer efficiency | A | A | A | A | A | A | A | A |
| | After durability test | Image concentration | A | A | A | A | A | A | A | A |
| | | Fogging | A | A | B | A | A | A | A | B |
| | | Transfer efficiency | A | A | B | A | A | A | B | A |
| Image characteristic (high temperature/high humidity) | Initial time | Image concentration | A | A | A | A | A | A | A | A |
| | | Fogging | A | A | A | A | A | A | A | A |
| | | Transfer efficiency | A | A | A | A | A | A | A | A |
| | After durability test | Image concentration | A | A | A | A | B | B | A | B |
| | | Fogging | A | B | B | B | B | B | A | B |
| | | Transfer efficiency | A | A | B | B | A | B | B | B |
| Member contamination (low temperature/low humidity) | Development roll | | A | A | B | B | A | A | B | A |
| | Charge roll | | A | A | B | A | B | A | B | A |
| | Photoreceptor | | A | B | B | A | B | B | B | B |
| Filming resistance | Photoreceptor | | A | B | B | A | B | A | B | A |

Comparative Examples 1 to 6

In preparing External Additives 1, 2, and 6 according to Comparative Examples 1, 2, and 6 among the following Comparative Examples 1 to 6, the first temperature in the first reaction step is adjusted to be the same as the temperature (TA) of the silicon-containing component on mixing, and the second temperature in the second reaction step is The kinds and the amounts of raw material for Comparative External Additive 1, and the process conditions are shown in the following Table 3.

<Property Confirmation of Comparative External Additive 1>

Properties of Comparative External Additive 1 are shown in the following Table 4.

As shown in Table 4, the obtained Comparative External Additive 1 has an average particle diameter of 40 nm, a first specific surface area (α) of 78 $m^2/g$, a true density of 1.98 g/cm$^3$, a ratio ($\alpha/\beta$) of the first specific surface area ($\alpha$) to second specific surface area ($\beta$) of 1.03, a loss on heating of 8.2 wt %, and a nitrogen gas desorption time when measuring the first specific surface area of 10.2 minutes.

Comparative External Additive 1 does not satisfy the above desired properties. This is considered to result because TA and TB do not satisfy the relationship of TB−40° C.<TA<TB−3° C. by adjusting TB to 65° C.

Comparative Example 2

Preparation of Comparative External Additive 2

Comparative external additive 2 is prepared in accordance with the same procedure as for External additive 1, except that the following conditions are changed.

10 wt % ammonia water in the catalyst-containing component is increased to 20 parts by weight.

The temperature (TA) of the silicon-containing component on mixing is set at 47° C.

The first reaction time (t1) is set for 3 hours.

The second reaction time (t2) is set for 5 hours.

The first temperature (T1) is set as in the temperature (TA) of the silicon-containing component on mixing, and the first accumulated heat (Q1) is set at 137° C.·hour.

The second temperature (T2) is set as the same as the temperature (TB) of the catalyst-containing component on mixing, and the second accumulated heat (Q2) is set at 266° C.·hour.

During particulate hydrophobization step, the pressure in the reaction vessel is set at 760 mmHg.

The kinds and the amounts of raw material for Comparative External Additive 2, and the process conditions are shown in the following Table 3.

<Property Confirmation of Comparative External Additive 2>

Properties of Comparative External Additive 2 are shown in the following Table 4.

As shown in Table 4, the obtained Comparative External Additive 2 has an average particle diameter of 200 nm, a first specific surface area ($\alpha$) of 12 m$^2$/g, a true density of 1.98 g/cm$^3$, a ratio ($\alpha/\beta$) of the first specific surface area ($\alpha$) to second specific surface area ($\beta$) of 0.79, a loss on heating of 10.2 wt %, and a nitrogen gas desorption time when measuring the first specific surface area of 6.7 minutes.

Comparative External Additive 2 does not satisfy the above desired properties. This is considered to result because the first accumulated heat Q1 is excessively high.

TABLE 3

| Step | Raw material, preparation condition | | Comparative Example 1 | Comparative Example 2 | Comparative Example 6 |
|---|---|---|---|---|---|
| Particulate formation step | Silicon-containing component | Ethanol (parts by weight) | 65 | 65 | 65 |
| | | Acetonitrile (parts by weight) | 65 | 65 | 65 |
| | | Tetraethoxysilane (parts by weight) | 50 | 50 | 9 |
| | | Diphenyldiethoxy silane (parts by weight) | — | — | 3 |
| | Catalyst-containing component | water (parts by weight) | 70 | 115 | 115 |
| | | 10% ammonia (parts by weight) | 2 | 20 | — |
| | | 20% ammonia (parts by weight) | — | — | 0.5 |
| | Preparation condition | Temperature TA (° C.) of silicon-containing component when being mixed | 20 | 47 | 20 |
| | | Temperature TB (° C.) of catalyst-containing component when being mixed | 65 | 55 | 55 |
| | | Post-addition component | catalyst-containing component | catalyst-containing component | silicon-containing component |
| | | T1 (° C.) | 20 | 47 | 20 |
| | | T2 (° C.) | 63 | 55 | 54 |
| | | Q1 (° C. · time) | 38 | 137 | 29 |
| | | Q2 (° C. · time) | 381 | 266 | 348 |
| | | t1 (time) | 2 | 3 | 1.5 |
| | | t2 (time) | 6 | 5 | 6.5 |
| | | T1 + t2 (time) | 8 | 8 | 8 |

TABLE 3-continued

| Step | Raw material, preparation condition | | Comparative Example 1 | Comparative Example 2 | Comparative Example 6 |
|---|---|---|---|---|---|
| Particulate hydrophobization step | Treatment agent | Hexamethyl disilazane (parts by weight) | 15 | 15 | — |
| | | Methyltrimethoxy silane (parts by weight) | — | — | 15 |
| | Solvent | Water (parts by weight) | 100 | 100 | 100 |
| | Preparation condition | Temperature (° C.) | 70 | 70 | 70 |
| | | Pressure (mmHg) in reaction vessel | 760 | 760 | 850 |

Comparative Example 3

Preparation of Comparative External Additive 3

693.9 g of methanol, 46.0 g of water, and 55.3 g of 28 wt % ammonia water are input to a 3 L glass reactor having an agitator, a drip funnel, and a thermometer and mixed. The mixed solution is adjusted to 35° C. and 1293.0 g of tetramethoxysilane and 464.5 g of 5.4 wt % ammonia water are added at the same time with stirring, with the tetramethoxysilane dripped for 6 hour, and the ammonia water dripped for 4 hours. Even after completing the tetramethoxysilane drip, the mixed solution is continuously stirred for 0.5 hours to carry out the hydrolysis reaction, so that a particulate dispersion is obtained.

To the particulate dispersion is added 547.4 g of hexamethyldisilazane (HMDS) at room temperature and heated at 120° C. and reacted for 3 hours to trimethylsilylate the particulate. Subsequently, the solvent is distillated and removed under reduced pressure to provide 553.0 g of a hydrophobic particulate (Comparative External Additive 3) having a spherical shape.

<Property Confirmation of Comparative External Additive 3>

Properties of Comparative External Additive 3 are shown in the following Table 4.

As shown in Table 4, the obtained Comparative External Additive 3 has an average particle diameter of 85 nm, a first specific surface area ($\alpha$) of 26.1 $m^2/g$, a true density of 2.03 $g/cm^3$, a ratio ($\alpha/\beta$) of the first specific surface area ($\alpha$) to second specific surface area ($\beta$) of 0.75, a loss on heating of 6.1 wt %, and a nitrogen gas desorption time when measuring the first specific surface area of 5.8 minutes.

Comparative External Additive 3 does not satisfy the above desired properties. This is considered to result because the temperature of each of tetraethoxysilane and ammonia water on mixing is set at the same temperature, and because the temperature of condensation polymerizing the silane compound is set constantly at 35° C.

Comparative External Additive 3 is prepared according to 'Preparation Example 1' of large-diameter silica particulate' disclosed in Japanese Patent Laid-Open Publication No. 2012-168222.

Comparative Example 4

Preparation of Comparative External Additive 4

A hydrophobic particulate (Comparative External Additive 4) having a spherical shape is prepared in accordance with the same procedure as for Comparative External Additive 3, except that the reaction temperature in the particulate forming process is changed to 45° C.

<Property Confirmation of Comparative External Additive 4>

Properties of Comparative External Additive 4 are shown in the following Table 4.

As shown in Table 4, the obtained Comparative External Additive 4 has an average particle diameter of 60 nm, a first specific surface area ($\alpha$) of 39.2 $m^2/g$, a true density of 1.94 $g/cm^3$, a ratio ($\alpha/\beta$) of the first specific surface area ($\alpha$) to second specific surface area ($\beta$) of 0.76, a loss on heating of 4.9 wt %, and a nitrogen gas desorption time when measuring the first specific surface area of 5.5 minutes.

Comparative External Additive 4 does not satisfy the above desired properties. This is considered to result because the temperature of each of tetraethoxysilane and ammonia water on mixing is set at the same temperature, and because the temperature of condensation polymerizing the silane compound is set constantly at 45° C.

Comparative External Additive 4 is prepared according to 'Preparation Example 1 of large-diameter silica particulate' disclosed in Japanese Patent Laid-Open Publication No. 2012-168222.

Comparative Example 5

Preparation of Comparative External Additive 5

80 parts by weight of ethanol, 80 parts by weight of 2-propanol, 9 parts by weight of tetraethoxysilane, and 3 parts by weight of diphenylethoxysilane are introduced into a reaction vessel under nitrogen atmosphere and 6 parts by weight of distilled water are added and then stirred at 60 rpm and dripped with 14 parts by weight of 20 wt % ammonia water for 40 minutes with stirring. After stirring at 30° C. for 3.5 hours, the reaction is concentrated using an evaporator until the liquid amount is decreased to the half. 10 parts by weight of tert-butanol and 300 parts by weight of distilled water are added into the concentrated product, and the product is precipitated by a centrifugal settler. The supernatant is removed by decantation, and then 300 parts by weight of distilled water are added and a solid-liquid separation is performed through the centrifugal settler. The solid-liquid separation is repeated several times, and the precipitate is lyophilized for 2 days using a freeze-dryer to provide a white powder.

10 parts by weight of the obtained white powder is added to a mixture of 300 parts by weight of toluene and 1 part by weight of isobutyltrimethoxysilane and stirred at a room temperature for 30 minutes with adding ultrasonic wave and concentrated and solidified and then heated and dried at 120° C. for 1 hour. Subsequently, 100 parts by weight of hexamethyldisilazane (HMDS) is added thereto and stirred at room temperature for 30 minutes with ultrasonic waves, concentrated and dried-solidified and then heated and dried at 120° C. for 1 hour to provide a white powder (Comparative External Additive 5).

<Property Confirmation of Comparative External Additive 5>

Properties of Comparative External Additive 5 are shown in the following Table 4.

As shown in Table 4, the obtained Comparative External Additive 5 has an average particle diameter of 131 nm, a first specific surface area (α) of 20.3 $m^2/g$, a true density of 2.17 $g/cm^3$, a ratio (α/β) of the first specific surface area (α) to second specific surface area (β) of 0.96, a loss on heating of 3.5 wt %, and a nitrogen gas desorption time when measuring the first specific surface area of 6.1 minutes.

Comparative External Additive 5 does not satisfy the above desired properties. This is considered to result because the temperature of each of tetraethoxysilane and ammonia water on mixing is set to the same temperature, and because the temperature for condensation polymerizing the silane compound is set constantly at 30° C.

Comparative External Additive 5 is prepared according to 'preparation of Silica External Additive 2' in Japanese Patent Laid-Open Publication No. 2007-264142.

Comparative Example 6

Preparation of Comparative External Additive 6

White powder (Comparative External Additive 6) may be prepared in accordance with the same conditions as for External Additive 1, except that 9 parts by weight of tetraethoxysilane and 3 parts by weight of diphenyldiethoxysilane$_{[ss1]}$ are used instead of 50 parts by weight of tetraethoxysilane, 0.5 parts by weight of 20 wt % ammonia water is used instead of 5 parts by weight of 10 wt % ammonia water, methyltrimethoxysilane$_{[ss2]}$ is used instead of hexamethyldisilazane (HMDS), and the silicon-containing component is added into the catalyst-containing component.

The kinds and amounts of raw material for Comparative External Additive 6, and the process conditions are shown in Table 3.

<Property Confirmation of Comparative External Additive 6>

Properties of Comparative External Additive 6 are shown in the following Table 4.

As shown in Table 4, the obtained Comparative External Additive 6 has an average particle diameter of 135 nm, a first specific surface area (α) of 28.7 $m^2/g$, a true density of 1.90 $g/cm^3$, a ratio (α/β) of the first specific surface area (α) to second specific surface area (β) of 1.23, a loss on heating of 4.2 wt %, and a nitrogen gas desorption time when measuring the first specific surface area of 4.8 minutes.

Comparative External Additive 6 does not satisfy the desired properties. This is considered to result because diphenyldiethoxysilane, which is a silane compound but is not a tetrafunctional silane compound for condensation-polymerization, is used as a silicone compound.

Preparation of Comparative Toners 1 to 6

Comparative Toners 1 to 6 are prepared in accordance with the same procedure as for Toner 1, except that the kind of external additive is changed from External Additive 1 to each of Comparative External Additives 1 to 6, respectively.

TABLE 4

| | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|
| Properties of external additive | Average particle diameter (nm) | 40 | 200 | 85 | 60 | 131 | 135 |
| | First specific surface area(α) | 78 | 12 | 26.1 | 39.2 | 20.3 | 28.7 |
| | Second specific surface area (β) | 75.8 | 15.2 | 34.8 | 51.6 | 21.1 | 23.4 |
| | True density (ρ:g/cm$^3$) | 1.98 | 1.98 | 2.03 | 1.94 | 2.17 | 1.90 |
| | α/β | 1.03 | 0.79 | 0.75 | 0.76 | 0.96 | 1.23 |
| | Loss on heating Comp. Ex. (mass %) | 8.2 | 10.2 | 6.1 | 4.9 | 3.5 | 4.2 |
| | Nitrogen gas desorption time (min) | 10.2 | 6.7 | 5.8 | 5.5 | 6.1 | 4.8 |
| | ρ/(α/β) | 1.92 | 2.50 | 2.70 | 2.55 | 2.26 | 1.55 |

<Evaluation of Comparative Toners 1 to 6>

Comparative Toners 1 to 6 are evaluated by the same method as for Toner 1, the evaluation results are shown in the following Table 5.

As shown in Table 5, the evaluations for Comparative Toners 1 to 6 are as follows:

Comparative Toner 1 is evaluated as 'A' for 7 categories, 'B' for 4 categories, and 'C' in 5 categories for all 16 categories.

That is, Comparative Toner 1 is unusable since it is evaluated as 'C' in greater than or equal to 31% of the categories.

Comparative Toner 2 is evaluated as 'D' for 4 categories. That is, according to the presence of 'D' evaluations, Comparative Toner 2 is impossible to be used.

Comparative Toner 3 is evaluated as 'D' for 1 category. That is, according to the presence of an evaluation of 'D,' Comparative Toner 3 is unusable.

Comparative Toner 4 is evaluated as 'A' for 8 categories and 'B' for 5 categories, and 'C' for 3 categories in all 16 categories. That is, Comparative Toner 4 is unusable since it is evaluated as 'C' for greater than or equal to 18% of the categories.

Comparative Toner 5 is evaluated as 'D' for 3 categories. That is, according to the presence of an evaluation of 'D,' Comparative Toner 5 is unusable.

Comparative Toner 6 is evaluated as 'D' for 1 category. That is, according to the presence of an evaluation of 'D,' Comparative Toner 6 is unusable.

According to the evaluations, it is confirmed that all Comparative Toners 1 to 6 are unusable and have deteriorated characteristics compared to Toners 1 to 8 according to one embodiment.

It is observed that all External Additives 1 to 8 externally added in Toners 1 to 8 according to one embodiment have Property 1 to Property $6_{[ss3]}$ and on the other hand, all Comparative External Additives 1 to 6 externally added in Comparative Toners 1 to 6 do not satisfy all of the above desired properties.

TABLE 5

| | | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|
| Image characteristic (room temperature/room humidity) | Initial time | Image concentration | A | A | A | A | A | A |
| | | Fogging | A | A | A | A | A | A |
| | | Transfer efficiency | A | A | A | A | A | A |
| | After durability test | Image concentration | A | A | A | A | A | A |
| | | Fogging | B | A | A | A | A | A |
| | | Transfer efficiency | B | A | A | B | A | A |
| Image characteristic (high temp/high humidity) | Initial time | Image concentration | A | A | A | A | A | A |
| | | Fogging | A | A | A | A | A | A |
| | | Transfer efficiency | A | A | A | A | A | A |
| | After durability test | Image concentration | C | B | A | B | A | A |
| | | Fogging | C | B | A | B | B | A |
| | | Transfer efficiency | C | B | A | B | B | A |
| Member contamination (low temperature/ low humidity) | Development roll | | C | D | D | C | D | D |
| | Charge roll | | B | D | C | C | C | B |
| | Photoreceptor | | B | D | C | C | D | B |
| Filming resistance | Photoreceptor | | C | D | C | B | D | C |

According to Experimental Examples 1 to 8, External Additives 1 to 8 are prepared under conditions such that the first reaction step is performed with the first temperature (T1) set at the same temperature as the temperature (TA) of the silicon-containing component on mixing, and the second reaction step is performed with the second temperature (T2) set at a temperature less than or equal to the temperature (TB) of the catalyst-containing component on mixing; but the first temperature (T1) may be set at a different temperature from the temperature (TA) of the silicon-containing component on mixing, and also the second temperature (T2) may be set at a temperature greater than the temperature (TB) of the catalyst-containing component on mixing, when the temperature (TA) of the silicon-containing component and the temperature (TB) of the catalyst-containing component on mixing satisfy the Relationship Equations (a) to (c); or when TB and TA satisfy the Relationship Equations (a) to (c), and also the first reaction step is carried out under a condition such that the first accumulated heat (Q1) is set at 5° C.·hour to 90° C.·hour, and the second reaction step is carried out under a condition such that the second accumulated heat (Q2) is set at 200° C.·hour to 700° C.·hour.

In addition, according to Experimental Examples 1 to 8, Toners 1 to 8 may be prepared by externally adding External Additives 1 to 8 onto Toner Mother Particle 1, but the external additive externally added to Toner Mother Particle 1 may include other external additives besides External Additive 1 to 8.

F. Experimental Example

External Additive for Toner Including Particulate Having Second Shape and Toner Hereinafter, the external additive for toner including a particulate having a second shape according to one embodiment is particularly described with reference to the Experimental Examples. But each of the Experimental Examples does not limit the scope of the present invention.

Before describing the Experimental Examples and the Comparative Examples, further evaluations are described, in addition to the evaluations for the external additives for toner including a particulate having the first shape and the toners.

<Evaluation 6. Halftone Fading>

Halftone fading is a phenomenon in which a part of the image concentration dramatically fades away on the paper where the image is to be formed by the toner due to electrification defects of the toner generated when the external additive for toner has a high hygroscopicity, thereby, it may determine whether an image is defective or not. Thereby, when halftone fading occurs it is understood that toner electrification is defective.

After the durability test, a halftone image having 25% image concentration is output using the above toner. The output image is observed by the naked eye to determine whether the halftone is faded and disappearing, using the following evaluation criteria to determine to which one of A to D the image belongs.

A to D are as follows.

A: Halftone fading is never apparent at any one of the three atmospheres (room temperature/room humidity, low temperature/low humidity and high temperature/high humidity), (toner appropriately usable)

B: Halftone fading is apparent at one of the three atmospheres (room temperature/room humidity, low temperature/low humidity and high temperature/high humidity), but the degree of halftone fading is not serious, so it is not difficult to be practically used (toner usable)

C: Halftone fading is apparent at one of the three atmospheres (room temperature/room humidity, low temperature/low humidity and high temperature/high humidity), and the halftone fading is obvious, so there is a problem for practical use (toner unusable)

D: Halftone fading is apparent at all three atmospheres (room temperature/room humidity, low temperature/low humidity and high temperature/high humidity), (toner unusable)

According to the criteria of Evaluation 6, 'A' refers to appropriately usable, and 'B' refers to sufficiently usable toners.

In the case of an evaluation of 'C,' when only one 'C' is evaluated besides 'A' or 'B,' the toner is defined as usable, but when two or more evaluations of 'C' are determined, the toner is defined as unusable. Furthermore, when even one 'D' evaluation is made, the toner is defined as unusable.

Hereinafter, in Experimental Example 9, preparation of External Additive 9, property confirmation of External Additive 9, preparation of Toner 9 using External Additive 9, and Characteristic Evaluation of the obtained Toner 9 will be described sequentially.

Experimental Examples 10 to 17 and Comparative Examples 7 to 11 will be described in the same order as for Experimental Example 9.

Experimental Example 9

Preparation of External Additive 9

First, External Additive 9, which is an external additive for toner according to Experimental Example 9, is prepared as follows.

80 parts by weight of ethanol, 60 parts by weight of acetonitrile, and 40 parts by weight of tetraethoxysilane are introduced into a reaction vessel under a nitrogen atmosphere, and the temperature (TA) of the silicon-containing component on mixing is controlled at 5° C. while the silicon-containing component including the three components is stirred at a stir speed of 150 rpm. In addition, the temperature (TB) of the catalyst-containing component including a mixture of 40 parts by weight of distilled water and 5 parts by weight of 10 wt % ammonia water is controlled at 30° C. Subsequently, the whole amount of catalyst-containing components is instantly added to the stirred silicon-containing component while maintaining the temperature (TB) of the catalyst-containing component on mixing at 30° C. to provide a mixed solution. Right after the mixing, the temperature of mixed solution may be 10° C.

Then a first reaction, with a first temperature (T1) maintained at 10° C. and a first reaction time (t1) of 2 hours, is performed while stirring the mixed solution at a stir speed of 150 rpm. Then a transition step, in which the first temperature (T1) is increased until 40° C. (second temperature) at a temperature increasing rate of 5° C./minute, is carried out. Then a second reaction step, with the second temperature (T2) maintained at 40° C. and a second reaction time (t2) of 10 hours, is carried out to complete the condensation polymerization of the tetraethoxysilane in the silicon-containing component, so that a particulate dispersion is obtained.

The other conditions for preparation of External Additive 9 may include a first accumulated heat (Q1) of 20° C.·hour, which is the integrated value of the first temperature (T1) and the first reaction time (t1), and a second accumulated heat (Q2) of 400° C.·hour, which is the integrated value of the second temperature (T2) and the second reaction time (t2). Total reaction time (t1+t2) may be 12 hours.

Subsequently, 100 parts by weight of distilled water is added into the particulate dispersion formed by the particulate forming process and heated and concentrated until the liquid amount is decreased by half, and then the concentrated solution is solid-liquid separated by a centrifugal settler. The supernatant is removed by decantation, and then 300 parts by weight of distilled water is added to the precipitate and is liquid-solid separated by a centrifugal settler, as before. Subsequently, the step is repeated for two times, and the precipitate is lyophilized for 24 hours to provide a white powder.

Subsequently, 10 parts by weight of the white powder is mixed with 200 parts by weight of water and 5 parts by weight of hexamethyldisilazane (HMDS) and is stirred at 150 rpm at room temperature (25° C.) for 30 minutes under standard pressure (760 mmHg) in the reaction vessel and stirred at 60° C. for 4 hour at 150 rpm, and then a solid-liquid separation is performed in accordance with the same procedure as in the particulate forming process. The precipitate is cleaned by methanol and dried at 80° C. for 48 hours to provide a white powder (External Additive 9) including a particulate of which the surface is hydrophobized.

Other details of the kinds and the amounts of raw materials for External Additive 9 and the process conditions are shown in the following Table 6.

<Evaluation of Properties and Sizes of Protruding Portion in External Additive 9>

The details of the properties of the obtained External Additive 9 and the size of protruding portion are shown in the following Table 7.

As shown in Table 7, the obtained External Additive 9 includes a particulate having the second shape and has an average particle diameter (D50) of 110 nm, a particle distribution (D90/D10) of 2.00, a true density of 1.97 g/cm$^3$, an average aspect ratio of 1.10, a first specific surface area ($\alpha$) of 38.4 m$^2$/g, a loss on heating 8.4 wt %, a hydrophobizing degree of 65 volume %, a nitrogen gas adsorption time on measuring the first specific surface area of 3 minutes 13 seconds, a nitrogen gas desorption time of 4 minutes 36 seconds, and a ratio of the adsorption time to the desorption time of 0.70.

The size of the protruding portion is measured by observing the same with a transmission electron microscope (TEM), the TEM image (magnification: 10000 times) of the External Additive 9 is binary-coded, and the approximate value of the size of protruding portion is obtained from the binary-coded image. The results are as follows:

The protruding portion has an average maximum length of 32 nm, a variation coefficient of the average maximum length of 17%, and a ratio of the average maximum length to the average particle diameter of 0.29.

The protruding portion has an average maximum height of 10 nm, a variation coefficient of the average maximum height of 24%, and a ratio of the average maximum height to the average particle diameter is 0.09.

The ratio of the average maximum length to the average maximum height is 0.31.

That is, it is confirmed that External Additive 9 has Property 1 to Property 5, Property 7 and Sizes 1 to 7 of the protruding portion.

Hereinafter, a toner mother particle, to which the obtained External Additive 9 will be added, is prepared as follows:

Preparation of Resin 3

Resin 3, which is a raw material for preparing the toner mother particle, is prepared as follows:

10800 g of propylene oxide addition product of bisphenol A (average addition molar number: 2.2 moles), 4300 g of ethylene oxide addition product of bisphenol A (average addition molar number: 2.0 moles), 5040 g of terephthalic acid, and 700 g of n-dodecenyl succinic anhydride are introduced into a reaction vessel mounted with a Dean-Stark trap, and stirred at 230° C. under a nitrogen atmosphere. At the time point when water generated by the reaction is not flowed out is confirmed by when the liquid amount gathered in the trap is not increased, 2112 g of anhydrous trimellitic acid is added to the reaction and reacted until a softening point of 148° C. to provide Resin 3. The obtained Resin 3 is designated as "polyester C".

The resin polyester C may have a softening point of 148° C., a glass transition point of 74° C., a maximum peak temperature of fusion heat of 81° C., an acid value of 27 mgKOH/g, and a hydroxyl value of 29 mgKOH/g.

Preparation of Resin 4

Resin 4, a raw material for preparing the toner mother particle, is prepared as follows:

12250 g of propylene oxide addition product of bisphenol A (average addition molar number: 2.2 moles), 21125 g of ethylene oxide addition product of bisphenol A (average addition molar number: 2.0 moles), 14940 g of terephthalic acid, and 15 g of dibutyltin oxide are introduced into a reaction vessel, and stirred at 230° C. under a nitrogen atmosphere and reacted until a softening point of 120° C. is reached to provide Resin 4.

The obtained Resin 4 is designated as "polyester D".

The resin polyester D is measured after the reaction and may have a softening point of 119° C., a glass transition point of 64° C., a maximum peak temperature of fusion heat of 69° C., an acid value of 3.4 mgKOH/g, and a hydroxyl value of 23.2 mgKOH/g.

Preparation of Toner Mother Particle 2

Toner Mother Particle 2 is prepared using Resin 3 (polyester C) and Resin 4 (polyester D) as follows:

2880 g of polyester A, 4320 g of polyester B, 300 g of Pigment Blue 15:3 (manufactured by Daiichi Seika Industries), 86.5 g of charge control agent LR-147 (manufactured by Nippon Carlit), and 504 g of carnauba wax (manufactured by Kato Yoko, melting point: 83° C.) as a hydroxyl ester-containing release agent are introduced into a Henshel Mixer and stirred and mixed at 3000 rpm for 15 minutes to provide a mixture. The mixture is fused and kneaded using an open roll-type continuous kneader to provide a kneaded product. The open roll-type continuous kneader used has a roll exterior diameter of 0.14 m, an effective roll length of 0.8 m, and sets the operation conditions of a rotation speed of 33 m/minute in a heating roll (front roll) and a rotation speed of 11 m/minute in a cooling roll (back roll), and a roll gap of 0.1 mm. The temperatures of heating and cooling media in the roll are set as the temperature of the inlet for inputting a raw material at 150° C. and the temperature of discharging the kneaded product at 115° C. in the heating roll; and as the temperature of inputting a raw material at 35° C. and the temperature of discharging the kneaded product at 30° C. in the cooling roll.

The kneaded product is coarsely ground by a roter brake, and the coarse ground material is pulverized and fractured by a breaker disc-type grinder (IDS-2 series, manufactured by Nippon Pneumatic Kogkyo) and a dispersion separator to provide an untreated cyan toner particle (Toner Mother Particle 2) having a volume average particle diameter of about 7.8 μm. The volume average particle diameter may be measured using a particle distribution measuring device (MULTISIZER, manufactured by Beckman Coulter).

Preparation of Toner 9

To 150 parts by weight of Toner Mother Particle 2, 1.0 parts by weight of hydrophobic silica (TS720: manufactured by Cabot) having a small diameter of about 20 nm and which is hydrophobicized with hexamethyldisilazane (HMDS), and 0.4 parts by weight of External Additive 9 are added and mixed in a sample mill at 10,000 rpm for 30 seconds to provide a cyan toner (Toner 9).

<Evaluation of Toner 9>

The obtained Toner 9 is subjected to Evaluation 1, Evaluation 2, Evaluation 5, and Evaluation 6 to determine the characteristics thereof. The results are shown in Table 8. As shown in Table 8, Toner 9 is evaluated as 'A' for all 8 categories. Considering the criterion that an evaluation of 'A' refers to appropriately usable, Toner 9 may be used for a toner for developing excellent electrostatic image and having degradation resistance. The excellent properties of Toner 9 result from the properties of the particulate included in External Additive 9.

Experimental Example 10

Preparation of External Additive 10

External Additive 10 is prepared in accordance with the same procedure as in Experimental Example 9, except that the temperature increasing rate in the transition step is changed to 1° C./minute.

The other details of the kinds and the amounts of raw materials for External Additive 10 and the process conditions are shown in the following Table 6.

<Evaluation of Properties and Sizes of Protruding Portion in External Additive 10>

The details of the properties of the obtained External Additive 10 and the size of the protruding portion are shown in the following Table 7.

As shown in Table 7, the obtained External Additive 10 includes a particulate having the second shape and has an average particle diameter (D50) of 103 nm, a particle distribution (D90/D10) of 1.99, a true density of 1.96 g/cm$^3$, an average aspect ratio of 1.07, a first specific surface area ($\alpha$) of 38.6 m$^2$/g, a loss on heating of 7.0 wt %, a hydrophobizing degree of 63 volume %, a nitrogen gas adsorption time on measuring the first specific surface area of 3 minutes 14 seconds, a nitrogen gas desorption time of 4 minutes 19 seconds, and a ratio of the adsorption time to the desorption time of 0.75.

The size of the protruding portion is measured by observing the same by a transmission electron microscope (TEM), the TEM image (magnification: 10000 times) of External Additive 10 is binary-coded, and the approximate value of the size of protruding portion is obtained from the binary-coded image. The results are as follows.

The protruding portion has an average maximum length of 30 nm, a variation coefficient of the average maximum length of 20%, and a ratio of the average maximum length to the average particle diameter of 0.29.

The protruding portion has an average maximum height of 10 nm, a variation coefficient of the average maximum height of 23%, and a ratio of the average maximum height to the average particle diameter of 0.10.

The ratio of the average maximum length to the average maximum height is 0.33.

That is, it is confirmed that External Additive 10 has Property 1 to Property 5, Property 7 and Sizes 1 to 7 of the protruding portion as described above.

Experimental Example 11

Preparation of External Additive 11

External Additive 11 is prepared in accordance with the same procedure as in Experimental Example 9, except that the temperature increasing rate in the performing step is changed to 10° C./minute.

The other details of the kinds and the amounts of raw materials for External Additive 11 and the process conditions are shown in the following Table 6.

<Evaluation of Properties and Sizes of Protruding Portion in External Additive 11>

The details of the properties of the obtained External Additive 11 and the sizes of the protruding portion are shown in the following Table 7.

As shown in Table 7, the obtained External Additive 11 includes a particulate having the second shape and has an average particle diameter (D50) of 106 nm, a particle distribution (D90/D10) of 2.10, a true density of 1.98 g/cm$^3$, an average aspect ratio of 1.08, a first specific surface area ($\alpha$) of 37.4 m$^2$/g, a loss on heating 7.0 wt %, a hydrophobizing degree of 67 volume %, a nitrogen gas adsorption time on measuring the first specific surface area of 3 minutes 14 seconds, a nitrogen gas desorption time of 4 minutes 26 seconds, and a ratio of the adsorption time to the desorption time of 0.73.

The size of protruding portion is measured by observing the same with a transmission electron microscope (TEM), the TEM image (magnification: 10000 times) of External Additive 11 is binary-coded, and the approximate value of the size of the protruding portion on the surface of External Additive 11 is obtained from the binary-coded image. The results are as follows.

The protruding portion has an average maximum length of 31 nm, a variation coefficient of the average maximum length of 18%, and a ratio of the average maximum length to the average particle diameter of 0.29.

The protruding portion has an average maximum height of 11 nm, a variation coefficient of the average maximum height of 24%, and a ratio of the average maximum height to the average particle diameter of 0.10.

The ratio of the average maximum length to the average maximum height is 0.35.

That is, it is confirmed that External Additive 11 has Property 1 to Property 5, Property 7 and Sizes 1 to 7 of the protruding portion as described above.

Experimental Example 12

Preparation of External Additive 12

External Additive 12 is prepared in accordance with the same procedure as in Experimental Example 9, except that the conditions are changed as follows:

While preparing the mixed solution, the temperature (TA) of the silicon-containing component on mixing is changed to 2° C.

The temperature (TB) of the catalyst-containing component on mixing is changed to 50° C.

As the temperatures are changed as above, TB−TA is changed to 48° C.

In the first reaction step, the first temperature (T1) is changed to 11.6° C.; and the first accumulated heat (Q1), which is the integrated value of the first temperature (T1) and the first reaction time (t1), is changed to 23.2° C.·hour.

As the first temperature (T1) is changed as in above, T2−T1 is changed to 28.4° C.

The other details of the kinds and the amounts of raw materials for External Additive 12 and the process conditions are shown in the following Table 6.

<Evaluation of Properties and Sizes of Protruding Portion in External Additive 12>

The details of the properties of the obtained External Additive 12 and the sizes of the protruding portion are shown in the following Table 7.

As shown in Table 7, the obtained External Additive 12 includes a particulate having the second shape and has an average particle diameter (D50) of 130 nm, a particle distribution (D90/D10) of 2.02, a true density of 1.94 g/cm$^3$, an average aspect ratio of 1.15, a first specific surface area ($\alpha$) of 30.7 m$^2$/g, a loss on heating of 10.0 wt %, a hydrophobizing degree of 58 volume %, a nitrogen gas adsorption time on measuring the first specific surface area of 3 minutes 03 seconds, a nitrogen gas desorption time of 4 minutes 01 seconds, and a ratio of the adsorption time to the desorption time of 0.76.

The size of the protruding portion is measured by observing the same by a transmission electron microscope (TEM), the TEM image (magnification: 10000 times) of External Additive 12 is binary-coded, and the approximate value of the size of the protruding portion on the surface of External Additive 12 is obtained from the binary-coded image. The results are as follows.

The protruding portion has an average maximum length of 33 nm, a variation coefficient of the average maximum length of 20%, and a ratio of the average maximum length to the average particle diameter of 0.25.

The protruding portion has an average maximum height of 12 nm, a variation coefficient of the average maximum height of 25%, and a ratio of the average maximum height to the average particle diameter of 0.09.

The ratio of the average maximum length to the average maximum height is 0.36.

That is, it is confirmed that External Additive 12 has Property 1 to Property 5, Property 7 and Sizes 1 to 7 of the protruding portion as described above.

Experimental Example 13

Preparation of External Additive 13

External Additive 13 is prepared in accordance with the same procedure as in Experimental Example 9, except that the conditions are changed as follows:

In the mixed solution preparing process, the temperature (TA) of the silicon-containing component on mixing is changed to 10° C.

The temperature (TB) of the catalyst-containing component on mixing is changed to 20° C.

As the temperatures are changed, TB−TA is changed to 10° C.

In the first reaction step, the first temperature (T1) is changed to 12° C.; and the first accumulated heat (Q1), which is the integrated value of the first temperature (T1) and the first reaction time (t1), is changed to 24° C.·hour.

As the first temperature (T1) is changed as in above, T2−T1 is changed to 28° C.

The other details of the kinds and the amounts of raw materials for External Additive 13 and the process conditions are shown in the following Table 6.

<Evaluation of Properties and Sizes of Protruding Portion in External Additive 13>

The details of the properties of the obtained External Additive 13 and the size of the protruding portion are shown in the following Table 7.

As shown in Table 7, the obtained External Additive 13 includes a particulate having the second shape and has an average particle diameter (D50) of 109 nm, a particle distribution (D90/D10) of 2.05, a true density of 2.00 g/cm$^3$, an average aspect ratio of 1.10, a first specific surface area (α) of 35.2 m$^2$/g, a loss on heating of 3.0 wt %, a hydrophobizing degree of 62 volume %, a nitrogen gas adsorption time on measuring the first specific surface area of 3 minutes 14 seconds, a nitrogen gas desorption time of 4 minutes 09 seconds, and a ratio of the adsorption time to the desorption time of 0.78.

The size of the protruding portion is measured by observing the same by a transmission electron microscope (TEM), the TEM image (magnification: 10000 times) of External Additive 13 is binary-coded, and the approximate value of the size of the protruding portion on the surface of External Additive 13 is obtained from the binary-coded image. The results are as follows.

The protruding portion has an average maximum length of 30 nm, a variation coefficient of the average maximum length of 23%, and a ratio of the average maximum length to the average particle diameter of 0.28.

The protruding portion has an average maximum height of 10 nm, a variation coefficient of the average maximum height of 23%, and a ratio of the average maximum height to the average particle diameter of 0.09.

The ratio of the average maximum length to the average maximum height is 0.33.

That is, it is confirmed that External Additive 13 has Property 1 to Property 5, Property 7 and Sizes 1 to 7 of the protruding portion as described above.

Experimental Example 14

Preparation of External Additive 14

External Additive 14 is prepared in accordance with the same procedure as in Experimental Example 9, except that the conditions are changed as follows: The temperature (TA) on mixing the silicon-containing component is changed to 2° C.

The temperature (TB) of the catalyst-containing component on mixing is changed to 20° C.

As the temperatures are changed, TB−TA is changed to 18° C.

In the first reaction step, the first temperature (T1) is changed to 5.6° C.; and the first accumulated heat (Q1), which is the integrated value of the first temperature (T1) and the first reaction time (t1), is changed to 11.2° C.·hour.

In the second reaction step, the second reaction temperature (T2) is changed to 30° C., and the second accumulated heat (Q2), which is the integrated value of the second temperature (T2) and the second reaction time (t2), is changed to 300° C.·hour.

As each of the first temperature (T1) and the second temperature (T2) is changed as in above, T2−T1 is changed to 24.4° C.

The other details of the kinds and the amounts of raw materials for External Additive 14 and the process conditions are shown in the following Table 6.

<Evaluation of Properties and Sizes of Protruding Portion in External Additive 14>

The details of the properties of the obtained External Additive 14 and the size of the protruding portion are shown in the following Table 7.

As shown in Table 7, the obtained External Additive 14 includes a particulate having the second shape and has an average particle diameter (D50) of 130 nm, a particle distribution (D90/D10) of 2.02, a true density of 1.94 g/cm$^3$, an average aspect ratio of 1.16, a first specific surface area (α) of 28.8 m$^2$/g, a loss on heating of 9.0 wt %, a hydrophobizing degree of 65 volume %, a nitrogen gas adsorption time on measuring the first specific surface area of 3 minutes 06 seconds, a nitrogen gas desorption time of 3 minutes 53 seconds, and a ratio of the adsorption time to the desorption time of 0.8.

The size of the protruding portion is measured by observing the same by a transmission electron microscope (TEM), the TEM image (magnification: 10000 times) of External Additive 14 is binary-coded, and the approximate value of the size of the protruding portion on the surface of External Additive 14 is obtained from the binary-coded image. The results are as follows.

The protruding portion has an average maximum length of 29 nm, a variation coefficient of the average maximum length of 21%, and a ratio of the average maximum length to the average particle diameter of 0.22.

The protruding portion has an average maximum height of 9 nm, a variation coefficient of the average maximum height of 23%, and a ratio of the average maximum height to the average particle diameter of 0.07.

The ratio of the average maximum length to the average maximum height is 0.31.

That is, it is confirmed that External Additive 14 has Property 1 to Property 5, Property 7 and Sizes 1 to 7 of the protruding portion as described above.

Experimental Example 15

Preparation of External Additive 15

External Additive 15 is prepared in accordance with the same procedure as in Experimental Example 9, except that the conditions are changed as follows:

While preparing the mixed solution, the temperature (TA) on mixing the silicon-containing component is changed to 10° C.

The temperature (TB) of the catalyst-containing component on mixing is changed to 35° C.

In the first reaction step, the first temperature (T1) is changed to 15° C.; and the first accumulated heat (Q1), which is the integrated value of the first temperature (T1) and the first reaction time (t1), is changed to 30° C.·hour.

In the second reaction step, the second reaction temperature (T2) is changed to 50° C., and the second accumulated heat (Q2), which is the integrated value of the second temperature (T2) and the second reaction time (t2), is changed to 500° C.·hour.

As each of the first temperature (T1) and the second temperature (T2) is changed as above, T2−T1 is changed to 35° C.

The other details of the kinds and the amounts of raw materials for External Additive 15 and the process conditions are shown in the following Table 6.

<Evaluation of Properties and Sizes of Protruding Portion in External Additive 15>

The details of the properties of the obtained External Additive 15 and the size of the protruding portion are shown in the following Table 7.

As shown in Table 7, the obtained External Additive 15 includes a particulate having the second shape and has an average particle diameter (D50) of 103 nm, a particle distribution (D90/D10) of 2.02, a true density of 1.94 g/cm$^3$, an average aspect ratio of 1.09, a first specific surface area ($\alpha$) of 36.8 m$^2$/g, a loss on heating of 3.0 wt %, a hydrophobizing degree of 61 volume %, a nitrogen gas adsorption time on measuring the first specific surface area of 3 minutes 20 seconds, a nitrogen gas desorption time of 4 minutes 04 seconds, and a ratio of the adsorption time to the desorption time of 0.82.

The size of the protruding portion is measured by observing the same by a transmission electron microscope (TEM), the TEM image (magnification: 10000 times) of External Additive 15 is binary-coded, and the approximate value of the size of the protruding portion on the surface of External Additive 15 is obtained from the binary-coded image. The results are as follows.

The protruding portion has an average maximum length of 30 nm, a variation coefficient of the average maximum length of 23%, and a ratio of the average maximum length to the average particle diameter of 0.29.

The protruding portion has an average maximum height of 10 nm, a variation coefficient of the average maximum height of 23%, and a ratio of the average maximum height to the average particle diameter of 0.10.

The ratio of the average maximum length to the average maximum height is 0.33.

That is, it is confirmed that External Additive 15 has Property 1 to Property 5, Property 7 and Sizes 1 to 7 of the protruding portion, as described above.

Experimental Example 16

Preparation of External Additive 16

External Additive 16 is prepared in accordance with the same procedure as in Experimental Example 9, except that the conditions are changed as follows:

In the first reaction step, the first reaction time (t1) is changed to 3 hours; and the first accumulated heat (Q1), which is the integrated value of the first temperature (T1) and the first reaction time (t1), is changed to 30° C.·hour.

In the second reaction step, the second reaction time (t2) is changed to 5 hours, and the second accumulated heat (Q2), which is the integrated value of the second temperature (T2) and the second reaction time (t2), is changed to 200° C.·hour.

As each of the first reaction time (t1) and the second reaction time (t2) is changed, t1+t2 is changed to 8 hours.

The other details of the kinds and the amounts of raw materials for External Additive 16 and the process conditions are shown in the following Table 6.

<Evaluation of Properties and Sizes of Protruding Portion in External Additive 16>

The details of the properties of the obtained External Additive 16 and the size of the protruding portion are shown in the following Table 7.

As shown in Table 7, the obtained External Additive 16 includes a particulate having the second shape and has an average particle diameter (D50) of 110 nm, a particle distribution (D90/D10) of 2.02, a true density of 1.97 g/cm$^3$, an average aspect ratio of 1.10, a first specific surface area ($\alpha$) of 32.0 m$^2$/g, a loss on heating of 6.0 wt %, a hydrophobizing degree of 57 volume %, a nitrogen gas adsorption time on measuring the first specific surface area of 3 minutes 14 seconds, a nitrogen gas desorption time of 3 minutes 54 seconds, and a ratio of the adsorption time to the desorption time of 0.83.

The size of the protruding portion is measured by observing the same by a transmission electron microscope (TEM), the TEM image (magnification: 10000 times) of External Additive 16 is binary-coded, and the approximate value of the size of the protruding portion on the surface of External Additive 16 is obtained from the binary-coded image. The results are as follows.

The protruding portion has an average maximum length of 27 nm, a variation coefficient of the average maximum length of 32%, and a ratio of the average maximum length to the average particle diameter of 0.25.

The protruding portion has an average maximum height of 8 nm, a variation coefficient of the average maximum height of 22%, and a ratio of the average maximum height to the average particle diameter of 0.07.

The ratio of the average maximum length to the average maximum height is 0.30.

That is, it is confirmed that External Additive 16 has Property 1 to Property 5, Property 7 and Sizes 1 to 7 of the protruding portion, as described above.

Experimental Example 17

Preparation of External Additive 17

External Additive 17 is prepared in accordance with the same procedure as in Experimental Example 9, except that the conditions are changed as follows:

In the first reaction step, the first time (t1) is changed to 0.5 hours; and the first accumulated heat (Q1), which is the integrated value of the first temperature (T1) and the first reaction time (t1), is changed to 5° C.·hour.

In the second reaction step, the second temperature (T2) is changed to 45° C.; the second reaction time (t2) is changed to 11 hours; so the second accumulated heat (Q2), which is the integrated value of the second temperature (T2) and the second reaction time (t2), is changed to 495° C.·hour.

As the second temperature (T2) is changed as above, T2−T1 is changed to 35° C.

The other details of the kinds and the amounts of raw materials for External Additive 17 and the process conditions are shown in the following Table 6.

<Evaluation of Properties and Sizes of Protruding Portion in External Additive 17>

The details of the properties of the obtained External Additive 17 and the size of the protruding portion are shown in the following Table 7.

As shown in Table 7, the obtained External Additive 17 includes a particulate having the second shape and has an average particle diameter (D50) of 112 nm, a particle distribution (D90/D10) of 2.02, a true density of 1.95 g/cm$^3$, an average aspect ratio of 1.14, a first specific surface area ($\alpha$) of 31.9 m$^2$/g, a loss on heating of 6.0 wt %, a hydrophobizing degree of 59 volume %, a nitrogen gas adsorption time on measuring the first specific surface area of 3 minutes 14 seconds, a nitrogen gas desorption time of 3 minutes 57 seconds, and a ratio of the adsorption time to the desorption time of 0.82.

The size of the protruding portion is measured by observing the same by a transmission electron microscope (TEM), the TEM image (magnification: 10000 times) of External Additive 17 is binary-coded, and the approximate value of the size of the protruding portion on the surface of External Additive 17 is obtained from the binary-coded image. The results are as follows.

The protruding portion has an average maximum length of 26 nm, a variation coefficient of the average maximum length of 31%, and a ratio of the average maximum length to the average particle diameter of 0.23.

The protruding portion has an average maximum height of 7 nm, a variation coefficient of the average maximum height of 23%, and a ratio of the average maximum height to the average particle diameter of 0.06.

The ratio of the average maximum length to the average maximum height is 0.27.

That is, it is confirmed that External Additive 17 has Property 1 to Property 5, Property 7 and Sizes 1 to 7 of the protruding portion, as described above.

Preparation of Toners 10 to 17

Toners 10 to 17 are prepared in accordance with the same procedure as for Toner 9, except that the external additive is changed to each of External Additives 10 to 17, respectively.

<Evaluation of Toners 10 to 17>

Toners 10 to 17 are evaluated in accordance with the same method as for Toner 9, and the results are shown in the following Table 8.

Toners 10 and 11 are both evaluated as 'A' for 7 categories out of all 8 categories, and are evaluated as 'B' for the last one category (image concentration under high temperature/high humidity). Accordingly, both toners 10 and 11 are appropriately usable.

Toners 12 and 13 are both evaluated as 'A' for 6 categories out of all 8 categories, and are evaluated as 'B' for the other two categories (image concentration and fogging under high temperature/high humidity). Accordingly, both toners 12 and 13 are appropriately usable.

Toners 14 and 15 are evaluated as 'A' for 4 categories out of all 8 categories, and are evaluated as 'B' for the other 4 categories (fogging under low temperature/low humidity, image concentration and fogging under high temperature/high humidity, and filming resistance under 3 atmospheres (low temperature/low humidity, room temperature/room humidity, high temperature/high humidity)). Accordingly, Toners 14 and 15 shows no disruptive influence on their use and are appropriately useable.

Toner 16 is evaluated as 'A' for 4 categories out of all 8 categories, and is evaluated as 'B' for the other 4 categories (image concentration and fogging under high temperature/high humidity and halftone fading and filming resistance under 3 atmospheres). Accordingly, Toner 16 shows no disruptive influence on its use and is appropriately useable.

Toner 17 is evaluated as 'A' for 2 categories out of all 8 categories, and is evaluated as 'B' for the other 6 categories (fogging under low temperature/low humidity, fogging under room temperature/room humidity, image concentration and fogging under high temperature/high humidity, and halftone fading and filming resistance under 3 atmospheres). Accordingly, Toner 17 shows no disruptive influence on its use and is appropriately useable.

Comparative Example 7

Preparation of Comparative External Additive 7

40 parts by weight of tetraethoxysilane, 127 parts by weight of ethanol and 40 parts by weight of distilled water are input into a reaction vessel under a nitrogen atmosphere, and the temperature is controlled at 65° C. Then, 44 parts by weight of 0.25 wt % ammonia water is added using a drip funnel for 12 hours and mixed by stirring at a stir speed of 150 rpm to carry out the condensation polymerization of the tetraethoxysilane in the mixed solution.

Then the non-reacted tetraethoxysilane, ethanol, ammonia are removed from the mixed solution using an ultrafiltration membrane to provide a dispersion having a solid concentration of 4.6 mass %.

Then ammonia water is added to the dispersion to adjust the pH of the dispersion to 11.5.

Subsequently, the dispersion is controlled at 65° C. and then 3.8 parts by weight of 20 wt % methyltrimethoxysilane-ethanol solution and added and reacted for 2 hours.

The reaction solution is further reacted by continuously adding a mixture of 68 parts by weight of tetraethoxysilane and 29 parts by weight of 5 wt % ammonia solution over 6 hours to provide a dispersion including a particulate.

100 parts by weight of distilled water is added to the obtained particulate dispersion, which is then heated and concentrated using an evaporator until the liquid amount is decreased by half. Then the product is solid-liquid separated by a centrifugal settler. The supernatant is removed by decantation and then 300 parts by weight of distilled water is added, followed by a solid-liquid separation in accordance with the same method as in above.

This step is repeated 3 times, and then the precipitate is lyophilized for 24 hours to provide a white powder.

10 parts by weight of the white powder is added to a mixture of 200 parts by weight of water and 5 parts by weight of hexamethyldisilazane (HMDS) and stirred at room temperature (25° C.) for 30 minutes, then stirred at 60° C. for 4 hours, and then a solid-liquid separation is performed. The powder obtained thereby is dried for 48 hours to provide a white powder (Comparative External Additive 7).

<Evaluation of Properties and Sizes of Protruding Portion in Comparative External Additive 7>

The details of the properties of the obtained Comparative External Additive 7 and the sizes of the protruding portion are shown in the following Table 7.

As shown in Table 7, the obtained Comparative External Additive 7 includes a particulate having the second shape and has an average particle diameter (D50) of 120 nm, a particle distribution (D90/D10) of 2.21, a true density of 2.10 g/cm$^3$, an average aspect ratio of 1.10, a first specific surface area ($\alpha$) of 26.8 m$^2$/g, a loss on heating of 5.0 wt %, a hydrophobizing degree of 68 volume %, a nitrogen gas adsorption time on measuring the first specific surface area of 2 minutes 45 seconds, a nitrogen gas desorption time of 3 minutes 16 seconds, and a ratio of the adsorption time to the desorption time of 1.21.

The size of the protruding portion is measured by observing the same by a transmission electron microscope (TEM), the TEM image (magnification: 10000 times) of Comparative External Additive 7 is binary-coded, and the approximate value of the size of the protruding portion on the surface of Comparative External Additive 7 is obtained from the binary-coded image. The results are as follows.

The protruding portion has an average maximum length of 12 nm, a variation coefficient of the average maximum length of 11%, and a ratio of the average maximum length to the average particle diameter of 0.10.

The protruding portion has an average maximum height of 4 nm, a variation coefficient of the average maximum height of 16%, and a ratio of the average maximum height to the average particle diameter of 0.03.

The ratio of the average maximum length to the average maximum height is 0.33.

It is confirmed that Comparative External Additive 7 does not satisfy the conditions of the true density, the gas adsorption time, the ratio of adsorption time to gas desorption time, and the protruding portion does not satisfy the conditions of the average maximum length of protruding portion to the average particle diameter, the average maximum height, the variation coefficient of the average maximum height, and the average maximum height of protruding portion to the average particle diameter.

The reasons why Comparative External Additive 7 does not satisfy the desired properties and sizes of the protruding portion are considered to be because the mother particle is formed by a tetrafunctional silane compound (tetraethoxysilane), and the protruding portion is formed by a trifunctional silane compound (methyl trimethoxysilane), under process conditions that differ from that for preparing an external additive according to one embodiment as disclosed herein.

Comparative External Additive 7 according to Comparative Example 7 is prepared according to 'Preparation Example 1 of silica particulate having a certain shape' disclosed in Paragraphs [0087] to [0089] of Japanese Patent Laid-open Publication No. 2013-137508.

Comparative Example 8

Preparation of Comparative External Additive 8

Comparative External Additive 8 is prepared in accordance with the same procedure as in Experimental Example 9, except that the conditions are changed as follows.

During the mixed solution preparing process, the temperature (TA) of the silicon-containing component on mixing is changed to 15° C.

The temperature (TB) of the catalyst-containing component on mixing is changed to 60° C.

As the temperatures are changed, TB−TA is changed to 45° C.

In the first reaction step, the first temperature (T1) is changed to 24° C.; the first reaction time (t1) is changed to 1 hour; and the first accumulated heat (Q1), which is the integrated value of the first temperature (T1) and the first reaction time (t1), is changed to 24° C.·hour.

As the first temperature (T1) is changed as above, T2−T1 is changed to 16° C.

The other details of the kinds and the amounts of raw materials for Comparative External Additive 8 and the process conditions are shown in the following Table 6.

<Evaluation of Properties and Sizes of Protruding Portion in Comparative External Additive 8>

The details of the properties of the obtained Comparative External Additive 8 and the sizes of the protruding portion are shown in the following Table 7.

As shown in Table 7, the obtained Comparative External Additive 8 includes a particulate having the second shape and has an average particle diameter (D50) of 40 nm, a particle distribution (D90/D10) of 2.30, a true density of 1.94 g/cm$^3$, an average aspect ratio of 1.02, a first specific surface area ($\alpha$) of 83.5 m$^2$/g, a loss on heating of 12.0 wt %, a hydrophobizing degree of 50 volume %, a nitrogen gas adsorption time on measuring the first specific surface area of 2 minutes 50 seconds, a nitrogen gas desorption time of 2 minutes 15 seconds, and a ratio of the adsorption time to the desorption time of 1.26.

The size of the protruding portion is measured by observing the same by a transmission electron microscope (TEM), the TEM image (magnification: 10000 times) of Comparative External Additive 8 is binary-coded, and the approximate value of the size of the protruding portion on the surface of Comparative External Additive 8 is obtained from the binary-coded image. The results are as follows.

The protruding portion has an average maximum length of 6 nm, a variation coefficient of the average maximum length of 10%, and a ratio of the average maximum length to the average particle diameter of 0.15.

The protruding portion has an average maximum height of 2 nm, a variation coefficient of the average maximum height of 15%, and a ratio of the average maximum height to the average particle diameter of 0.05.

The ratio of the average maximum length to the average maximum height is 0.33.

It is confirmed that Comparative External Additive 8 does not satisfy the desired conditions of the average particle diameter, the loss on heating, the gas adsorption time, the ratio of adsorption time to the gas desorption time, and the protruding portion does not satisfy the desired conditions of the average maximum length, the average maximum height, and the ratio of the average maximum height to the average maximum length.

The reason why Comparative External Additive 8 does not satisfy the desired properties and sizes of the protruding portion is considered to be because process conditions that differ from those for preparing an external additive according to one embodiment as disclosed herein are used: the temperature (TA) of the silicon-containing component on mixings is 15° C., which does not satisfy the relationship 0° C.≤TA≤10° C. set by one embodiment; and the temperature (TB) of the catalyst-containing component on mixing is 60° C., which does not satisfy 20° C.≤TB≤50° C. set by one embodiment; and the first temperature (T1) in the first reaction step is 24° C., which does not satisfy 5° C.≤T1≤15° C. set by one embodiment.

Comparative Example 9

Preparation of Comparative External Additive 9

Comparative External Additive 9 is prepared in accordance with the same procedure as in Experimental Example 9, except that the conditions are changed as follows.

While preparing the mixed solution, the temperature (TA) of the silicon-containing component on mixing is changed to 0° C.

The temperature (TB) of the catalyst-containing component on mixing is changed to 15° C.

As the temperatures are changed, TB−TA is changed to 15° C.

In the first reaction step, the first temperature (T1) is changed to 3° C.; the first reaction time (t1) is changed to 1 hour; and the first accumulated heat (Q1), which is the integrated value of the first temperature (T1) and the first reaction time (t1), is changed to 3° C.·hour.

As the first temperature (T1) is changed, T2−T1 is changed to 37° C. The other details of the kinds and the amounts of raw materials for Comparative External Additive 9 and the process conditions are shown in the following Table 6.

<Evaluation of Properties and Sizes of Protruding Portion in Comparative External Additive 9>

The details of the properties of the obtained Comparative External Additive 9 and the sizes of the protruding portion are shown in the following Table 7.

As shown in Table 7, the obtained Comparative External Additive 9 includes a particulate having the second shape and has an average particle diameter (D50) of 230 nm, a particle distribution (D90/D10) of 2.15, a true density of 2.00 g/cm$^3$, an average aspect ratio of 1.26, a first specific surface area ($\alpha$) of 14.0 m$^2$/g, a loss on heating of 7.0 wt %, a hydrophobizing degree of 43 volume %, a nitrogen gas adsorption time on measuring the first specific surface area of 1 minute 45 seconds, a nitrogen gas desorption time of 1 minute 22 seconds, and a ratio of the adsorption time to the desorption time of 1.28.

The size of the protruding portion is measured by observing the same by a transmission electron microscope (TEM), the TEM image (magnification: 10000 times) of Comparative External Additive 9 is binary-coded, and the approximate value of the size of the protruding portion on the surface of Comparative External Additive 9 is obtained from the binary-coded image. The results are as follows.

The protruding portion has an average maximum length of 48 nm, a variation coefficient of the average maximum length of 53%, and a ratio of the average maximum length to the average particle diameter of 0.21.

The protruding portion has an average maximum height of 5 nm, a variation coefficient of the average maximum height of 16%, and a ratio of the average maximum height to the average particle diameter of 0.02.

The ratio of the average maximum length to the average maximum height is 0.10.

It is understood that Comparative External Additive 9 does not satisfy the conditions of the average particle diameter, the average aspect ratio, the first specific area, the gas adsorption time, the ratio of absorption time to the gas desorption time; and the protruding portion does not satisfy the conditions of the average maximum length, the variation coefficient of average maximum length, the variation coefficient of average maximum height, the average maximum height to the average particle diameter, and the ratio of average maximum height to average maximum length.

The reasons why Comparative External Additive 9 does not satisfy the properties and the sizes of protruding portion are considered to be because the temperature (TB) of the catalyst-containing component on mixing is 15° C., which does not satisfy 20° C.≤TB≤50° C. set by one embodiment; the first temperature (T1) is 3° C., which does not satisfy 5° C.≤T1≤15° C. set by one embodiment; and the first accumulated heat (Q1), which is the integrated value of the first liquid temperature (T1) and the first reaction time (t1), is 3° C.·hour which does not satisfy 5° C.·hour≤Q1≥30° C.·hour set by one embodiment. Thus process conditions are used which are different from the process conditions of the external additive according to one embodiment disclosed herein.

Comparative Example 10

Preparation of Comparative External Additive 10

Comparative External Additive 10 is prepared in accordance with the same procedure as in Experimental Example 9, except that the conditions are changed as follows.

In the mixed solution preparing process, the temperature (TB) of the catalyst-containing component on mixing are changed to 60° C.

As the temperature is changed, TB−TA is changed to 55° C.

In the first reaction step, the first temperature (T1) is changed to 16° C.; the first reaction time (t1) is changed to 1 hour; and the first accumulated heat (Q1), which is the integrated value of the first temperature (T1) and the first reaction time (t1), is changed to 16° C.·hour.

In the second reaction step, the second temperature (T2) is changed to 70° C., the second reaction time (t2) is changed to 7 hours, and the second accumulated heat (Q2), which is the integrated value of the second temperature (T2) and the second reaction time (t2), is changed to 490° C.·hour.

As the first temperature (T1) and the second temperature (T2) are changed, T2−T1 is changed to 54° C.

The other details of the kinds and the amounts of raw materials for Comparative External Additive 10 and the process conditions are shown in the following Table 6.

<Evaluation of Properties and Sizes of Protruding Portion in Comparative External Additive 10>

The details of the properties of the obtained Comparative External Additive 10 and the size of the protruding portion are shown in the following Table 7.

As shown in Table 7, the obtained Comparative External Additive 10 includes a particulate having the second shape and has an average particle diameter (D50) of 60 nm, a particle distribution (D90/D10) of 2.00, a true density of 2.15 g/cm$^3$, an average aspect ratio of 1.02, a first specific surface area ($\alpha$) of 49.3 m$^2$/g, a loss on heating of 1.0 wt %, a hydrophobizing degree of 55 volume %, a nitrogen gas adsorption time on measuring the first specific surface area of 2 minutes 24 seconds, a nitrogen gas desorption time of 1 minutes 49 seconds, and a ratio of the adsorption time to the desorption time of 1.32.

The size of the protruding portion is measured by observing the same by a transmission electron microscope (TEM), the TEM image (magnification: 10000 times) of Comparative External Additive 10 is binary-coded, and the approximate value of the size of protruding portion on the surface of Comparative External Additive 10 is obtained from the binary-coded image. The results are as follows.

The protruding portion has an average maximum length of 42 nm, a variation coefficient of the average maximum length of 45%, and a ratio of the average maximum length to the average particle diameter of 0.70.

The protruding portion has an average maximum height of 3 nm, a variation coefficient of the average maximum height of 15%, and a ratio of the average maximum height to the average particle diameter of 0.05.

The ratio of the average maximum length to the average maximum height is 0.07.

It is understood that Comparative External Additive 10 does not satisfy the conditions of the average particle diameter, the true density, the loss on heating, the gas adsorption time, the ratio of absorption time to the gas desorption time; and the protruding portion does not satisfy the conditions of the variation coefficient of average maximum length, the average maximum length to the average particle diameter, the average maximum height, the variation coefficient of average maximum height, the average maximum height to the average particle diameter, and the ratio of average maximum height to average maximum length.

The reasons why Comparative External Additive 10 does not satisfy the properties and the sizes of protruding portion are considered to be because the temperature (TB) of the catalyst-containing component on mixing is 60° C., which does not satisfy 20° C.≤TB≤50° C. set by one embodiment, and TB−TA is 55° C., which does not satisfy 10° C.≤TB−TA≤50° C. set by one embodiment; the first temperature (T1) is 16° C. which does not satisfy 5° C.≤T1≤15° C. set by one embodiment; the second temperature (T2) is 70° C., which does not satisfy 30° C.≤T2≤50° C. set by one embodiment, and T2−T1 is 54° C., which does not satisfy 15° C.≤T2−T1≤45° C. set by one embodiment. Thus process conditions are used which are different from the process conditions for preparing the external additive according to one embodiment.

Comparative Example 11

Preparation of Comparative External Additive 11

Comparative External Additive 11 is prepared in accordance with the same procedure as in Experimental Example 9, except that the conditions are changed as follows.

In the first reaction step, the first reaction time (t1) is changed to 5° C.; and the first accumulated heat (Q1), which is the integrated value of the first temperature (T1) and the first reaction time (t1), is changed to 50° C.·hour.

In the second reaction step, the second reaction time (t2) is changed to 15 hours, and the second accumulated heat (Q2), which is the integrated value of the second temperature (T2) and the second reaction time (t2), is changed to 600° C.·hour.

The other details of the kinds and the amounts of raw materials for Comparative External Additive 11 and the process conditions are shown in the following Table 6.

<Evaluation of Properties and Sizes of Protruding Portion in Comparative External Additive 11>

The details of the properties of the obtained Comparative External Additive 11 and the size of the protruding portion are shown in the following Table 7.

As shown in Table 7, the obtained Comparative External Additive 11 includes a particulate having the second shape and has an average particle diameter (D50) of 220 nm, a particle distribution (D90/D10) of 2.10, a true density of 2.10 g/cm$^3$, an average aspect ratio of 1.27, a first specific surface area (α) of 13.4 m$^2$/g, a loss on heating of 2.0 wt %, a hydrophobizing degree of 45 volume %, a nitrogen gas adsorption time on measuring the first specific surface area of 1 minute 53 seconds, a nitrogen gas desorption time of 1 minute 27 seconds, and a ratio of the adsorption time to the desorption time of 1.30.

The size of the protruding portion is measured by observing the same by a transmission electron microscope (TEM), the TEM image (magnification: 10000 times) of Comparative External Additive 11 is binary-coded, and the approximate value of the size of protruding portion on the surface of Comparative External Additive 11 is obtained from the binary-coded image. The results are as follows.

The protruding portion has an average maximum length of 51 nm, a variation coefficient of the average maximum length of 54%, and a ratio of the average maximum length to the average particle diameter of 0.23.

The protruding portion has an average maximum height of 8 nm, a variation coefficient of the average maximum height of 14%, and a ratio of the average maximum height to the average particle diameter of 0.04.

The ratio of the average maximum length to the average maximum height is 0.16.

It is understood that Comparative External Additive 11 does not satisfy the conditions of the average particle diameter, the true density, the average aspect ratio, the loss on heating, the specific surface area, the gas adsorption time, the ratio of absorption time to the gas desorption time, and the protruding portion does not satisfy the conditions of the average maximum length, the variation coefficient of average maximum length, the average maximum length to the average particle diameter, the variation coefficient of average maximum height, the average maximum height to the average particle diameter, the ratio of average maximum height to average maximum length.

The reasons why Comparative External Additive 11 does not satisfy the properties and the sizes of protruding portion are considered to be because the temperature (TB) of the catalyst-containing component on mixing is different from the process conditions for an external additive according to one embodiment; in that the first accumulated heat (Q1), which is integrated value of the first liquid temperature (T1) and the first reaction time (t1), is 50° C.·hour which does not satisfy 5° C.·hour≤Q1≤30° C.·hour set by one embodiment; and the second accumulated heat (Q2), which is integrated value of the second liquid temperature (T2) and the second reaction time (t2), is 600° C.·hour which does not satisfy 200° C.·hour≤Q2≤500° C.·hour set by one embodiment.

<Evaluation of Comparative Toners 7 to 11>

Comparative Toners 7 to 11 are evaluated for characteristics in accordance with the same methods as for Toner 9, the results are shown in the following Table 8.

As shown in Table 8, the evaluations for Comparative Toners 7 to 11 are as follows.

Comparative Toner 7 is evaluated as 'C' in one category (filming resistance under 3 atmospheres).

According to receiving the criterion of 'C', Comparative Toner 7 is unusable.

Comparative Toner 8 is evaluated as 'C' for two categories (image concentration under low temperature/low humidity, filming resistance under 3 atmospheres) and evaluated as 'D' for one category (fogging under low temperature/low humidity).

According to receiving the criterions of 'C' and 'D,' Comparative Toner 8 is unusable.

Comparative Toner 9 is evaluated as 'C' for 3 categories (image concentration under high temperature/high humidity, halftone fading and photoreceptor filming under 3 atmospheres) and evaluated as 'D' for one category (fogging under high temperature/high humidity).

According to receiving the criterions of 'C' and 'D,' Comparative Toner 9 is unusable.

Comparative Toner 10 is evaluated as 'C' for 3 categories (image concentration and fogging under high temperature/ high humidity, halftone fading under 3 atmospheres) and evaluated as 'D' for one category (filming resistance under 3 atmospheres).

According to receiving the criterions of 'C' and 'D,' Comparative Toner 10 is unusable.

Comparative Toner 11 is evaluated as 'C' for 4 categories (image concentration and fogging under low temperature/low humidity, image concentration and fogging under room temperature/room humidity) and evaluated as 'D' for 4 categories (image concentration and fogging under high temperature/high humidity, halftone fading and filming resistance under 3 atmospheres).

According to receiving the criterions of 'C' and 'D,' Comparative Toner 11 is unusable.

As shown in the evaluations, Comparative Toners 7 to 11 are all unusable and have inferior characteristics to those of Experimental Examples 9 to 17.

The difference in usability of the Experimental Example toners and Comparative toners is considered to result because External Additives 9 to 17, which are externally added to Toners 9 to 17, respectively, all satisfy Property 1 to Property 5, and Property 7 and Size 1 to 7 of the protruding portion, while on the other hand, Comparative Toners 7 to 11 do not satisfy these conditions of properties and sizes of the protruding portion.

TABLE 6

| | | Ex. 9 | Ex. 10 | Ex. 11 | Ex. 12 | Ex. 13 | Ex. 14 | Ex. 15 | Ex. 16 | Ex. 17 | Comp. Ex. 8 | Comp. Ex. 9 | Comp. Ex. 10 | Comp. Ex. 11 |
|---|---|---|---|---|---|---|---|---|---|---|---|---|---|---|
| Silicon-containing component | Ethanol (parts by weight) | 80 | 80 | 80 | 80 | 80 | 80 | 80 | 80 | 80 | 80 | 80 | 80 | 80 |
| | Acetonitrile (parts by weight) | 60 | 60 | 60 | 60 | 60 | 60 | 60 | 60 | 60 | 60 | 60 | 60 | 60 |
| | Tetraethoxy silane (parts by weight) | 40 | 40 | 40 | 40 | 40 | 40 | 40 | 40 | 40 | 40 | 40 | 40 | 40 |
| Catalyst-containing component | Water (parts by weight) | 40 | 40 | 40 | 40 | 40 | 40 | 40 | 40 | 40 | 40 | 40 | 40 | 40 |
| | Ammonia (parts by weight) | 5 | 5 | 5 | 5 | 5 | 5 | 5 | 5 | 5 | 5 | 5 | 5 | 5 |
| Preparation of mixed solution | Silicon-containing component temperature TA (° C.) | 5 | 5 | 5 | 2 | 10 | 2 | 10 | 5 | 5 | 15 | 0 | 5 | 5 |
| | Catalyst-containing component Temperature TB (° C.) | 30 | 30 | 30 | 50 | 20 | 20 | 35 | 30 | 30 | 60 | 15 | 60 | 30 |
| | TB − TA (° C.) | 25 | 25 | 25 | 48 | 10 | 18 | 25 | 25 | 25 | 45 | 15 | 55 | 25 |
| First reaction step | First temperature T1 (° C.) | 10 | 10 | 10 | 11.6 | 12 | 5.6 | 15 | 10 | 10 | 24 | 3 | 16 | 10 |
| | First reaction time t1 (time) | 2 | 2 | 2 | 2 | 2 | 2 | 2 | 3 | 0.5 | 1 | 1 | 1 | 5 |
| | Q1 (° C. · time) | 20 | 20 | 20 | 23.2 | 24 | 11.2 | 30 | 30 | 5 | 24 | 3 | 16 | 50 |
| Transition step | Temperature increasing rate (° C./min) | 5 | 1 | 10 | 5 | 5 | 5 | 5 | 5 | 5 | 15 | 5 | 5 | 5 |
| Second reaction step | Second temperature T2 (° C.) | 40 | 40 | 40 | 40 | 40 | 30 | 50 | 40 | 45 | 40 | 40 | 70 | 40 |
| | Second reaction time t2 (time) | 10 | 10 | 10 | 10 | 10 | 10 | 10 | 5 | 11 | 10 | 10 | 7 | 15 |
| | Q2 (° C. · time) | 400 | 400 | 400 | 400 | 400 | 300 | 500 | 200 | 495 | 400 | 400 | 490 | 600 |
| | T2 − T1 (° C.) | 30 | 30 | 30 | 28.4 | 28 | 24.4 | 35 | 30 | 35 | 16 | 37 | 54 | 30 |

TABLE 7

| | | Experimental Ex. 9 | Experimental Ex. 10 | Experimental Ex. 11 | Experimental Ex. 12 | Experimental Ex. 13 | Experimental Ex. 14 | Experimental Ex. 15 | Experimental Ex. 16 | Experimental Ex. 17 | Comp. Ex. 7 | Comp. Ex. 8 | Comp. Ex. 9 | Comp. Ex. 10 | Comp. Ex. 11 |
|---|---|---|---|---|---|---|---|---|---|---|---|---|---|---|---|
| Protruding portion dimension | Average maximum length (nm) | 32 | 30 | 31 | 33 | 30 | 29 | 30 | 27 | 26 | 12 | 6 | 48 | 42 | 51 |
| | Average maximum length/ average particle diameter | 0.29 | 0.29 | 0.29 | 0.25 | 0.28 | 0.22 | 0.29 | 0.25 | 0.23 | 0.10 | 0.15 | 0.21 | 0.70 | 0.23 |
| | Variation coefficient of average maximum length (%) | 17 | 20 | 18 | 20 | 23 | 21 | 23 | 32 | 31 | 11 | 10 | 53 | 45 | 54 |
| | Average maximum height (nm) | 10 | 10 | 11 | 12 | 10 | 9 | 10 | 8 | 7 | 4 | 2 | 5 | 3 | 8 |
| | Average maximum height/ average particle diameter | 0.09 | 0.10 | 0.10 | 0.09 | 0.09 | 0.07 | 0.10 | 0.07 | 0.06 | 0.03 | 0.05 | 0.02 | 0.05 | 0.04 |
| | Variation coefficient of average maximum height (%) | 24 | 23 | 24 | 25 | 23 | 23 | 23 | 22 | 23 | 16 | 15 | 16 | 15 | 14 |
| | Average maximum height/ average maximum length | 0.31 | 0.33 | 0.35 | 0.36 | 0.33 | 0.31 | 0.33 | 0.30 | 0.27 | 0.33 | 0.33 | 0.10 | 0.07 | 0.16 |
| Properties | Average particle diameter D50 (nm) | 110 | 103 | 106 | 130 | 109 | 130 | 103 | 110 | 112 | 120 | 40 | 230 | 60 | 220 |
| | Particle distribution D90/D10 | 2.00 | 1.99 | 2.10 | 2.02 | 2.05 | 2.02 | 2.02 | 2.02 | 2.02 | 2.21 | 2.30 | 2.15 | 2.00 | 2.10 |

TABLE 7-continued

| | Experimental Ex. 9 | Experimental Ex. 10 | Experimental Ex. 11 | Experimental Ex. 12 | Experimental Ex. 13 | Experimental Ex. 14 | Experimental Ex. 15 | Experimental Ex. 16 | Experimental Ex. 17 | Comp. Ex. 7 | Comp. Ex. 8 | Comp. Ex. 9 | Comp. Ex. 10 | Comp. Ex. 11 |
|---|---|---|---|---|---|---|---|---|---|---|---|---|---|---|
| True density $g/m^3$ | 1.97 | 1.96 | 1.98 | 1.94 | 2.00 | 1.94 | 1.94 | 1.97 | 1.95 | 2.10 | 1.94 | 2.00 | 2.15 | 2.10 |
| Average aspect ratio | 1.10 | 1.07 | 1.08 | 1.15 | 1.10 | 1.16 | 1.09 | 1.10 | 1.14 | 1.10 | 1.02 | 1.26 | 1.02 | 1.27 |
| Loss on heating (wt %) | 8 | 7 | 7 | 10 | 3 | 9 | 3 | 6 | 6 | 5 | 12 | 7 | 1 | 2 |
| Hydrophobization degree (volume %) | 65 | 63 | 67 | 58 | 62 | 65 | 61 | 57 | 59 | 68 | 50 | 43 | 55 | 45 |
| First specific surface area ($m^2/g$) | 38.4 | 38.6 | 37.4 | 30.7 | 35.2 | 28.8 | 36.8 | 32.0 | 31.9 | 26.8 | 83.5 | 14.0 | 49.3 | 13.4 |
| Nitrogen gas adsorption time when measuring first specific surface area (min:sec) | 3:13 | 3:14 | 3:14 | 3:03 | 3:14 | 3:06 | 3:20 | 3:14 | 3:14 | 2:45 | 2:50 | 1:45 | 2:24 | 1:53 |
| Nitrogen gas desorption time when measuring first specific surface area (min:sec) | 4:36 | 4:19 | 4:26 | 4:01 | 4:09 | 3:53 | 4:04 | 3:54 | 3:57 | 2:16 | 2:15 | 1:22 | 1:49 | 1:27 |
| Gas adsorption time/ gas desorption time | 0.70 | 0.75 | 0.73 | 0.76 | 0.78 | 0.80 | 0.82 | 0.83 | 0.82 | 1.21 | 1.26 | 1.28 | 1.32 | 1.30 |

TABLE 8

| | | Toners | | | | | | |
|---|---|---|---|---|---|---|---|---|
| | | Toner 9 | Toner 10 | Toner 11 | Toner 12 | Toner 13 | Toner 14 | Toner 15 |
| | | Experimental Exs. | | | | | | |
| | | Experimental Ex. 9 | Experimental Ex. 10 | Experimental Ex. 11 | Experimental Ex. 12 | Experimental Ex. 13 | Experimental Ex. 14 | Experimental Ex. 15 |
| After low temperature/ low humidity, durability test | Image concentration | A | A | A | A | A | A | A |
| | Fogging | A | A | A | A | A | B | B |
| After room temperature/ room humidity, durability test | Image concentration | A | A | A | A | A | A | A |
| | Fogging | A | A | A | A | A | A | A |
| After high temperature/ high humidity, durability test | Image concentration | A | B | B | B | B | B | B |
| | Fogging | A | A | A | B | B | B | B |
| After durability test in three environments* | Halftone fading | A | A | A | A | A | A | A |
| | Filming resistance | A | A | A | A | A | B | B |

| | | Toners | | | | | | |
|---|---|---|---|---|---|---|---|---|
| | | Toner 16 | Toner 17 | Comparative Toner 7 | Comparative Toner 8 | Comparative Toner 9 | Comparative Toner 10 | Comparative Toner 11 |
| | | Experimental Exs. | | | | | | |
| | | Experimental Ex. 16 | Experimental Ex. 17 | Comp. Ex. 7 | Comp. Ex. 8 | Comp. Ex. 9 | Comp. Ex. 10 | Comp. Ex. 11 |
| After low temperature/ low humidity, durability test | Image concentration | A | A | B | C | B | B | C |
| | Fogging | A | B | B | D | B | B | C |
| After room temperature/ room humidity, durability test | Image concentration | A | A | A | B | B | B | C |
| | Fogging | A | B | B | A | B | B | C |
| After high temperature/ high humidity, durability test | Image concentration | B | B | B | B | C | C | D |
| | Fogging | B | B | B | B | D | C | D |
| After durability test in three environments* | Halftone fading | B | B | B | B | C | C | D |

TABLE 8-continued

| | | | | | | | |
|---|---|---|---|---|---|---|---|
| Filming resistance | B | B | C | C | C | D | D |

*Three environments: low temperature/low humidity, room temperature/room humidity, high temperature/high humidity environments.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

| <Description of symbols> | |
|---|---|
| CP: mother particle | CP1: maximum inscribed circle |
| CP2: circular arc portion | PP: protruding portion |
| PP1: peripheral region | PP2: apex |
| L1: first straight line | L2: second straight line |

What is claimed is:

1. An external additive for toner comprising a particulate obtained from a silicone compound selected from a silane compound represented by Chemical Formula 1, a hydrolysis-condensation product of the silane compound, and a combination thereof, wherein the particulate has an average particle diameter ranging from about 50 nm to about 250 nm and a true density ranging from about 1.80 g/cm$^3$ to about 2.00 g/cm$^3$:

$Si(OR^1)_4$, [Chemical Formula 1]

wherein each $R^1$ is independently a C1 to C6 monovalent hydrocarbon group.

2. The external additive of claim 1, wherein the particulate has a first specific surface area of about 13 m$^2$/g to about 90 m$^2$/g, when measured by a gas adsorption method, and a ratio ($\alpha/\beta$) of the first specific surface area ($\alpha$) relative to the second specific surface area ($\beta$), calculated from an average particle diameter, of about 0.85 to about 1.75.

3. The external additive of claim 2, wherein a gas desorption time at measurement of the first specific surface area ($\alpha$) ranges from about 3 min to about 10 min.

4. The external additive of claim 1, wherein the average particle diameter is obtained by a dynamic light scattering method.

5. The external additive of claim 4, wherein a ratio of the gas adsorption time relative to the gas desorption time ranges from about 0.5 to about 1.0.

6. The external additive of claim 1, wherein the particulate has a loss on heating of about 3 wt % to about 13 wt % when increasing temperature from room temperature up to about 500° C.

7. The external additive of claim 1, wherein the particulate comprises a hydrophobic group on the surface thereof.

8. The external additive of claim 7, wherein the hydrophobic group comprises a trialkylsilyl group, a triphenylsilyl group, a diphenylmonoalkylsilyl group, a dialkylmonophenylsilyl group, or a combination thereof.

9. The external additive of claim 7, wherein a hydrophobization degree on the surface of particulate ranges from about 30 volume % to about 80 volume %.

10. The external additive of claim 7, wherein the hydrophobic group is introduced onto the surface of the particulate by contacting the surface of the particulate with a compound selected from a silazane compound represented by $R^2{}_3SiNHSiR^2{}_3$, wherein each $R^2$ is independently a C1 to C6 monovalent hydrocarbon group, a silane compound represented by $R^3{}_3SiX$, wherein $R^3$ is independently a C1 to C6 monovalent hydrocarbon group, and X is a hydroxyl group (—OH) or a hydrolytic group, and a combination thereof to introduce a trialkylsilyl group onto the surface of the particulate.

11. The external additive of claim 1, wherein the particulate has an average aspect ratio of about 1.00 to about 1.25 and comprises a protruding portion which is an area present outside a maximum inscribed circle, wherein the maximum inscribed circle is defined with reference to the contour of a transmission electron microscope image;

wherein the protruding portion has:

an average maximum length ranging from about 25 nm to about 45 nm, which is an average length of the chord connecting both ends of a circular arc of the maximum inscribed circle for the area in the shortest distance, a variation coefficient of the average maximum length ranging from about 10% to about 35%, a ratio of the average maximum length relative to the average particle diameter ranging from about 0.12 to about 0.30, an average maximum height ranging from about 5 nm to about 15 nm, which is an average of a shortest distance between the chord and the farthest point of the area outside the maximum inscribed circle in a radial direction, a variation coefficient of the average maximum height ranging from about 20% to about 45%, and a ratio of the average maximum height to the average particle diameter ranging from about 0.05 to about 0.15.

12. The external additive for toner of claim 11, wherein the ratio of the average maximum height to the average maximum length is about 0.2 to about 0.4.

13. A method of producing an external additive for toner including a particulate obtained from a silicone compound selected from a silane compound represented by Chemical Formula 1, a hydrolysis-condensation product of the silane compound, and a combination thereof, the method comprising mixing a silicon-containing component comprising a silicone compound selected from a silane compound represented by Chemical Formula 1, a hydrolysis-condensation product of the silane compound, and a combination thereof and a catalyst-containing component comprising a basic compound to prepare a mixed solution, and performing a condensation reaction of the silicone compound to prepare dispersed particulates in the mixed solution by maintaining the mixed solution at a first temperature (T1) for a first time (t1), and then maintaining the mixed solution at a second temperature (T2) for a second time (t2, $Si(OR^1)_4$, Chemical Formula 1:

wherein each $R^1$ is independently a C1 to C6 monovalent hydrocarbon group.

14. The method of claim 13, wherein, at the time of mixing the silicon-containing component and the catalyst-containing component, the temperature of the silicon-containing component (TA, in ° C.) and the temperature of the catalyst-containing component (TB, in ° C.) satisfy the following:

$$2° \text{ C.} < TA < 60° \text{ C.},$$

$$TA < TB, \text{ and}$$

$$TB - 40° \text{ C.} < TA < TB - 3° \text{ C.}$$

15. The method of claim 13, wherein, at the time of mixing the silicon-containing component and the catalyst-containing component, the temperature of the silicon-containing component (TA, in ° C.) and the temperature of the catalyst-containing component (TB, in ° C.) satisfy the following:

$$0° \text{ C.} \leq TA \leq 10° \text{ C.},$$

$$20° \text{ C.} \leq TB \leq 50° \text{ C.},$$

$$10° \text{ C.} \leq TB - TA \leq 50° \text{ C.}$$

16. The method of claim 13, wherein the value from integrating the first temperature (T1) over the first time (t1) is about 5° C.·hour to about 90° C.·hour; and the value from integrating the second temperature (T2) over the second time (t2) is about 200° C.·hour to about 700° C.·hour.

17. The method of claim 16, wherein the first temperature (T1) and the second temperature (T2) satisfy the following:

$$5° \text{ C.} \leq T1 \leq 15° \text{ C.}$$

$$30° \text{ C.} \leq T2 \leq 50° \text{ C., and}$$

$$15° \text{ C.} \leq T2 - T1 \leq 45° \text{ C.}$$

wherein the particulate comprises a protruding portion on the surface thereof.

18. The method of claim 13, wherein a temperature increasing rate for transition from the first temperature (T1) to the second temperature (T2) is about 0.5° C./minute to about 10° C./minute.

19. The method of claim 13, further comprising hydrophobizing the surface of the particulate.

20. A toner comprising the external additive for toner of claim 1.

21. A toner comprising the external additive for toner obtained by the method of claim 13.

* * * * *